US010391031B2

(12) United States Patent
Yevmenenko et al.

(10) Patent No.: US 10,391,031 B2
(45) Date of Patent: Aug. 27, 2019

(54) ADAPTER FOR VIAL ACCESS DEVICE

(71) Applicant: Becton Dickinson and Company Limited, Dun Laoghaire (IE)

(72) Inventors: Yan Yevmenenko, New York, NY (US); Ross Weir, Cambridge (GB); Lasse Wesseltoft Mogensen, St. Ives (GB)

(73) Assignee: Becton Diskinson and Company Limited, Dun Laoghaire (IE)

( * ) Notice: Subject to any disclaimer, the term of this patent is extended or adjusted under 35 U.S.C. 154(b) by 413 days.

(21) Appl. No.: 15/034,388

(22) PCT Filed: Nov. 4, 2014

(86) PCT No.: PCT/US2014/063896

§ 371 (c)(1),
(2) Date: May 4, 2016

(87) PCT Pub. No.: WO2015/069649

PCT Pub. Date: May 14, 2015

(65) Prior Publication Data

US 2016/0287475 A1 Oct. 6, 2016

Related U.S. Application Data

(60) Provisional application No. 61/900,562, filed on Nov. 6, 2013.

(51) Int. Cl.
*A61J 1/20* (2006.01)

(52) U.S. Cl.
CPC ..... *A61J 1/201* (2015.05); *A61J 1/2055* (2015.05); *A61J 1/2065* (2015.05); *A61J 1/2072* (2015.05); *A61J 1/2089* (2013.01); *A61J 1/2096* (2013.01)

(58) Field of Classification Search
CPC ..... A61J 1/201; A61J 1/2055; A61J 1/2065; A61J 1/2072; A61J 1/2089; A61J 1/2096
See application file for complete search history.

(56) References Cited

U.S. PATENT DOCUMENTS

| | | | | |
|---|---|---|---|---|
| 5,112,315 | A | 5/1992 | Gloyer et al. | |
| 5,647,845 | A | 7/1997 | Haber et al. | |
| 5,893,397 | A | 4/1999 | Peterson et al. | |
| 6,875,205 | B2 * | 4/2005 | Leinsing | A61J 1/2089 206/828 |
| 9,839,580 | B2 * | 12/2017 | Lev | A61J 1/1406 |
| 2002/0104584 | A1 | 8/2002 | Spero et al. | |
| 2004/0199139 | A1 | 10/2004 | Fowles et al. | |

FOREIGN PATENT DOCUMENTS

| | | | |
|---|---|---|---|
| EP | 0783879 | A2 | 7/1997 |
| JP | 5502186 | A | 4/1993 |
| JP | 200739121 | A | 2/2007 |

* cited by examiner

*Primary Examiner* — Leslie R Deak
(74) *Attorney, Agent, or Firm* — The Webb Law Firm

(57) ABSTRACT

A system (10) includes a vial access device (12) including a spike (38), with the vial access device attachable to a first vial (80) defining a first vial size (81), and an adapter (14) transitionable between a shield position in which the adapter is attachable to the vial access device such that the adapter shields the spike of the vial access device and a vial position in which the adapter is attachable to a second vial (90) defining a second vial size (91), the second vial size different than the first vial size.

15 Claims, 54 Drawing Sheets

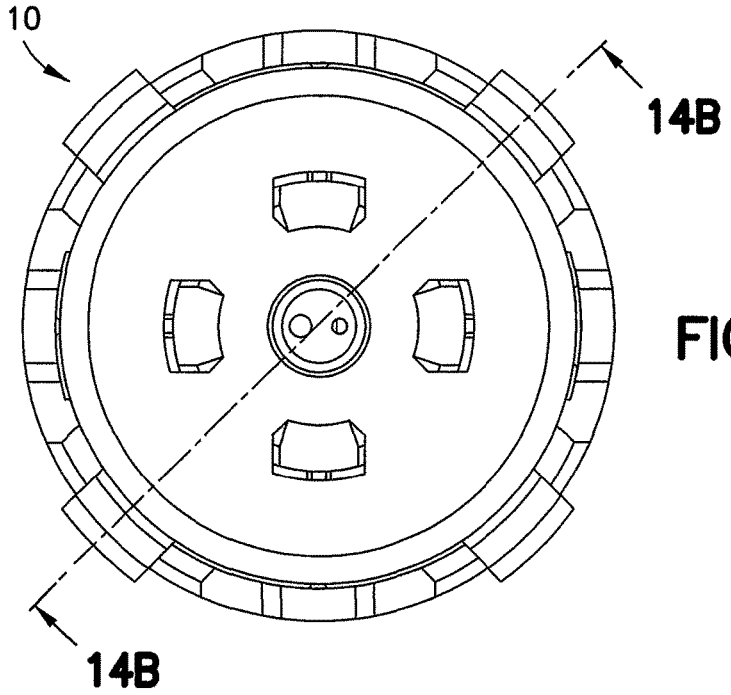
FIG. 14A
FIG. 14B
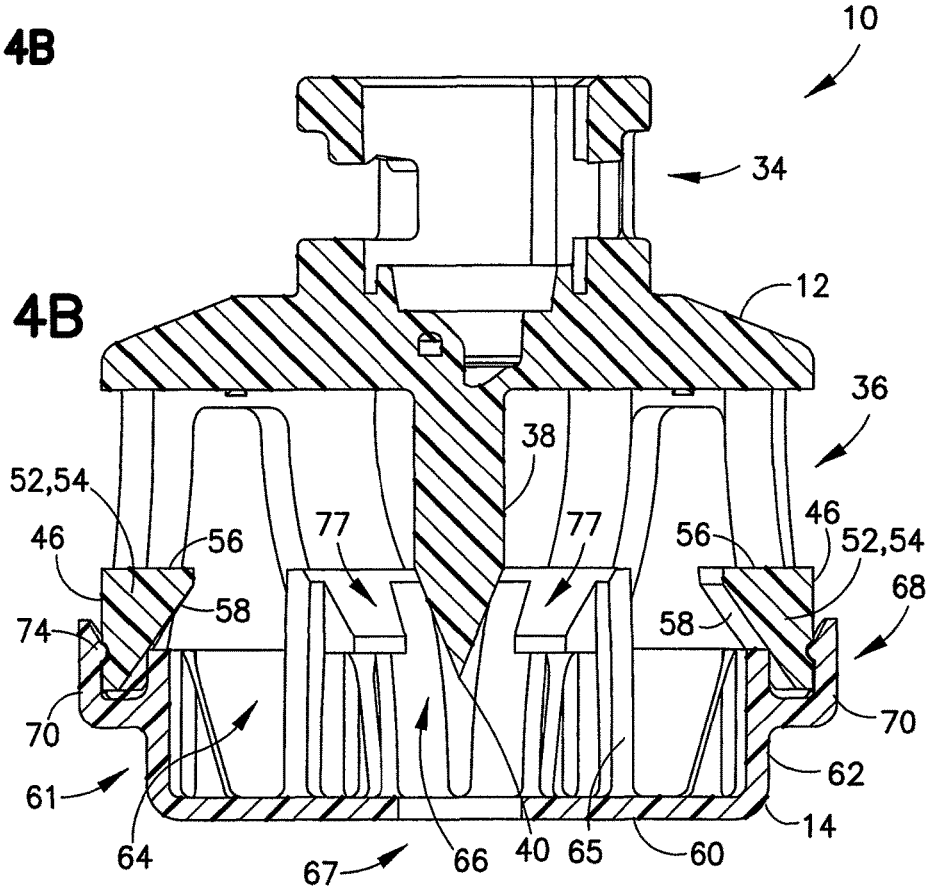

ADAPTER FOR VIAL ACCESS DEVICE

CROSS-REFERENCE TO RELATED APPLICATIONS

This application is the United States national phase of International Application No. PCT/US2014/063896 filed Nov. 4, 2014, the disclosure of which is hereby incorporated in its entirety by reference.

BACKGROUND OF THE INVENTION

1. Field of the Disclosure

The present disclosure relates generally to an adapter for a vial access device. More particularly, the present disclosure relates to an adapter that is transitionable between a first configuration in which the adapter is attachable to a vial access device, which is attachable to a first vial, such that the adapter shields a spike of the vial access device and a second configuration in which the adapter is attachable to a second vial.

2. Description of the Related Art

Health care providers reconstituting, transporting, and administering hazardous drugs, such as cancer treatments, can put health care providers at risk of exposure to these medications and present a major hazard in the health care environment. For example, nurses treating cancer patients risk being exposed to chemotherapy drugs and their toxic effects. Unintentional chemotherapy exposure can affect the nervous system, impair the reproductive system, and bring an increased risk of developing blood cancers in the future. In order to reduce the risk of health care providers being exposed to toxic drugs, the closed transfer of these drugs becomes important.

Systems for the closed transfer of fluids include vial access devices that include a spike for drug vial access. The spike of a vial access device may result in a patient and/or healthcare worker receiving an inadvertent spike stick injury. Accordingly, there is a need for a component to prevent spike stick injuries.

SUMMARY OF THE INVENTION

In one aspect, a system includes a vial access device including a spike, with the vial access device attachable to a first vial defining a first vial size, an adapter transitionable between a shield position in which the adapter is attachable to the vial access device such that the adapter shields the spike of the vial access device and a vial position in which the adapter is attachable to a second vial defining a second vial size, the second vial size different than the first vial size.

The vial access device may further include an adapter connection element and the adapter may further include an access device connection element and a vial connection element, with the adapter transitionable between the shield position in which the access device connection element is attachable to the adapter connection element of the vial access device to secure the adapter to the vial access device such that the adapter shields the spike of the vial access device and the vial position in which the vial connection element is attachable to the second vial to secure the adapter to the second vial. The access device connection element of the adapter may be an external latch or an internal latch. The vial connection element of the adapter may be a plurality of vial grip members. The plurality of vial grip members may be elastically deformable. The vial access device may further include a first connection element attachable to the first vial to secure the vial access device to the first vial. The second vial size may be less than the first vial size. The system may further include a first vial defming a first vial size, and a second vial defining a second vial size, where the second vial size is different than the first vial size, where the vial access device further comprises a first connection element attachable to the first vial to secure the vial access device to the first vial, and where the adapter is attachable to the second vial. The first connection element of the vial access device may be configured to secure the adapter to the vial access device when the adapter is in the vial position. The adapter may include an alignment guide configured to position the vial access device during installation of the vial access device onto the second vial when the adapter is in the vial position.

The adapter may include a horizontal shield wall, an outer portion extending from the periphery of the horizontal shield wall, and an inner portion extending from the horizontal shield wall. The horizontal shield wall of the adapter may define a spike cavity that is configured to receive the spike when the adapter is in the vial position. The access device connection element may include a plurality of external latches spaced around a periphery of the outer portion of the adapter, with the vial access device defining a plurality of slots configured to receive the plurality of external latches when the adapter is in the shield position. The access device connection element may include a plurality of locking apertures spaced around a periphery of the outer portion of the adapter, with the vial access device comprising a locking protrusion configured to be received by the plurality of locking apertures when the adapter is in the shield position.

In a further aspect, a method of accessing a vial includes providing a vial access device and an adapter, where the vial access device comprising a spike and a first connection element attachable to a first vial defining a first vial size to secure the vial access device to the first vial. The method further includes removing the adapter from a shield position in which the adapter is attached to the vial access device with the adapter shielding the spike of the vial access device, and attaching the adapter to a second vial defining a second vial size.

The first vial size may be different from the second vial size. For example, the second vial size may be smaller than the first vial size. The method may further include securing the vial access device to the adapter after the adapter is attached to the second vial with the spike of the vial access device entering the second vial. The adapter may include a plurality of vial grip members with the adapter being attached to the second vial via the plurality of vial grip members of the adapter, and the vial access device may include a plurality of vial grip members with the vial access device attached to the adapter via the plurality of vial grip members of the vial access device.

BRIEF DESCRIPTION OF THE DRAWINGS

The above-mentioned and other features and advantages of this disclosure, and the manner of attaining them, will become more apparent and the disclosure itself will be better understood by reference to the following descriptions of aspects of the disclosure taken in conjunction with the accompanying drawings, wherein:

FIG. 14A is a bottom view of an adapter attached to a vial access device in a shield position in accordance with an aspect of the present invention.

FIG. 14B is a cross-sectional view of an adapter attached to a vial access device in a shield position taken along line 14B-14B of FIG. 14A in accordance with an aspect of the present invention.

Corresponding reference characters indicate corresponding parts throughout the several views. The exemplifications set out herein illustrate exemplary aspects of the disclosure, and such exemplifications are not to be construed as limiting the scope of the disclosure in any manner.

DETAILED DESCRIPTION

Figure 1A:
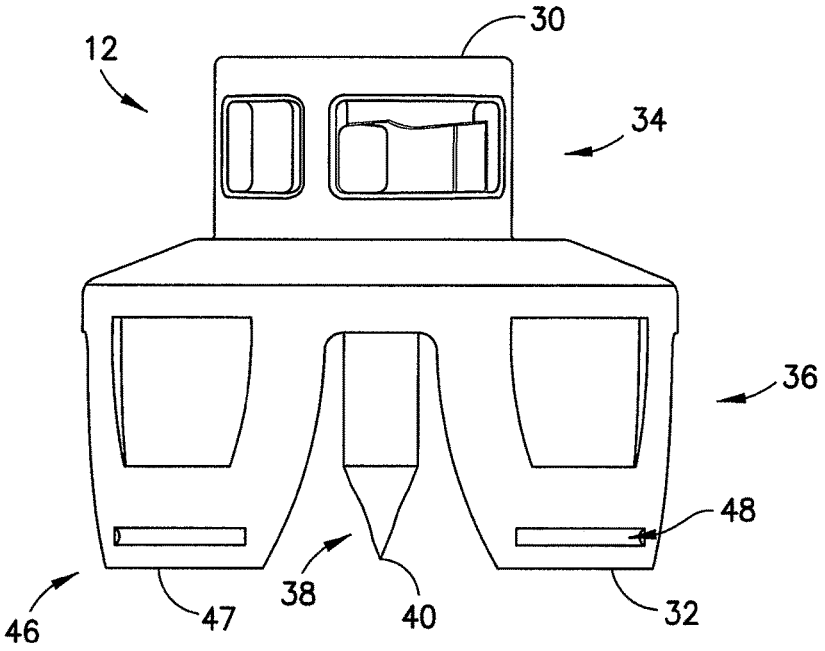
FIG. 1A is a side elevation view of a vial access device in accordance with an aspect of the present invention.

The following description is provided to enable those skilled in the art to make and use the described aspects contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary aspects of the invention. Hence, specific dimensions and other physical characteristics related to the aspects disclosed herein are not to be considered as limiting.

In the following discussion, "distal" refers to a direction generally toward an end of a component adapted for contact with a container, such as a vial, and "proximal" refers to the opposite direction of distal, i.e., away from the end of a component adapted for engagement with the container. For purposes of this disclosure, the above-mentioned references are used in the description of the components of a system in accordance with the present disclosure.

FIGS. 1A-5, 11-16B, and 23-24B illustrate a first exemplary aspect of the present disclosure. Referring to FIGS. 1A-5, 11-16B, and 23-24B, a first system for the closed transfer of fluids 10 includes a vial access device 12 attachable to a first vial 80 having a first vial size 81 (FIGS. 21-22B) and a first adapter 14 transitionable between a shield position (FIGS. 11-14B) in which first adapter 14 is attachable to vial access device 12 such that first adapter 14 shields a spike member 38 of vial access device 12 and a vial position (FIGS. 15-16B and 23-24B) in which first adapter 14 is attachable to a second vial 90 defining a second vial size 91, the second vial size 91 different than the first vial size 81. In this manner, first adapter 14 provides reversibility between a shield configuration in which first adapter 14 shields spike member 38 of vial access device 12 to prevent spike stick injuries and an adapter configuration in which first adapter 14 allows first system 10 to accommodate a plurality of vials having different sizes.

Figure 21:
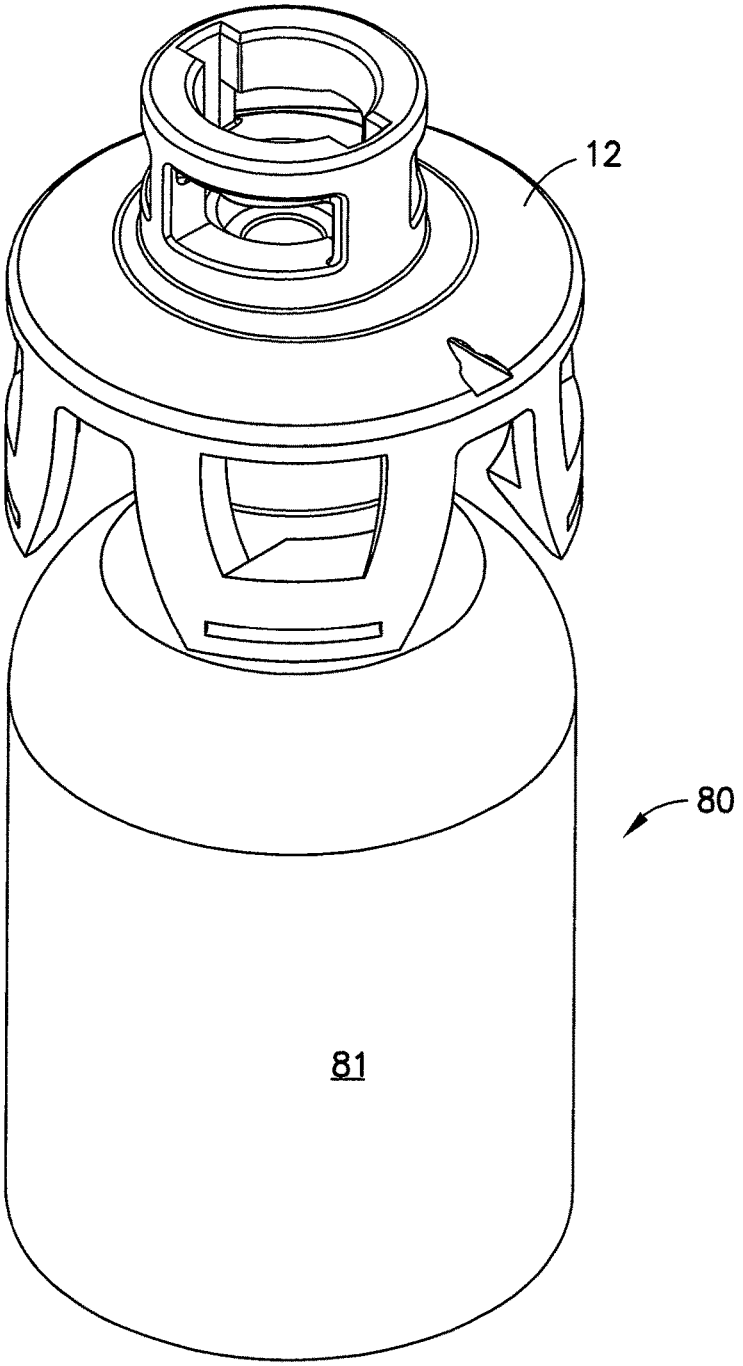
FIG. 21 is a perspective view of a vial access device connected to a first vial in accordance with an aspect of the present invention.
Figure 22A:
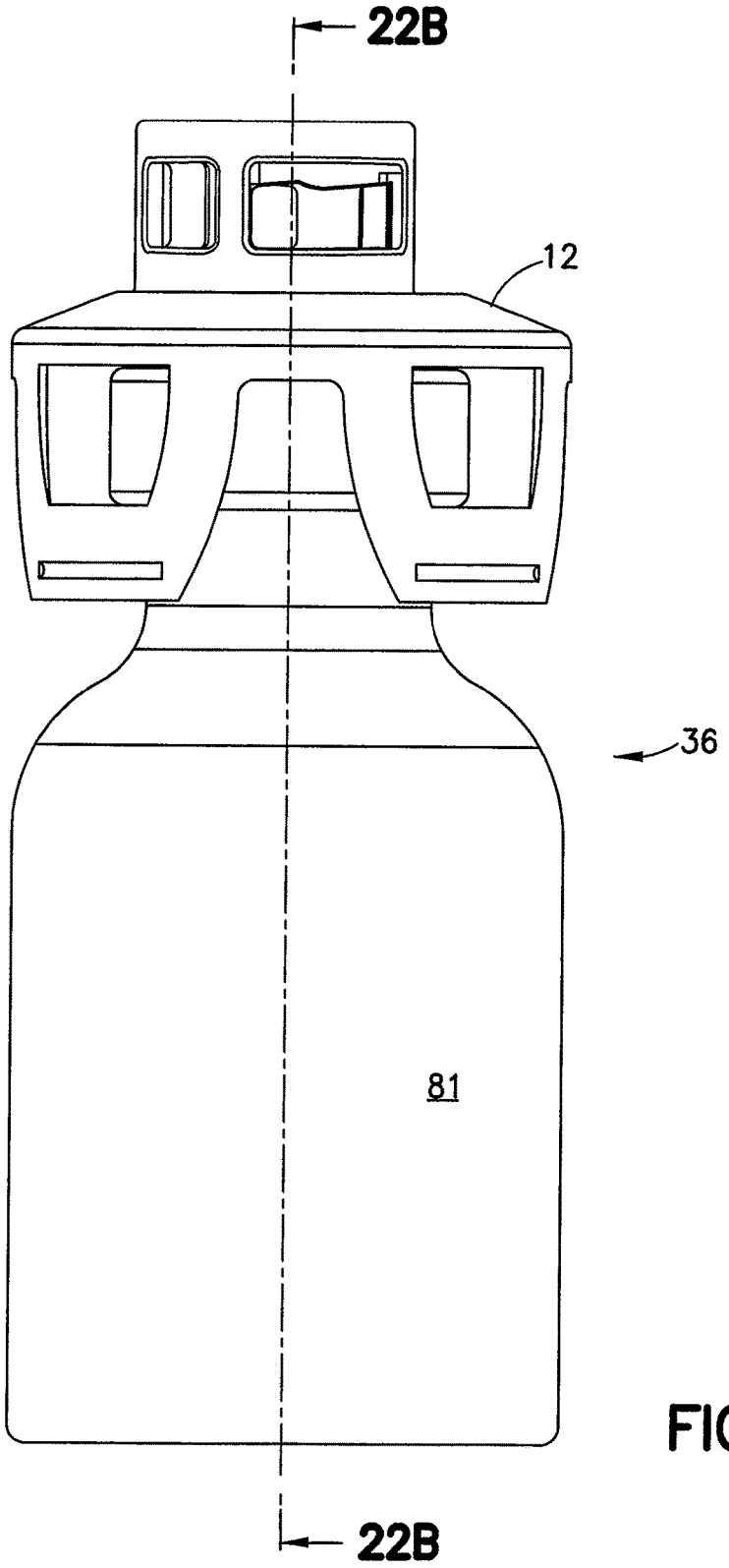
FIG. 22A is a side elevation view of a vial access device connected to a first vial in accordance with an aspect of the present invention.
Figure 22B:
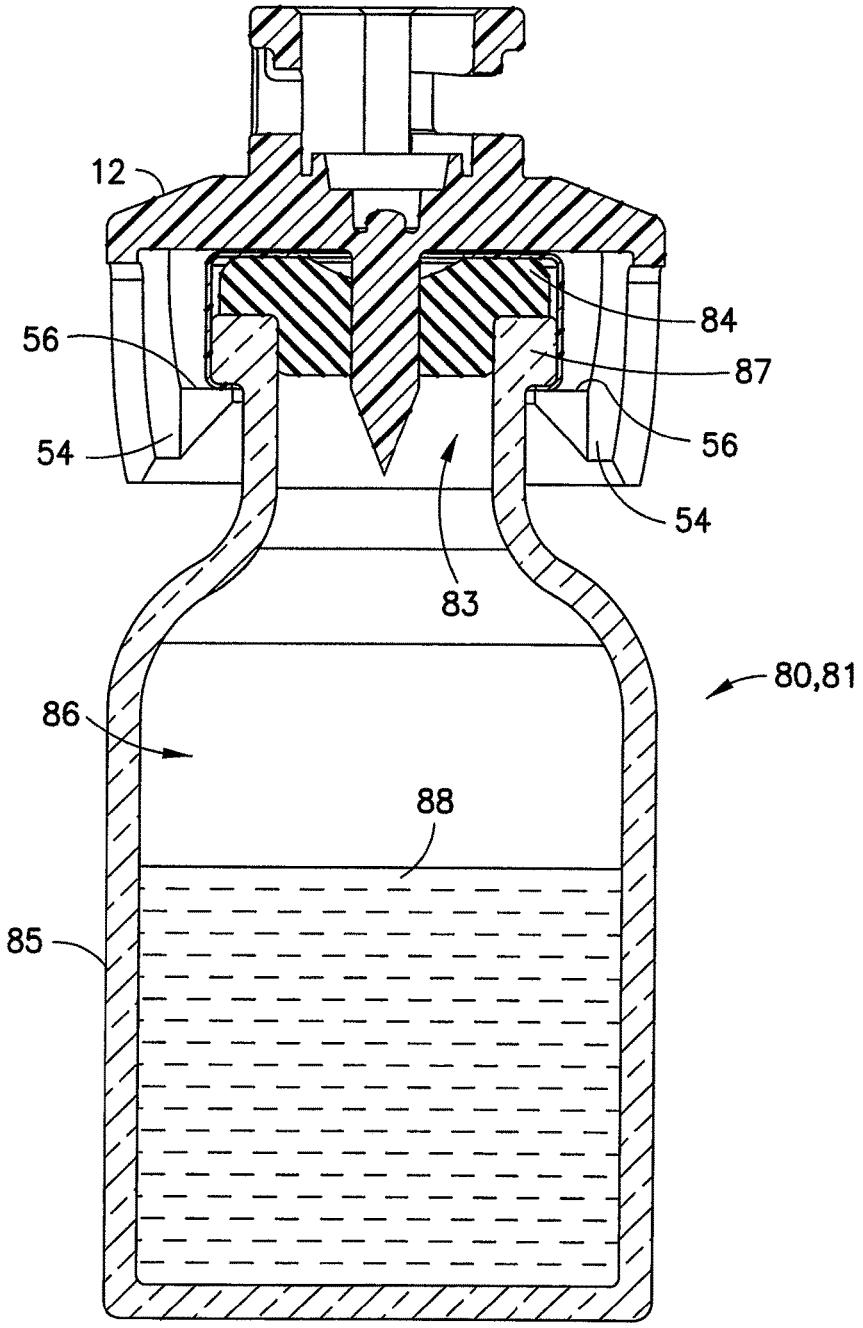
FIG. 22B is a cross-sectional view of the vial access device connected to the first vial taken along line 22B-22B of FIG. 22A in accordance with an aspect of the present invention.
Figure 23:
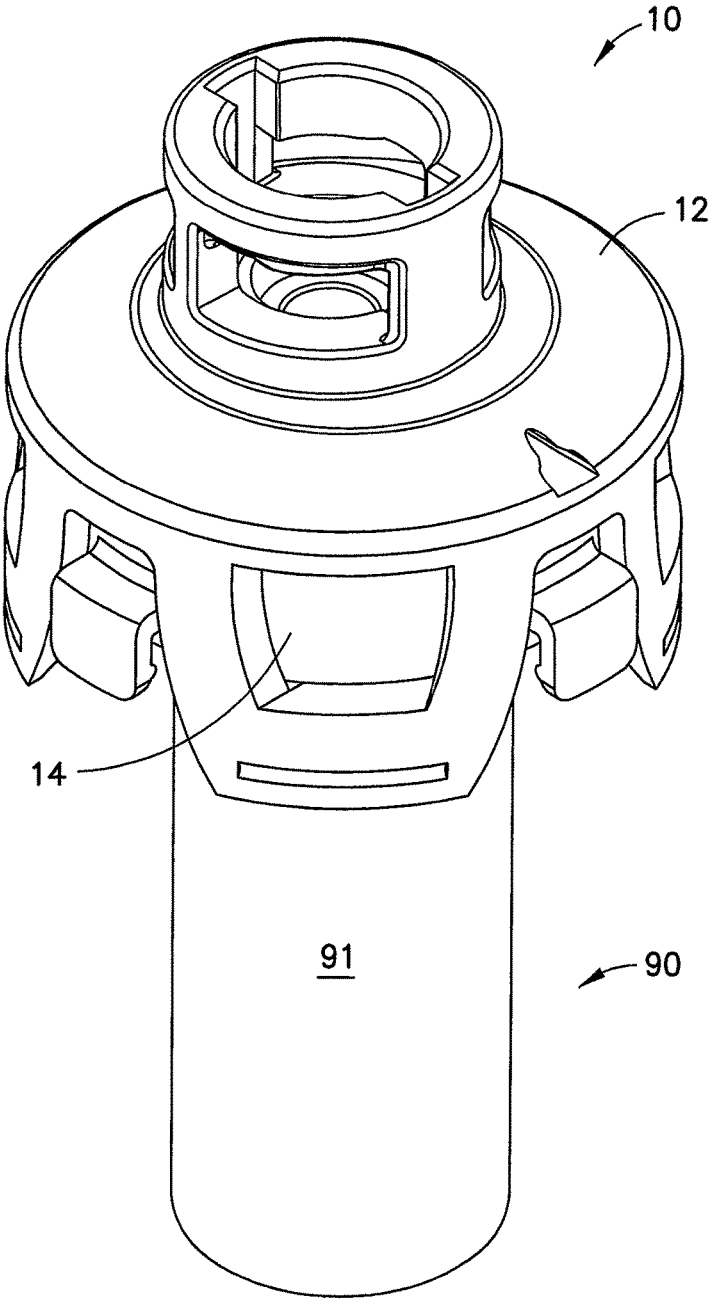
FIG. 23 is a perspective view of a vial access device and an adapter connected to a second vial in accordance with an aspect of the present invention.
Figure 24A:
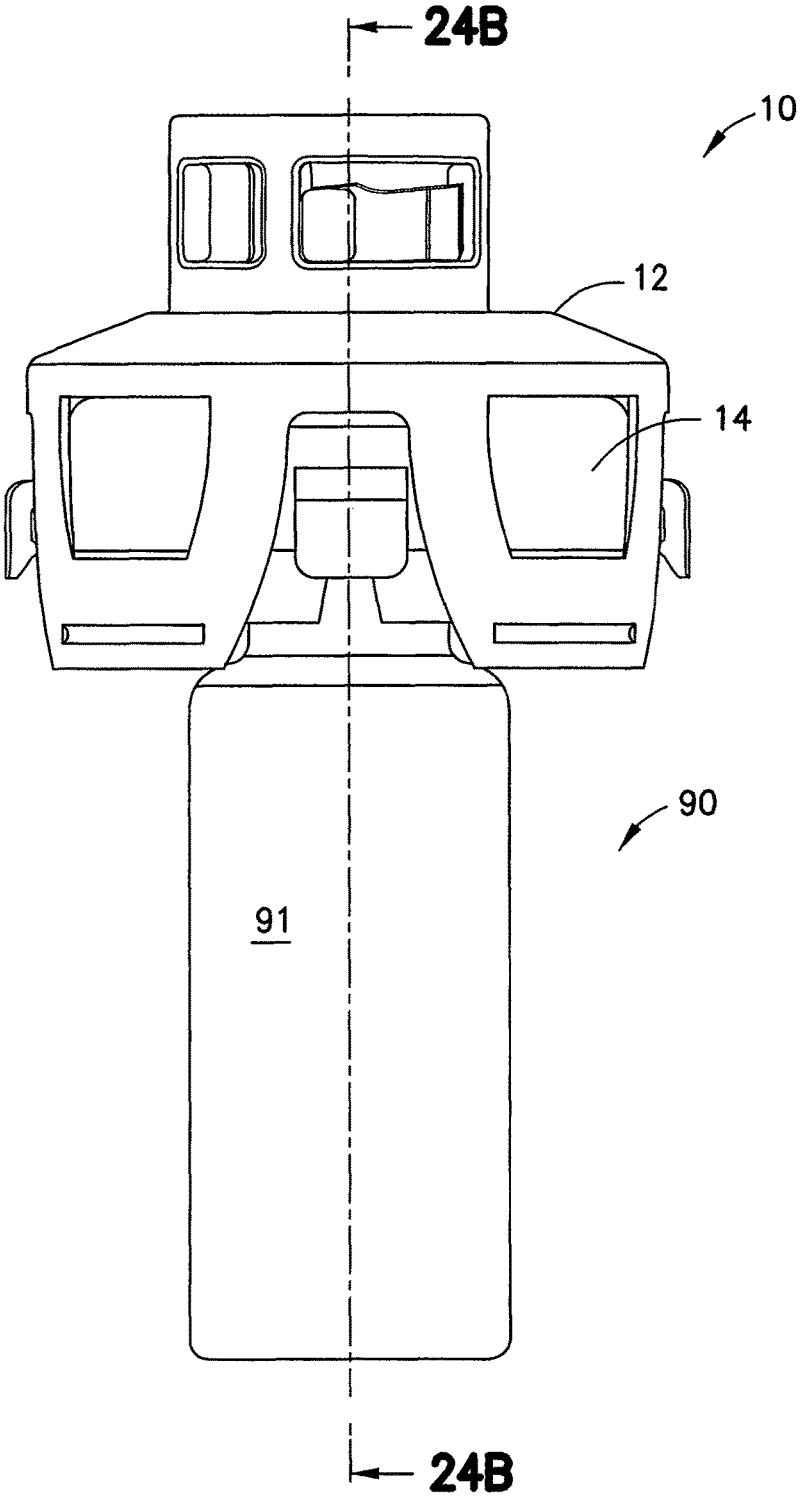
FIG. 24A is a side elevation view of a vial access device and an adapter connected to a second vial in accordance with an aspect of the present invention.
Figure 24B:
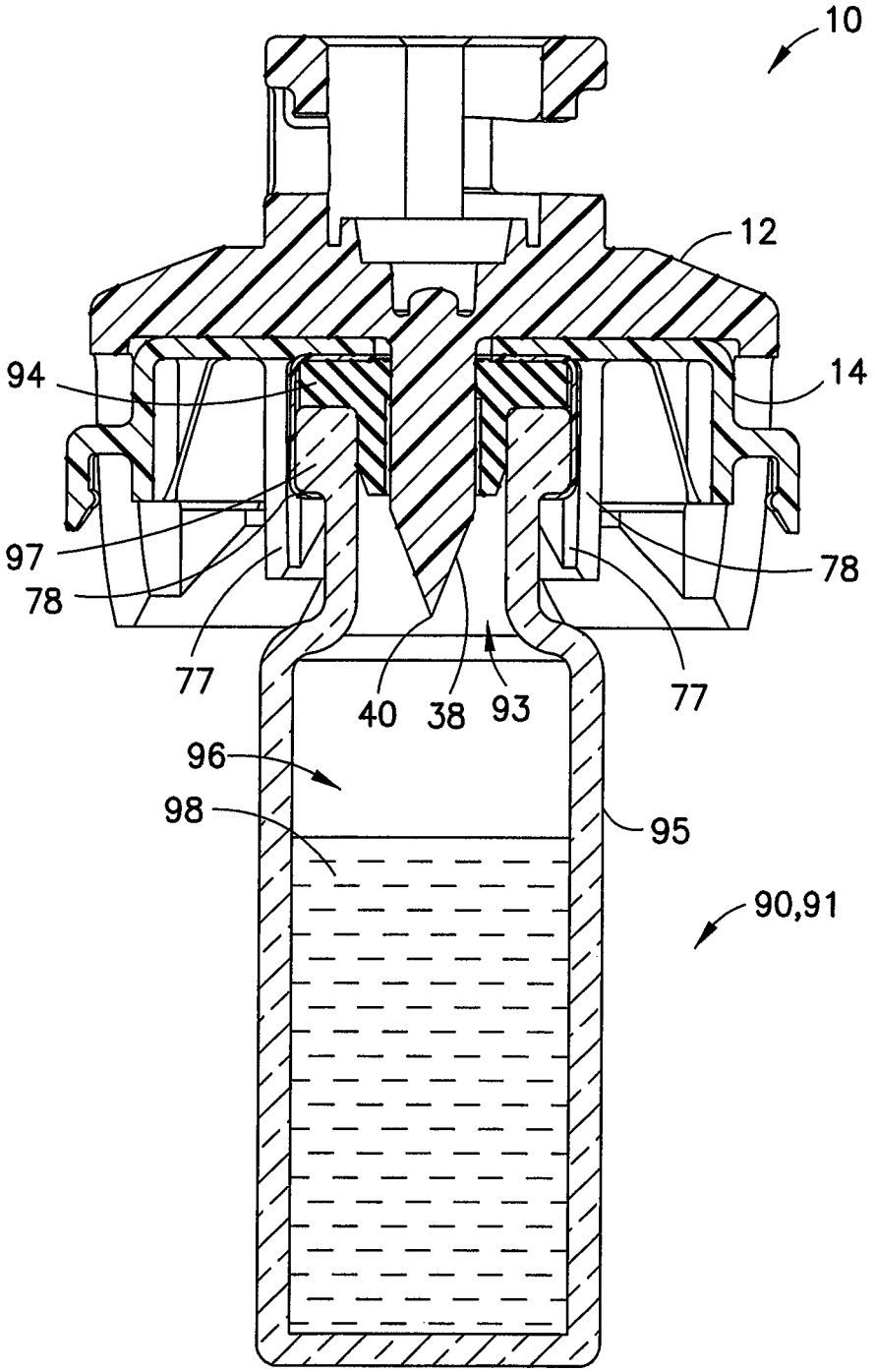
FIG. 24B is a cross-sectional view of the vial access device and the adapter connected to the second vial taken along line 24B-24B of FIG. 24A in accordance with an aspect of the present invention.

Referring to FIGS. 21-22B, with vial access device 12 attached to first vial 80, vial access device 12 provides substantially leak-proof sealing during engagement of a cannula with a vial, during transfer of a substance from a vial chamber to a barrel chamber via the cannula, and during disengagement of the cannula from the vial. Referring to FIGS. 23-24B, with vial access device 12 attached to second vial 90 via first adapter 14, first system 10 provides substantially leak-proof sealing during engagement of a cannula with a vial, during transfer of a substance from a vial chamber to a barrel chamber via the cannula, and during disengagement of the cannula from the vial. The leak-proof sealing of the first system 10 substantially prevents leakage of both air and liquid during use of the first system 10. First system 10 is compatible with a needle and syringe assembly for accessing a medication contained within a vial for administering the medication to a patient. First system 10 is also compatible to be used with a drug reconstitution system.

As described above, first system 10 is capable of accommodating a plurality of vials having different sizes. For example, referring to FIGS. 21-22B, first vial 80 defining a first vial size 81 may be a standard drug vial of any type having an open head portion 83 covered by a pierceable septum 84 of an elastomeric material. Walls 85 of first vial 80 define vial chamber 86 for containing a first substance 88. First vial 80 includes flange 87 located adjacent open head portion 83. Vial septum 84 is engaged with head portion 83 of first vial 80 to seal the first substance 88 within vial chamber 86. Referring to FIGS. 23-26B, second vial 90 defining a second vial size 91 may be a standard drug vial of any type having an open head portion 93 covered by a pierceable septum 94 of an elastomeric material. Walls 95 of second vial 90 define vial chamber 96 for containing a second substance 98. Second vial 90 includes flange 97 located adjacent open head portion 93. Vial septum 94 is engaged with head portion 93 of second vial 90 to seal the second substance 98 within vial chamber 96. In one aspect, second vial size 91 is less than first vial size 81.

Vial access device 12 and first adapter 14 provide a first system 10 that is capable of accommodating a plurality of vials having different sizes, e.g., first vial 80 having first vial size 81 and second vial 90 having second vial size 91. In one aspect, it is envisioned that vial access device 12 and first adapter 14 are compatible with a first vial 80 comprising a 20 mm vial and a second vial 90 comprising a 13 mm vial. In another aspect, it is envisioned that vial access device 12 and first adapter 14 are compatible with a first vial 80 comprising a 28 mm vial and a second vial 90 comprising a 20 mm vial. In another aspect, it is envisioned that vial access device 12 and first adapter 14 are compatible with a first vial 80 comprising a 32 mm vial and a second vial 90 comprising a 28 mm vial. In other aspects, it is envisioned that vial access device 12 and first adapter 14 are compatible with a first vial 80 comprising other vial sizes and a second vial 90 comprising other vial sizes, wherein the second vial size is less than the first vial size.

FIGS. 1A-1D, 6-10, 17-20B, and 25-26B illustrate a second exemplary aspect of the present disclosure. Referring to FIGS. 1A-1D, 6-10, 17-20B, and 25-26B, a second system for the closed transfer of fluids 20 includes vial access device 12 attachable to first vial 80 having first vial size 81 (FIGS. 21-22B) and a second adapter 24 transitionable between a shield position (FIGS. 17-18B) in which second adapter 24 is attachable to vial access device 12 such that second adapter 24 shields a spike member 38 of vial access device 12 and a vial position (FIGS. 19-20B and 25-26B) in which second adapter 24 is attachable to second vial 90 defining second vial size 91, the second vial size 91 different than the first vial size 81. In this manner, second adapter 24 provides reversibility between a shield configuration in which second adapter 24 shields spike member 38 of vial access device 12 to prevent spike stick injuries and an adapter configuration in which second adapter 24 allows second system 20 to accommodate a plurality of vials having different sizes.

Figure 25:
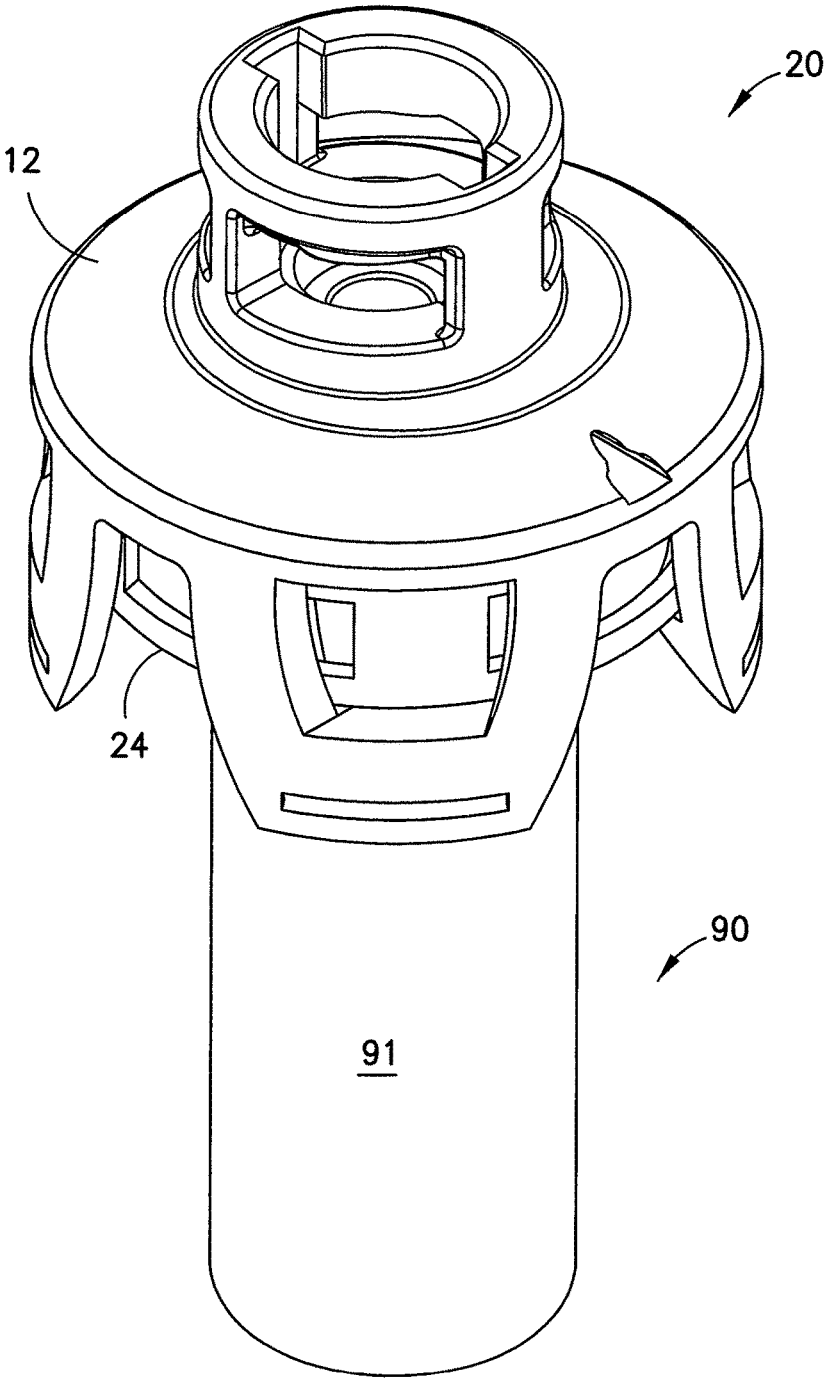
FIG. 25 is a perspective view of a vial access device and an adapter connected to a second vial in accordance with another aspect of the present invention.
Figure 26A:
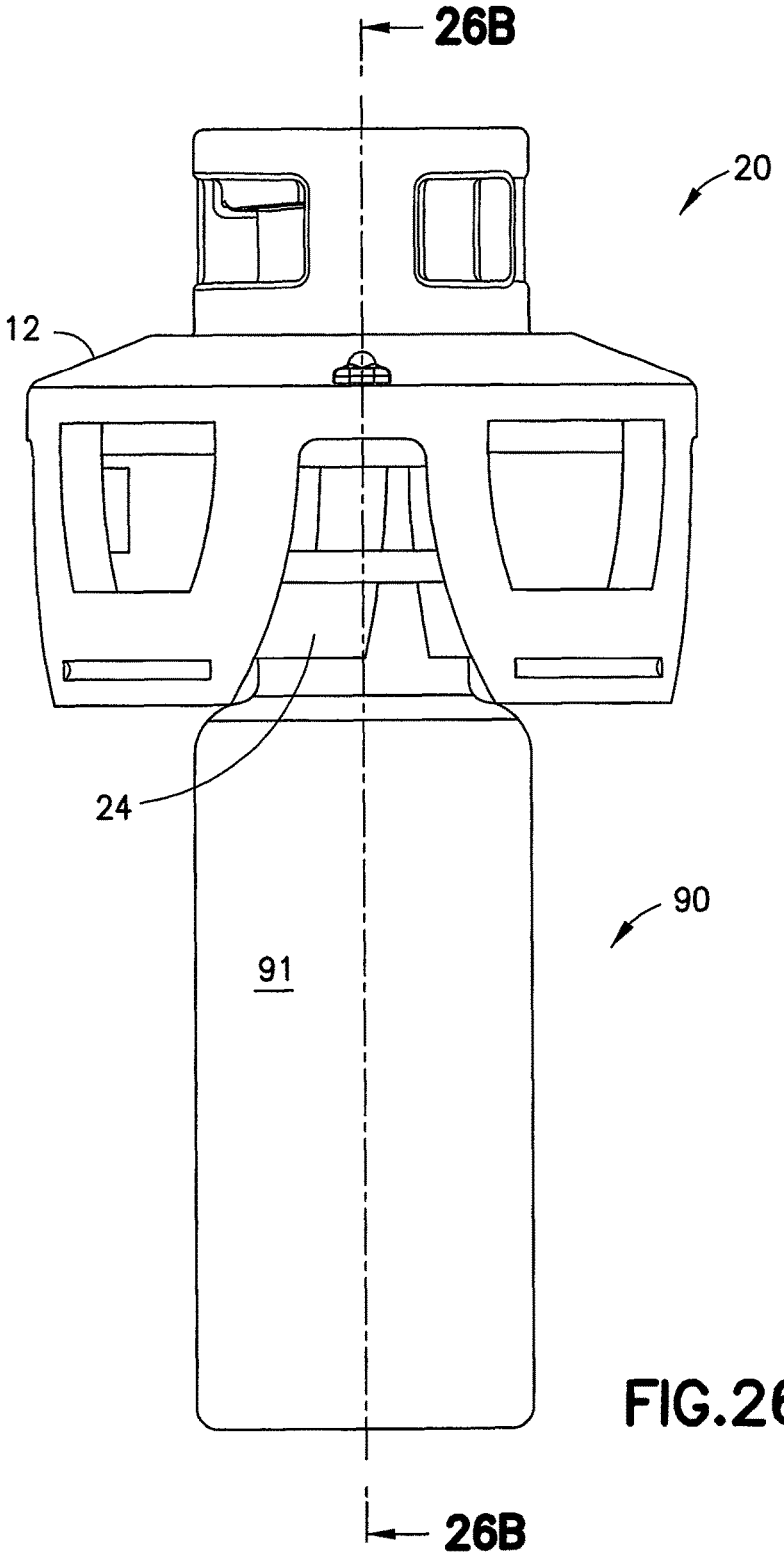
FIG. 26A is a side elevation view of a vial access device and an adapter connected to a second vial in accordance with another aspect of the present invention.
Figure 26B:
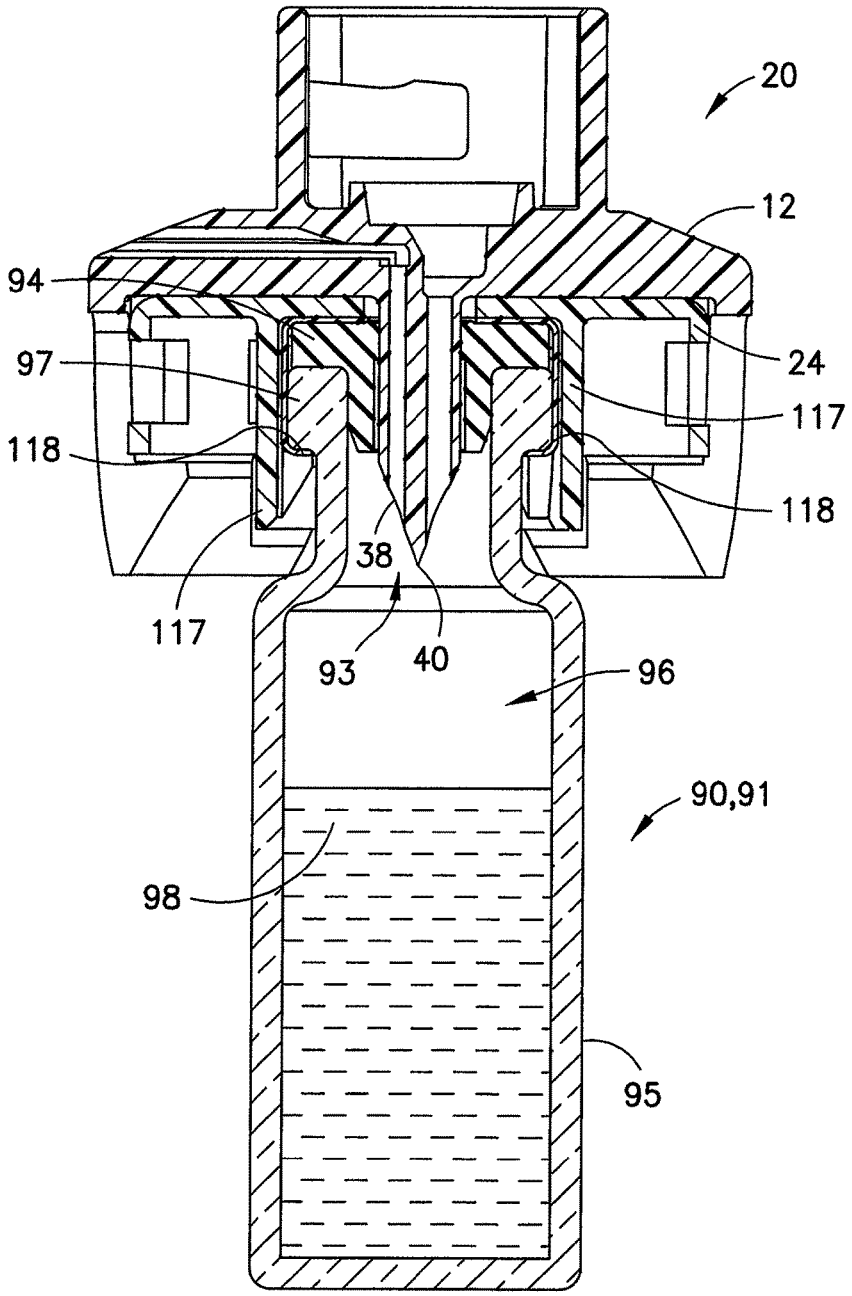
FIG. 26B is a cross-sectional view of the vial access device and the adapter connected to the second vial taken along line 26B-26B of FIG. 26A in accordance with another aspect of the present invention.

Referring to FIGS. 21-22B, with vial access device 12 attached to first vial 80, vial access device 12 provides substantially leak-proof sealing during engagement of a cannula with a vial, during transfer of a substance from a vial chamber to a barrel chamber via the cannula, and during disengagement of the cannula from the vial. Referring to FIGS. 25-26B, with vial access device 12 attached to second vial 90 via second adapter 24, second system 20 provides substantially leak-proof sealing during engagement of a cannula with a vial, during transfer of a substance from a vial chamber to a barrel chamber via the cannula, and during disengagement of the cannula from the vial. The leak-proof sealing of the second system 20 substantially prevents leakage of both air and liquid during use of the second system 20. Second system 20 is compatible with a needle and syringe assembly for accessing a medication contained within a vial for administering the medication to a patient. Second system 20 is also compatible to be used with a drug reconstitution system.

Vial access device 12 and second adapter 24 provide a second system 20 that is capable of accommodating a plurality of vials having different sizes, e.g., first vial 80 having first vial size 81 and second vial 90 having second vial size 91. In one aspect, it is envisioned that vial access device 12 and second adapter 24 are compatible with a first vial 80 comprising a 20 mm vial and a second vial 90 comprising a 13 mm vial. In another aspect, it is envisioned that vial access device 12 and second adapter 24 are compatible with a first vial 80 comprising a 28 mm vial and a second vial 90 comprising a 20 mm vial. In another aspect, it is envisioned that vial access device 12 and second adapter 24 are compatible with a first vial 80 comprising a 32 mm vial and a second vial 90 comprising a 28 mm vial. In other aspects, it is envisioned that vial access device 12 and second adapter 24 are compatible with a first vial 80 comprising other vial sizes and a second vial 90 comprising other vial sizes, wherein the second vial size is less than the first vial size.

Referring to FIGS. 1A-1D, vial access device 12 generally includes first or proximal end 30; opposing second or distal end 32; neck portion 34 disposed adjacent first end 30; body portion 36 disposed adjacent second end 32; spike member 38 including piercing tip 40; fluid transfer channel 42; pressure normalization channel 44; first adapter connection elements 46 comprising end walls 47 and slots 48; second adapter connection elements 50 comprising locking protrusions 51; and vial connection element 52 comprising vial grip members 54, hook protrusions 56, and angled walls 58.

First end 30 of vial access device 12 is substantially formed by neck portion 34. In one aspect, neck portion 34 may include a guiding groove arranged therein to guide corresponding guiding protrusions on a syringe adapter, for example, to establish a secure attachment between the syringe adapter and vial access device 12 after which fluid communication can be established.

Referring to FIGS. 1A-1D, in one aspect, first end 30 of vial access device 12 may contain a pierceable barrier member. The pierceable barrier member provides for a liquid and gas tight seal between a piercing member and the pierceable barrier member during fluid transfer to minimize leakage and thereby prevent exposure of hazardous medicaments to a user. The pierceable barrier member provides a self-sealing seal that, with vial access device 12 attached to a vial, provides a leak-proof seal preventing any substance contained within the vial chamber from being exposed to a health care provider reconstituting, transporting, or administering a drug using system 10. In one aspect, the pierceable barrier member comprises a resilient material. For example, the pierceable barrier member is preferably a unitary device molded of any flexible, elastomeric material conventionally used for fabricating gas-proof closures. The pierceable barrier member may be formed of a natural rubber material, polyurethane elastomers, butyl rubbers, or similar materials. It is contemplated that the pierceable barrier member is formed of a material having a Shore A hardness of approximately 10 to 50. It is also envisioned that the pierceable barrier member can have other material hardness values that would provide an appropriate self-sealing material to provide a leak-proof seal with a vial septum of a vial and an syringe adapter, thereby preventing any liquid or medication residue from being exposed to a health care provider reconstituting, transporting, or administering a drug using system 10.

Second end 32 of vial access device 12 is substantially formed by body portion 36. Referring to FIGS. 1A-1D, protruding out from body portion 36 at second end 32 of vial access device 12 is a piercing member or spike member 38 which includes piercing tip 40. The spike member 38 extends in a direction substantially parallel with the plurality of vial grip members 54 and serves the purpose of piercing a fluid container such as first vial 80 during assembly of vial access device 12 to a first vial 80 as is shown in greater detail in FIG. 22B.

Figure 1B:
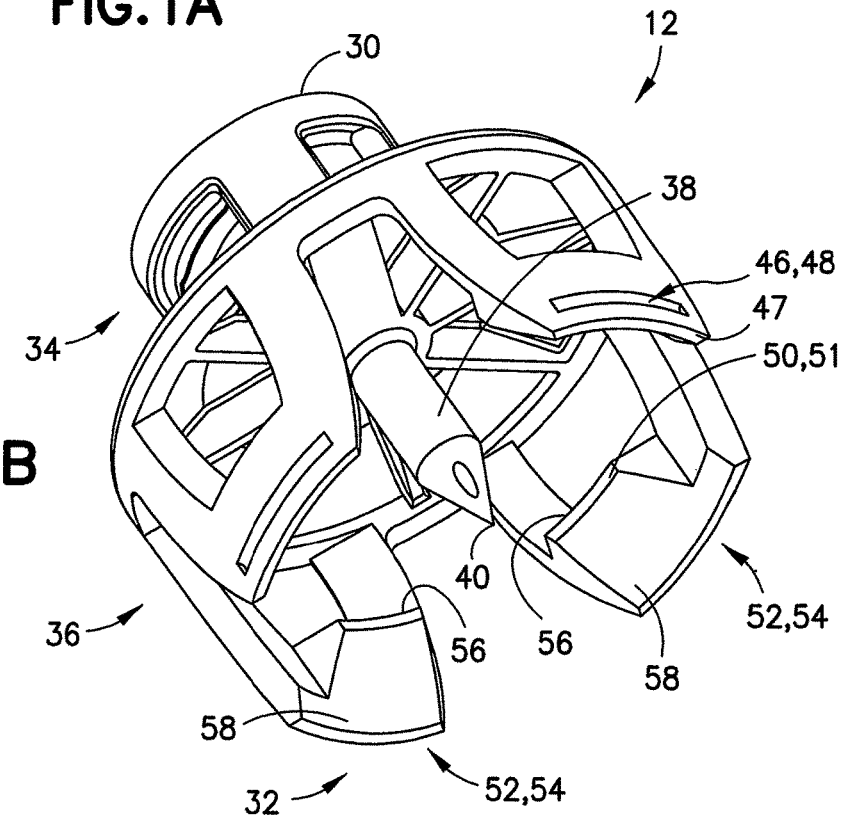
FIG. 1B is a bottom, perspective view of a vial access device in accordance with an aspect of the present invention.
Figure 1C:
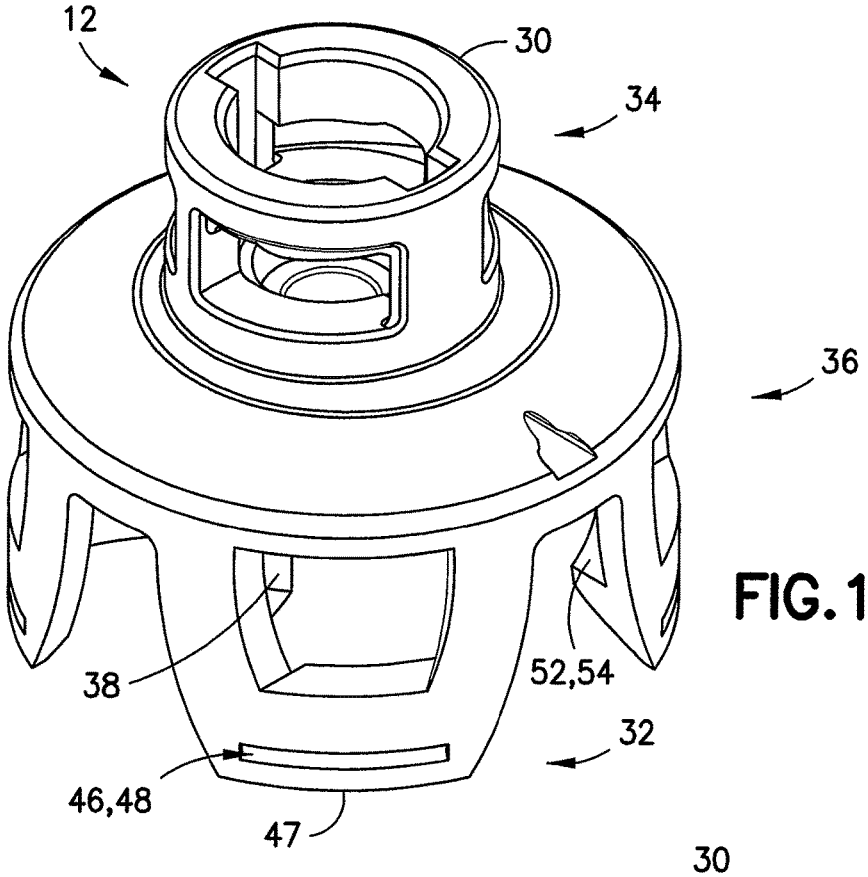
FIG. 1C is a perspective view of a vial access device in accordance with an aspect of the present invention.
Figure 1D:
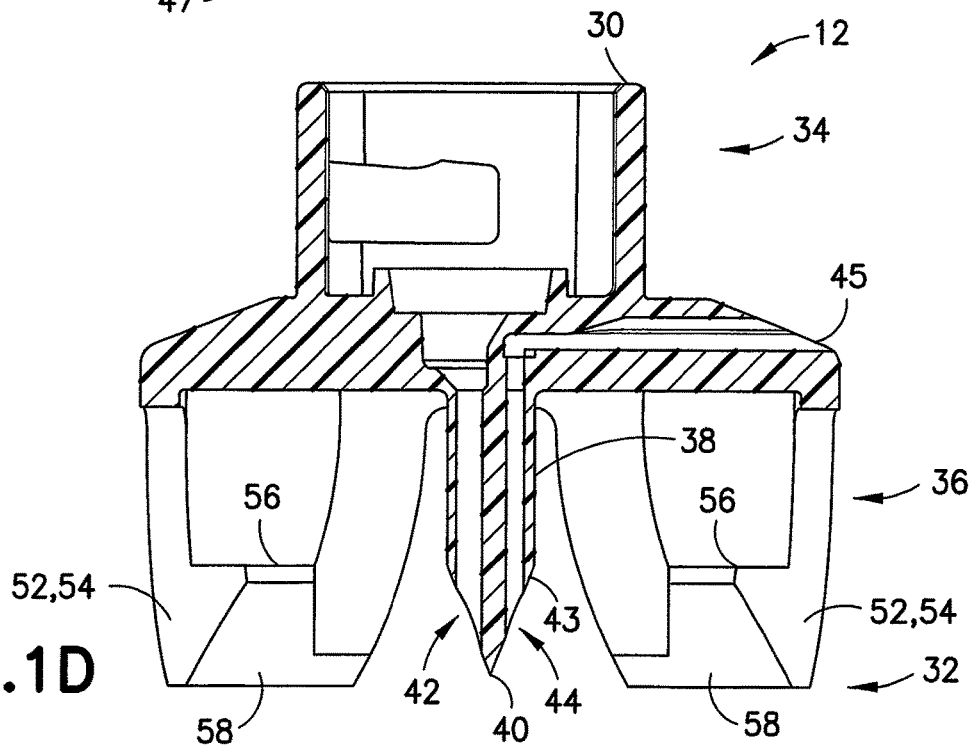
FIG. 1D is a cross-sectional view of the vial access device of FIG. 1C in accordance with an aspect of the present invention.

Referring to FIG. 1D, a fluid transfer channel 42 extends through spike member 38 such that piercing tip 40 is in fluid communication with first end 30 of vial access device 12. The purpose of fluid transfer channel 42 is to permit a needle cannula to extend through vial access device 12 and to thereby permit fluid to be transferred through vial access device 12. In one aspect, fluid transfer channel 42 extends inside of spike member 38 as shown in FIG. 1D.

Referring to FIG. 1D, in one aspect, a pressure normalization channel 44 extends from enter aperture 43 to exit aperture 45. Pressure normalization channel 44 is arranged to provide gas communication between a pressure equalization system and the interior of a vial when the vial access device 12 is connected to a vial. With vial access device 12 connected to a vial, a syringe or cannula assembly may be used to inject fluid into the vial or to withdraw fluid therefrom. Any suitable pressure equalization arrangement may be utilized. For example, in one aspect, an accordion bellows pressure equalization system may be utilized as discussed in more detail below. The use of a pressure equalization system with a system of the present disclosure provides a system for the closed transfer of fluids that provides substantially leak-proof sealing and pressure equalization during engagement of a cannula with a vial, during transfer of a substance from a vial chamber to a barrel chamber via the cannula, and during disengagement of the cannula from the vial. In other aspects, the vial access device 12 may be a vial access device only and not include a pressure equalization arrangement and/or sealing arrangement.

Referring to FIGS. 1A-1D, a vial connection element 52 is disposed at second end 32 of vial access device 12. In one aspect, vial connection element 52 includes a plurality of vial grip members 54 having hook protrusions 56 and angled walls 58. In one aspect, vial grip members 54 are elastically deformable. Vial grip members 54 are attachable to a first vial 80 to secure vial access device 12 to the first vial 80. Each vial grip member 54 includes a hook protrusion 56 arranged to engage a corresponding flange 87 on a container such as first vial 80 as shown in FIGS. 21-22B. Vial connection element 52 of vial access device 12 may be dimensioned to be attached to containers of any size and volume. In other aspects, vial connection element 52 of vial access device 12 may include other connection mechanisms for securing vial access device 12 to first vial 80 such as a threaded portion, a snap fit mechanism, locking tabs, or other similar mechanism. Each vial grip member 54 includes an angled wall 58 arranged to provide a lead-in surface to center and align vial access device 12 on a vial.

Referring to FIGS. 1A-1D, vial access device 12 includes a first adapter connection element 46 and a second adapter connection element 50. In this manner, vial access device 12 is connectable with a plurality of different adapters of the present disclosure as discussed in more detail below. In one aspect, first adapter connection element 46 comprises a plurality of slots 48. Slots 48 are spaced a distance from one another as shown in FIGS. 1A-1C. In one aspect, second adapter connection element 50 comprises a plurality of locking protrusions 51. Locking protrusions 51 are spaced a distance from one another as shown in FIGS. 1A-1C.

Referring to FIGS. 2-5, first adapter 14 generally includes horizontal shield wall 60; outer portion 61 extending from the periphery of horizontal shield wall 60, outer portion 61 comprising outer shield wall 62; inner portion 64 extending from horizontal shield wall 60 and disposed within outer portion 61, inner portion 64 comprising a plurality of inner shield walls 65 defining spike shield area 66; spike cavity 67 defined within a central region of horizontal shield wall 60; access device connection element 68 comprising a plurality of external latches 70 defining a vial access device receiving area 72 and including a locking rib 74; alignment guides 75; and vial connection element 76 comprising vial grip members 77, hook protrusions 78, and angled walls 79.

First adapter 14 is transitionable between a shield position (FIGS. 11-14B) in which first adapter 14 is attachable to vial access device 12 such that first adapter 14 shields a spike member 38 of vial access device 12 and a vial position (FIGS. 15-16B and 23-24B) in which first adapter 14 is attachable to a second vial 90 defining a second vial size 91, the second vial size 91 different than the first vial size 81. In this manner, first adapter 14 provides reversibility between a shield configuration in which first adapter 14 shields spike member 38 of vial access device 12 to prevent spike stick injuries and an adapter or vial configuration in which first adapter 14 allows first system 10 to accommodate a plurality of vials having different sizes.

Figure 2:
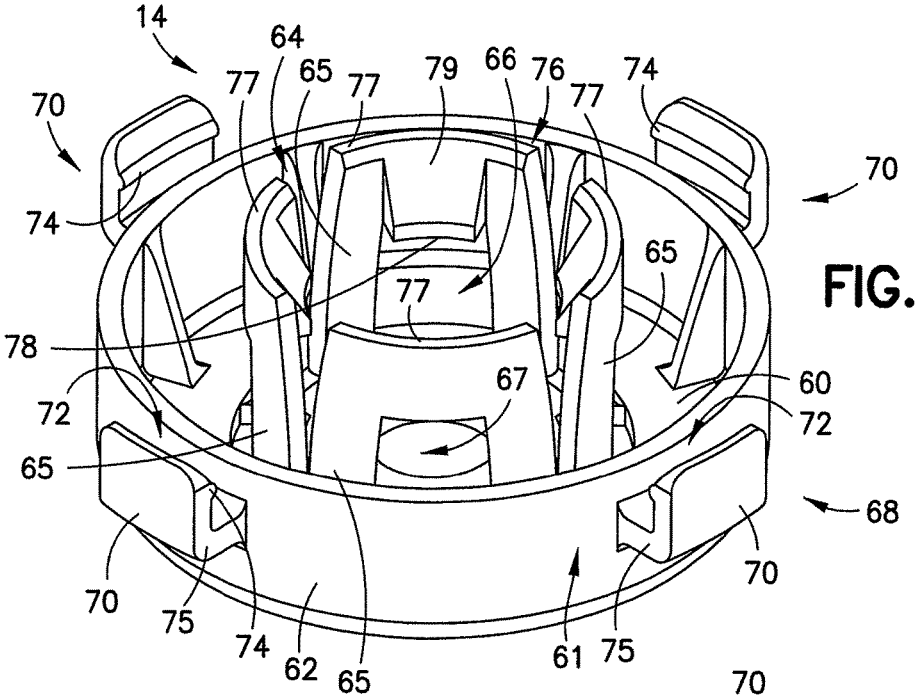
FIG. 2 is a perspective view of an adapter in accordance with an aspect of the present invention.
Figure 3:
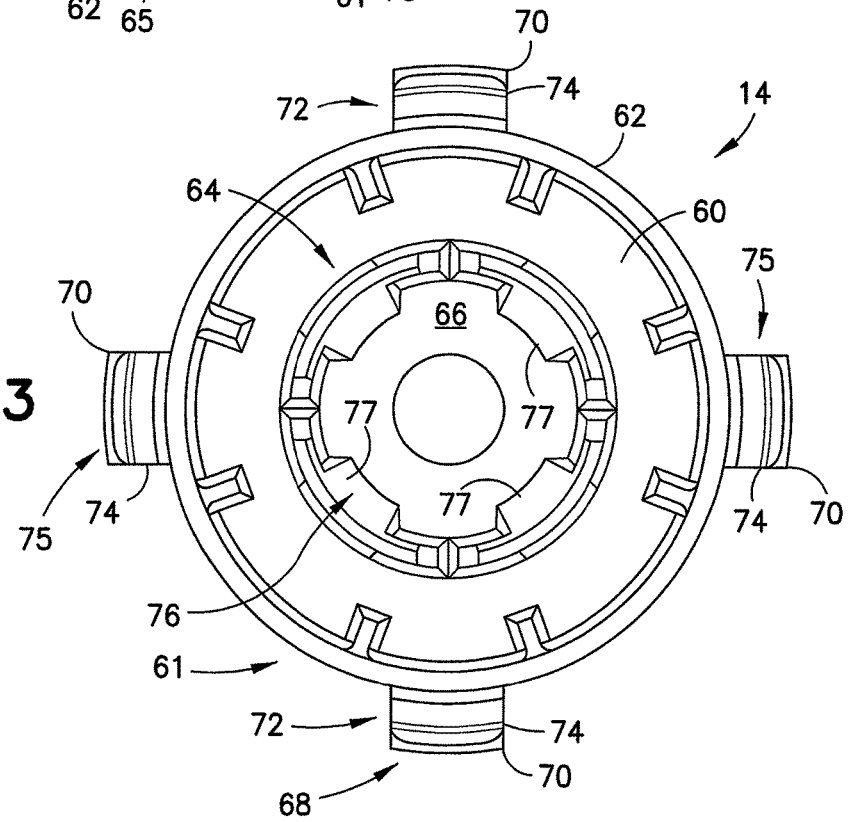
FIG. 3 is a top view of an adapter in accordance with an aspect of the present invention.
Figure 4:
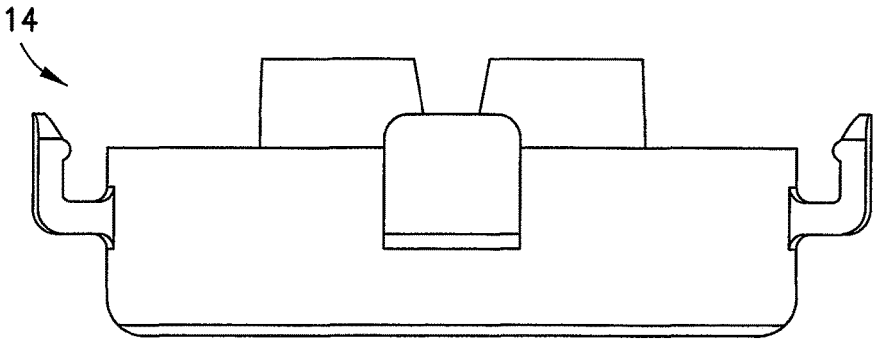
FIG. 4 is a side elevation view of an adapter in accordance with an aspect of the present invention.
Figure 5:
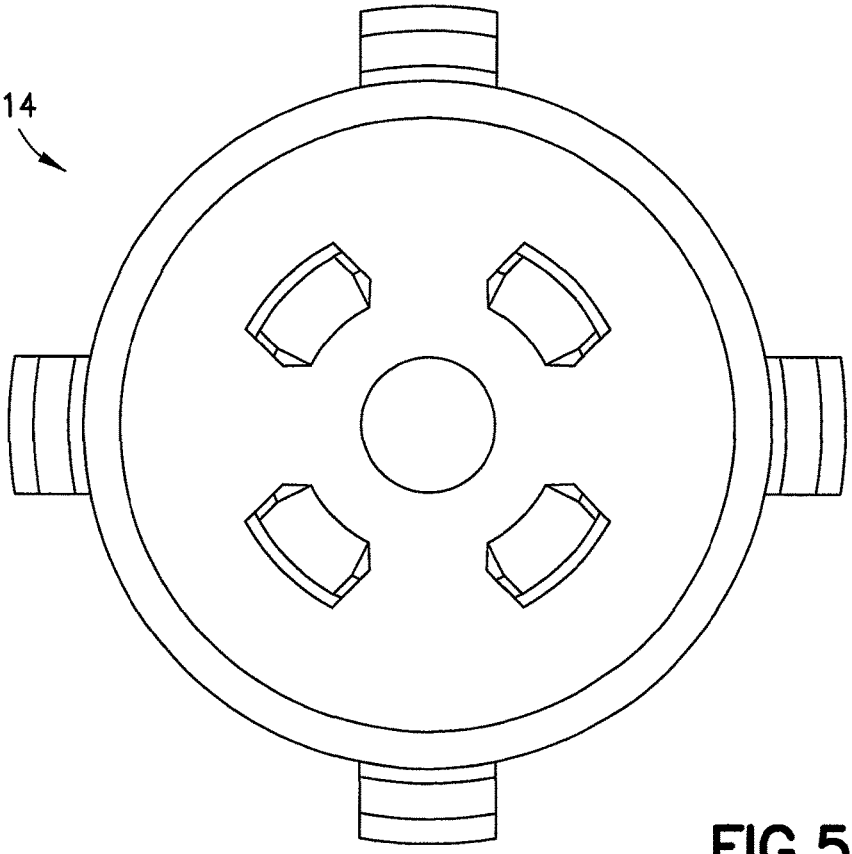
FIG. 5 is a bottom view of an adapter in accordance with an aspect of the present invention.

Referring to FIGS. 2 and 14B, horizontal shield wall 60 and inner shield walls 65 together define a spike shield area 66 which is sized and configured to receive and shield spike member 38 of vial access device 12 with first adapter 14 in a shield position. In this manner, first adapter 14 provides a physical barrier that shields spike member 38 of vial access device 12 and prevents the fingers of a user from contacting piercing tip 40 of spike member 38.

In one aspect, access device connection element 68 of first adapter 14 includes a plurality of external latches 70 spaced around a periphery of outer shield wall 62 as shown in FIG. 2. External latches 70 are engageable with slots 48 of vial access device 12 to attach first adapter 14 to vial access device 12 with the first adapter 14 in the shield position to shield spike member 38 of vial access device 12 as shown in FIG. 14B and as described in more detail below. In one aspect, external latches 70 are elastically deformable.

Referring to FIGS. 2-5, inner shield walls 65 of first adapter 14 include a vial connection element 76. In one aspect, vial connection element 76 includes a plurality of vial grip members 77 having hook protrusions 78 and angled walls 79. In one aspect, vial grip members 77 are elastically deformable. Vial grip members 77 are attachable to a second vial 90 to secure first system 10 to the second vial 90. Each vial grip member 77 includes a hook protrusion 78 arranged to engage a corresponding flange 97 on a container such as second vial 90 as shown in FIGS. 23-24B. Vial connection element 76 of first adapter 14 may be dimensioned to be attached to containers of any size and volume. In other aspects, vial connection element 76 of first adapter 14 may include other connection mechanisms for securing first adapter 14 to second vial 90 such as a threaded portion, a snap fit mechanism, locking tabs, or other similar mechanism. Each vial grip member 77 includes an angled wall 79 arranged to provide a lead-in surface to center and align first system 10 on a vial.

Figure 11:
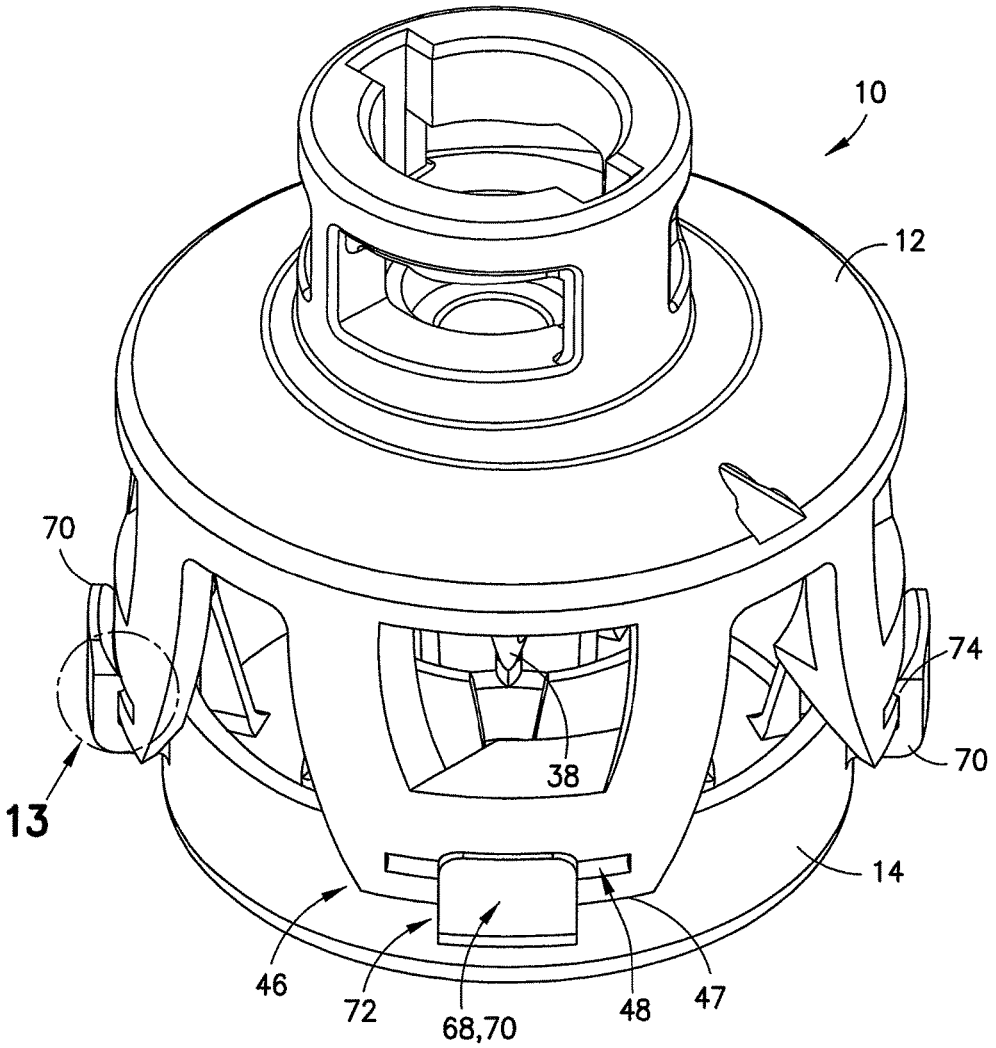
FIG. 11 is a perspective view of an adapter attached to a vial access device in a shield position in accordance with an aspect of the present invention.
Figure 12:
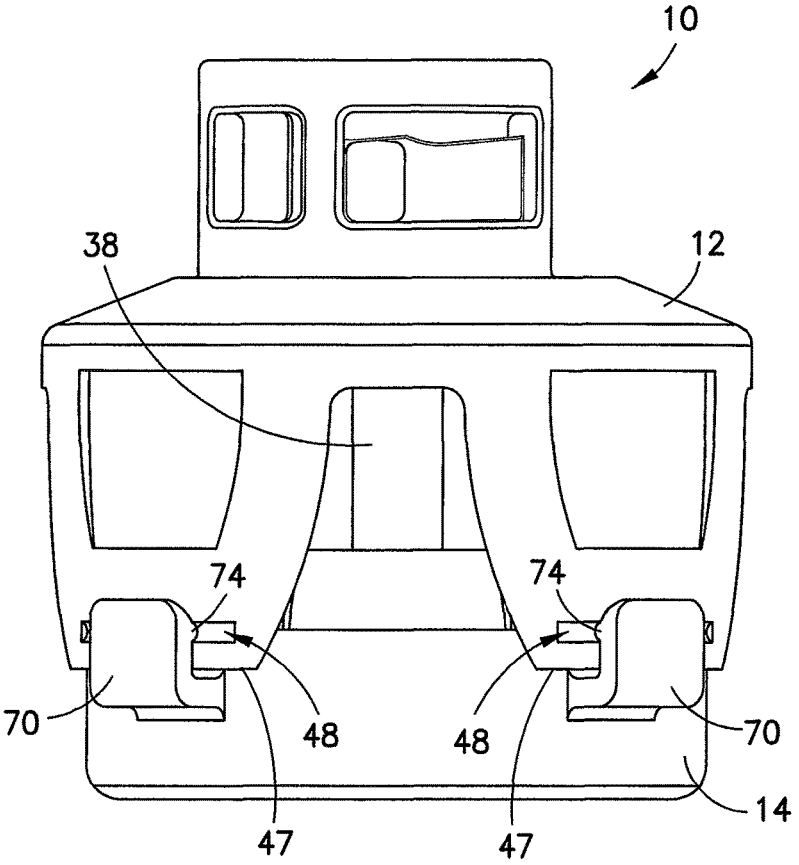
FIG. 12 is a side elevation view of an adapter attached to a vial access device in a shield position in accordance with an aspect of the present invention.
Figure 13:
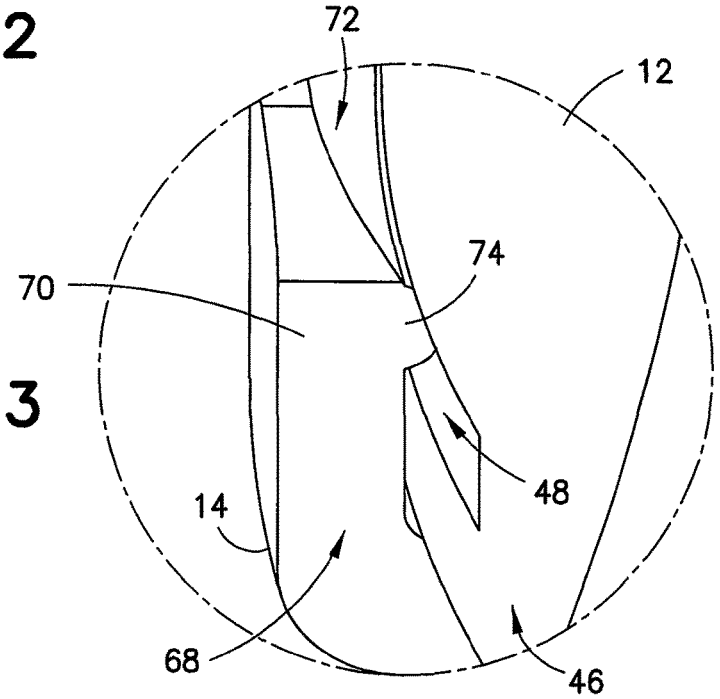
FIG. 13 is an enlarged view of the adapter attached to the vial access device in a shield position taken along section 13 of FIG. 11 in accordance with an aspect of the present invention.
Figure 15:
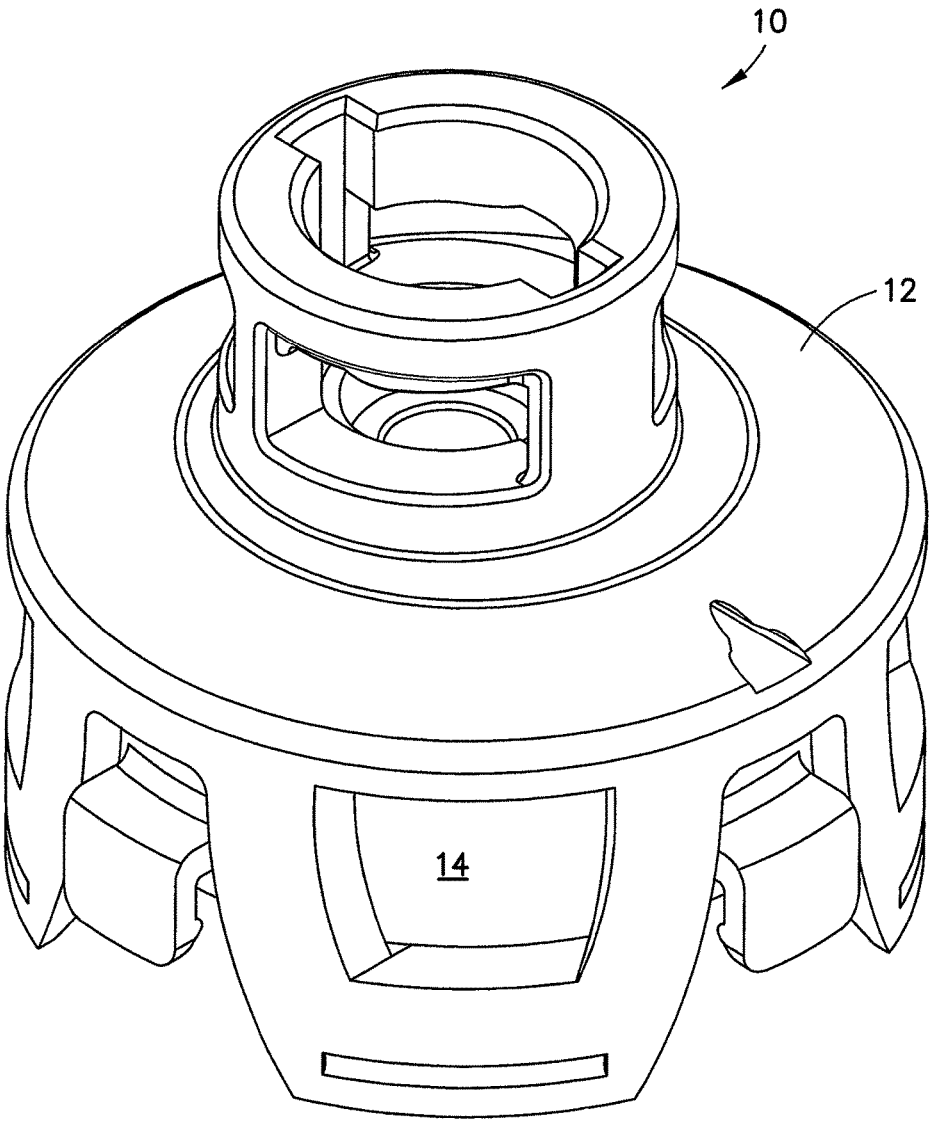
FIG. 15 is a perspective view of an adapter attached to a vial access device in a vial position in accordance with an aspect of the present invention.

Referring to FIGS. 11-14B, as described above, first adapter 14 is attachable to vial access device 12 such that first adapter 14 shields a spike member 38 of vial access device 12 in a shield position. First adapter 14 is attachable to vial access device 12 by engagement of access device connection elements 68 of first adapter 14 with first adapter connection elements 46 of vial access device 12. For example, end walls 47 of first adapter connection elements 46 can be positioned into respective vial access device receiving areas 72 of external latches 70 of first adapter 14 as shown in FIGS. 11 and 14B. In this position, a force can be exerted on vial access device 12 to push vial access device 12 into engagement with external latches 70 of first adapter 14. As force is exerted on vial access device 12 to axially move vial access device 12 into engagement with first adapter 14, external latches 70 of first adapter 14 cooperate with first adapter connection elements 46 of vial access device 12 and deform outward so that end walls 47 of first adapter connection elements 46 move axially downward into vial access device receiving areas 72 of external latches 70 until locking ribs 74 of external latches 70 engage respective slots 48 of first adapter connection elements 46 and lock first adapter 14 to vial access device 12 in the shield position as shown in FIGS. 11-14B. In this manner, first adapter 14 is secured to vial access device 12 such that first adapter 14 is prevented from significant relative movement relative to vial access device 12.

In the shield position, first adapter 14 is particularly advantageous in that it allows a user, such as a patient and/or healthcare worker, to safely handle vial access device 12 without receiving spike stick injuries from piercing tip 40 of spike member 38. With first adapter 14 in the shield position as described above, first adapter 14 provides a physical barrier preventing the fingers of a user from contacting piercing tip 40 of spike member 38. In this manner, the user is prevented from spike stick injuries and the user can conveniently and safely handle vial access device 12 and remove vial access device 12 from packaging. An adapter of the present disclosure is also advantageous in that it protects the package integrity.

After vial access device 12 is safely removed from packaging and safely handled with first adapter 14 shielding spike member 38 as described above, first adapter 14 may be removed from vial access device 12. Next, if it is desired to use a system that provides substantially leak-proof sealing during engagement of a cannula with a first vial 80 defining a first vial size 81, vial access device 12 can be used and attached to first vial 80 as shown in FIGS. 21-22B. Vial grip members 54 of vial access device 12 are attachable to first vial 80 to secure vial access device 12 to first vial 80. Each vial grip member 54 includes a hook protrusion 56 arranged to engage a corresponding flange 87 on a container such as first vial 80 as shown in FIG. 22B. Referring to FIGS. 21-22B, with vial access device 12 attached to first vial 80, vial access device 12 provides substantially leak-proof sealing during engagement of a cannula with first vial 80, during transfer of a substance from vial chamber 86 to a barrel chamber via the cannula, and during disengagement of the cannula from first vial 80.

In another application of first system 10 of the present disclosure, after vial access device 12 is safely removed from packaging and safely handled with first adapter 14 shielding spike member 38 as described above, first adapter 14 may be removed from vial access device 12. Next, if it is desired to use a system that provides substantially leak-proof sealing during engagement of a cannula with a second vial 90 defining a second vial size 91, the second vial size 91 being less than first vial size 81, first adapter 14 can be used and attached to second vial 90 as shown in FIGS. 23-24B. After first adapter 14 is removed from vial access device 12, first adapter 14 can be rotated from the shield position as shown in FIGS. 11-14B to the vial position as shown in FIGS. 15-16B and 23-24B. In the vial position, first adapter 14 can be used and attached to second vial 90 as shown in FIGS. 23-24B. Although FIGS. 23-24B illustrate vial access device 12 and first adapter 14 attached to second vial 90, first adapter 14 can first be attached to second vial 90 and used to align and guide vial access device 12 during its installation onto second vial 90 as described below. The first adapter 14 is secured to the vial access device 12 by the vial grip members 54 of the vial access device 12 engaging the bottom of the outer portion 61 of the first adapter 14. The vial grip members 54 may be secured to the first adapter 14 in the same manner that the vial grip members 54 are secured to the flange 87 on the first vial 80 as described above.

Figure 16A:
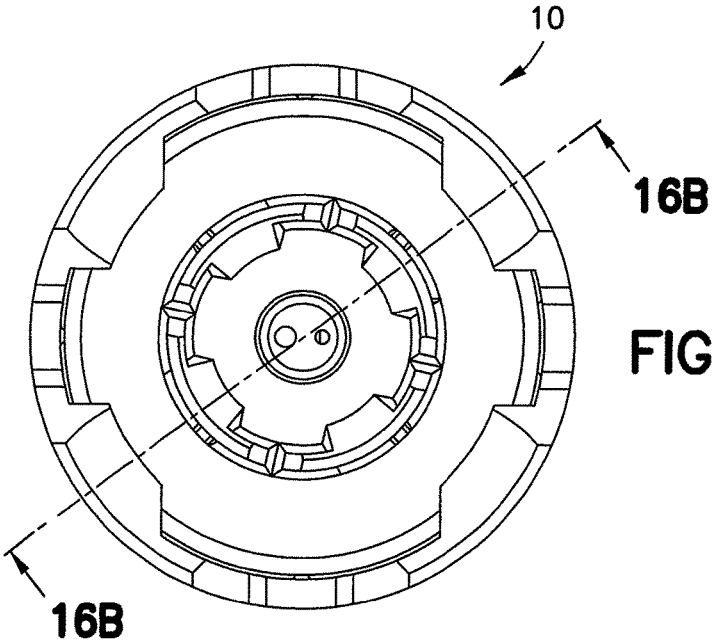
FIG. 16A is a bottom view of an adapter attached to a vial access device in a vial position in accordance with an aspect of the present invention.
Figure 16B:
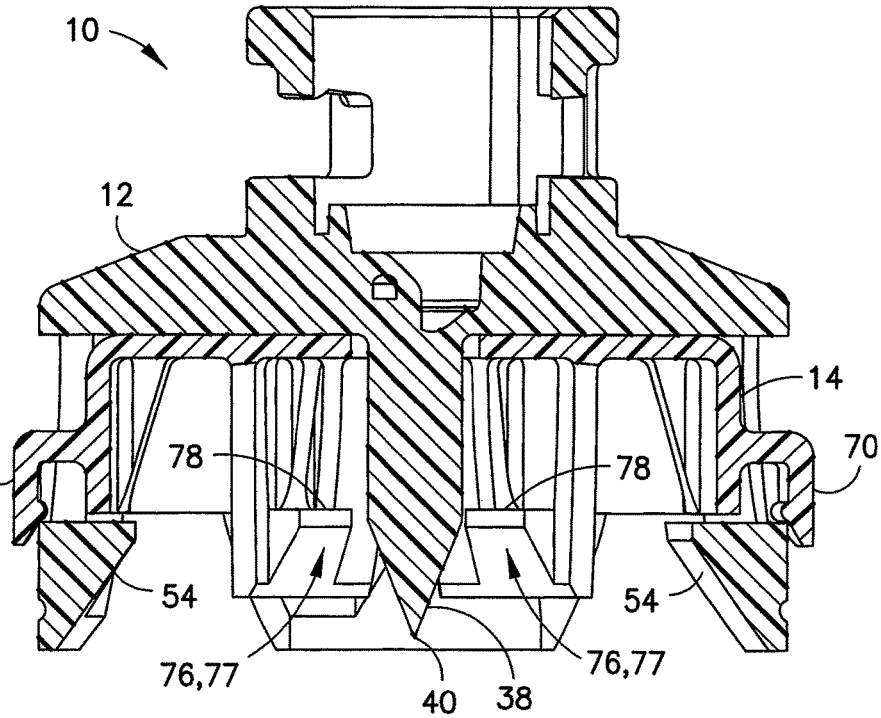
FIG. 16B is a cross-sectional view of an adapter attached to a vial access device in a vial position taken along line 16B-16B of FIG. 16A in accordance with an aspect of the present invention.

Vial grip members 77 of first adapter 14 are attachable to second vial 90 to secure vial access device 12 to second vial 90 via first adapter 14 as shown in FIGS. 23-24B. Each vial grip member 77 of first adapter 14 includes a hook protrusion 78 arranged to engage a corresponding flange 97 on a container such as second vial 90 as shown in FIG. 24B. Referring to FIGS. 23-24B, with vial access device 12 attached to second vial 90 via first adapter 14, first system 10 provides substantially leak-proof sealing during engagement of a cannula with second vial 90, during transfer of a substance from vial chamber 96 to a barrel chamber via the cannula, and during disengagement of the cannula from second vial 90. In one aspect, after first adapter 14 is attached to second vial 90, alignment guides 75 of first adapter 14 provide a functional benefit by acting as alignment guides for positioning vial access device 12 during its installation onto second vial 90. With first adapter 14 and vial access device 12 secured to second vial 90, spike member 38 of vial access device 12 is able to extend through spike cavity 67 of first adapter 14 as shown in FIG. 16B.

Referring to FIGS. 6-10, second adapter 24 generally includes horizontal shield wall 100; outer portion 101 extending from the periphery of horizontal shield wall 100, outer portion 101 comprising outer shield wall 102; inner portion 104 extending from horizontal shield wall 100 and disposed within outer portion 101, inner portion 104 comprising a plurality of inner shield walls 105 defining spike shield area 106; spike cavity 107 defined within a central region of horizontal shield wall 100; access device connection element 108 comprising a plurality of internal latches or locking apertures 110; and vial connection element 116 comprising vial grip members 117, hook protrusions 118, and angled walls 119.

Second adapter 24 is transitionable between a shield position (FIGS. 17-18B) in which second adapter 24 is attachable to vial access device 12 such that second adapter 24 shields a spike member 38 of vial access device 12 and a vial position (FIGS. 19-20B and 25-26B) in which second adapter 24 is attachable to a second vial 90 defining a second vial size 91, the second vial size 91 different than the first vial size 81. In this manner, second adapter 24 provides reversibility between a shield configuration in which second adapter 24 shields spike member 38 of vial access device 12 to prevent spike stick injuries and an adapter or vial configuration in which second adapter 24 allows second system 20 to accommodate a plurality of vials having different sizes.

Figure 6:
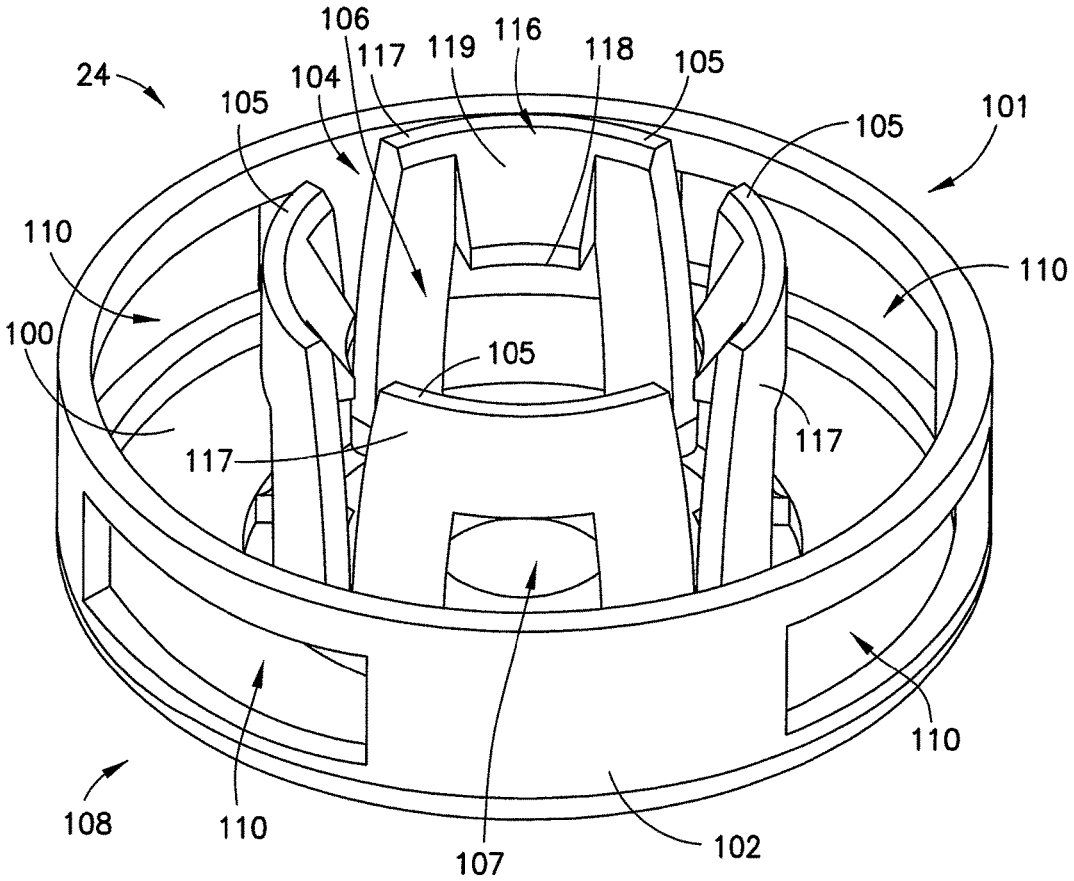
FIG. 6 is a perspective view of an adapter in accordance with another aspect of the present invention.
Figure 7:
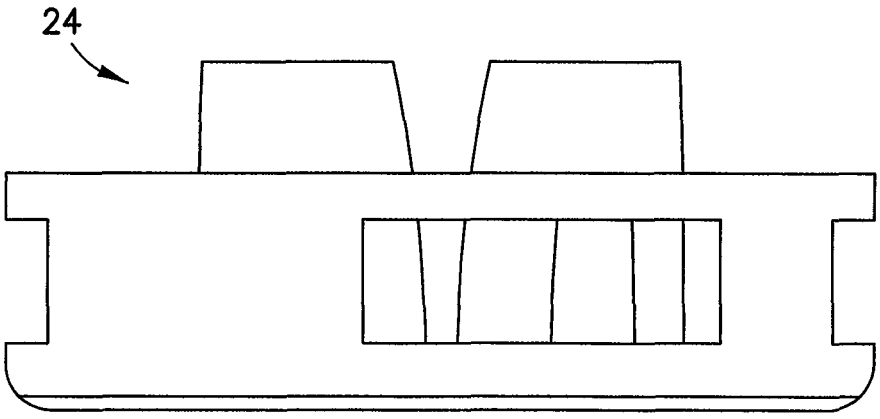
FIG. 7 is a side elevation view of an adapter in accordance with another aspect of the present invention.
Figure 8:
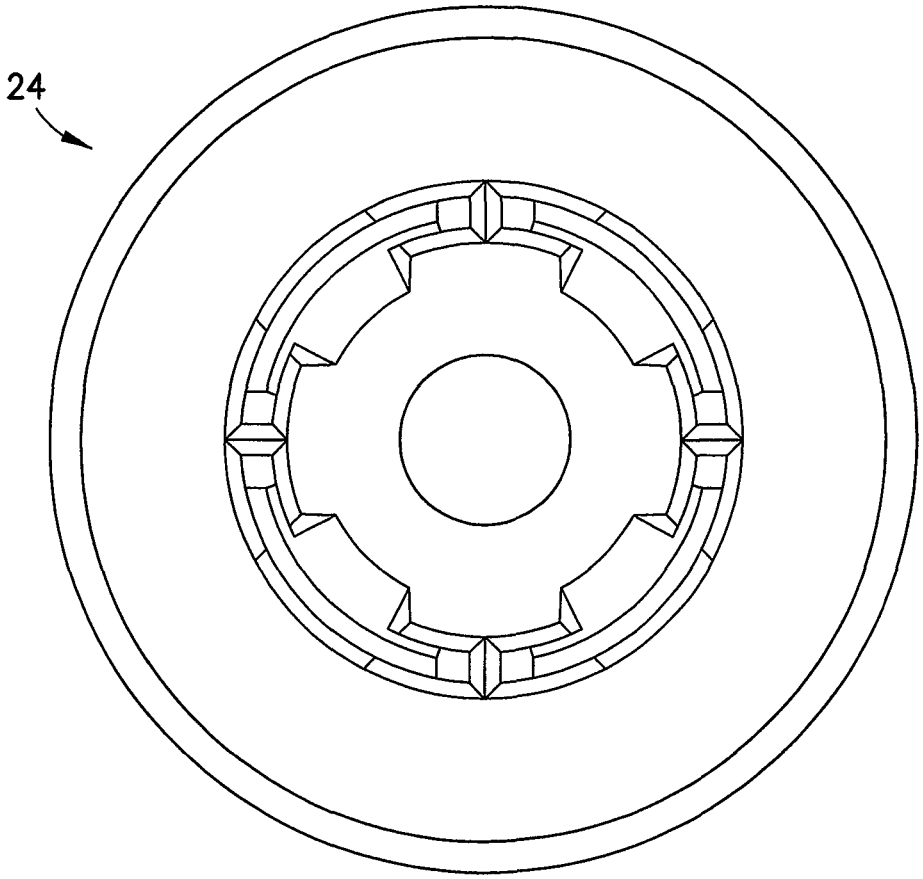
FIG. 8 is a top view of an adapter in accordance with another aspect of the present invention.
Figure 9:
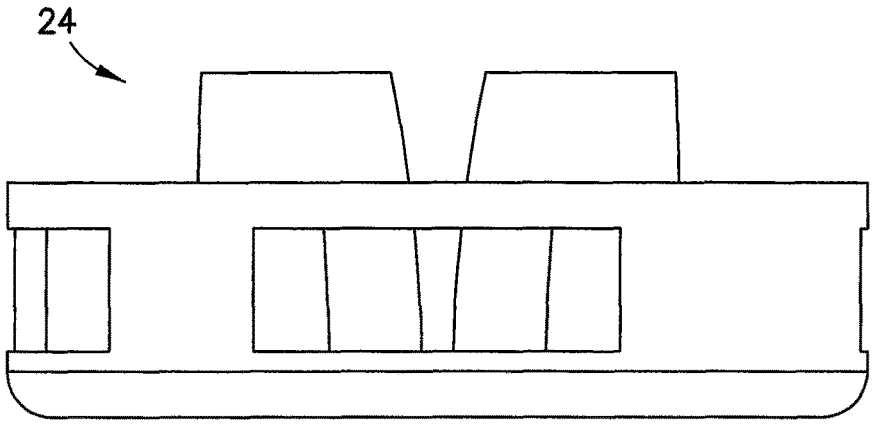
FIG. 9 is another side elevation view of an adapter in accordance with another aspect of the present invention.
Figure 10:
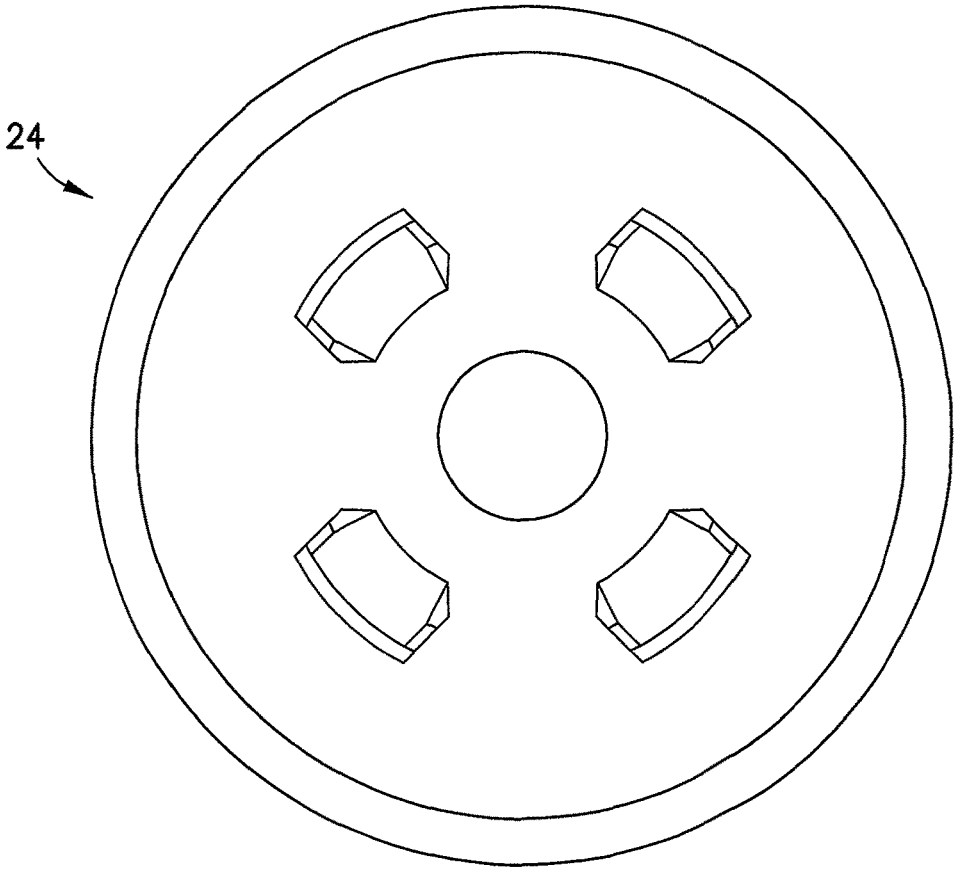
FIG. 10 is a bottom view of an adapter in accordance with another aspect of the present invention.
Figure 18A:
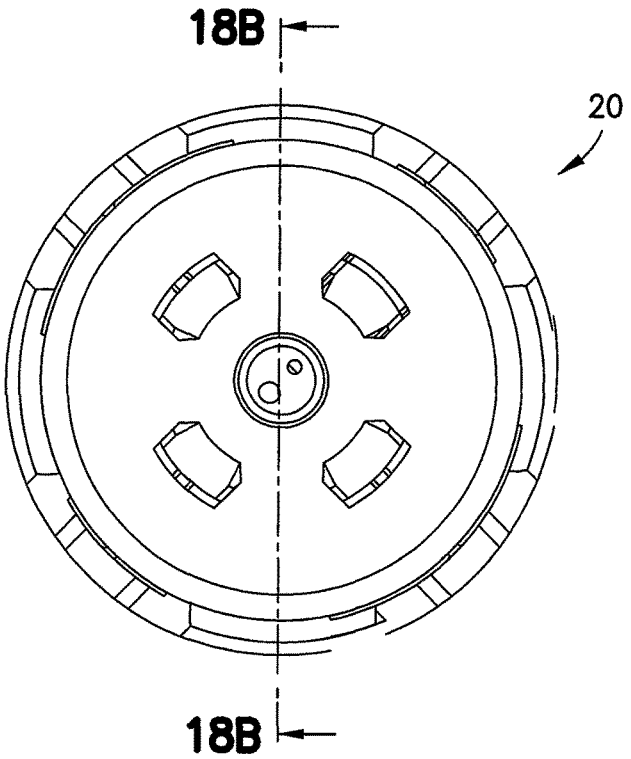
FIG. 18A is a bottom view of an adapter attached to a vial access device in a shield position in accordance with another aspect of the present invention.
Figure 18B:
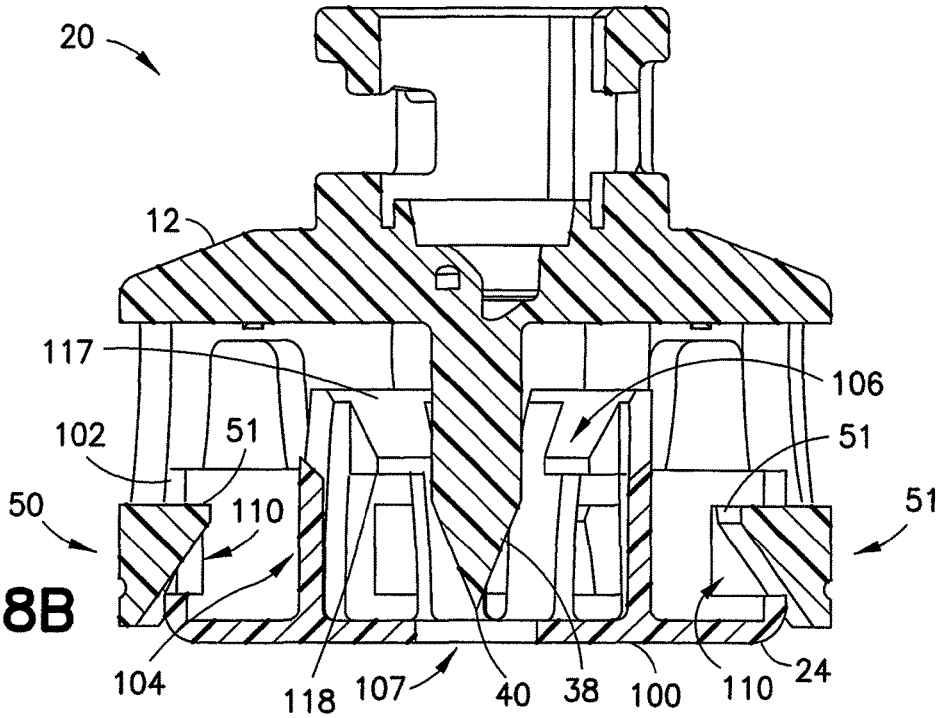
FIG. 18B is a cross-sectional view of an adapter attached to a vial access device in a shield position taken along line 18B-18B of FIG. 18A in accordance with another aspect of the present invention.
Figure 19:
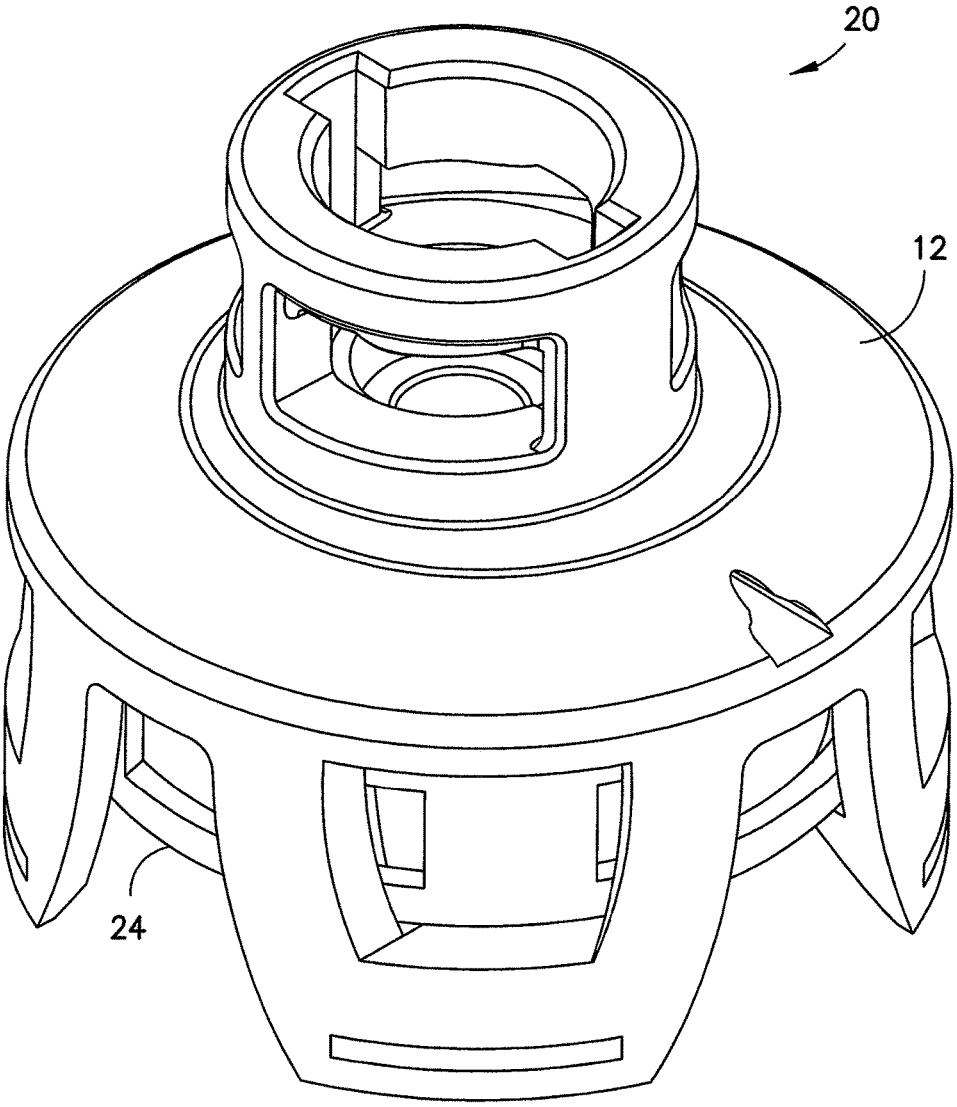
FIG. 19 is a perspective view of an adapter attached to a vial access device in a vial position in accordance with another aspect of the present invention.

Referring to FIGS. 6 and 18B, horizontal shield wall 100 and inner shield walls 105 together define a spike shield area 106 which is sized and configured to receive and shield spike member 38 of vial access device 12 with second adapter 24 in a shield position. In this manner, second adapter 24 provides a physical barrier that shields spike member 38 of vial access device 12 and prevents the fingers of a user from contacting piercing tip 40 of spike member 38.

In one aspect, access device connection element 108 of second adapter 24 includes a plurality of internal latches or locking apertures 100 spaced around a periphery of outer shield wall 102 as shown in FIG. 6. Internal latches 100 are engageable with locking protrusions 51 of vial access device 12 to attach second adapter 24 to vial access device 12 with the second adapter 24 in the shield position to shield spike member 38 of vial access device 12 as shown in FIG. 18B and as described in more detail below.

Referring to FIGS. 6-10, inner shield walls 105 of second adapter 24 include a vial connection element 116. In one aspect, vial connection element 116 includes a plurality of vial grip members 117 having hook protrusions 118 and angled walls 119. In one aspect, vial grip members 117 are elastically deformable. Vial grip members 117 are attachable to a second vial 90 to secure second system 20 to the second vial 90. Each vial grip member 117 includes a hook protrusion 118 arranged to engage a corresponding flange 97 on a container such as second vial 90 as shown in FIGS. 25-26B. Vial connection element 116 of second adapter 24 may be dimensioned to be attached to containers of any size and volume. In other aspects, vial connection element 116 of second adapter 24 may include other connection mechanisms for securing second adapter 24 to second vial 90 such as a threaded portion, a snap fit mechanism, locking tabs, or other similar mechanism. Each vial grip member 117 includes an angled wall 119 arranged to provide a lead-in surface to center and align second system 20 on a vial.

Figure 17:
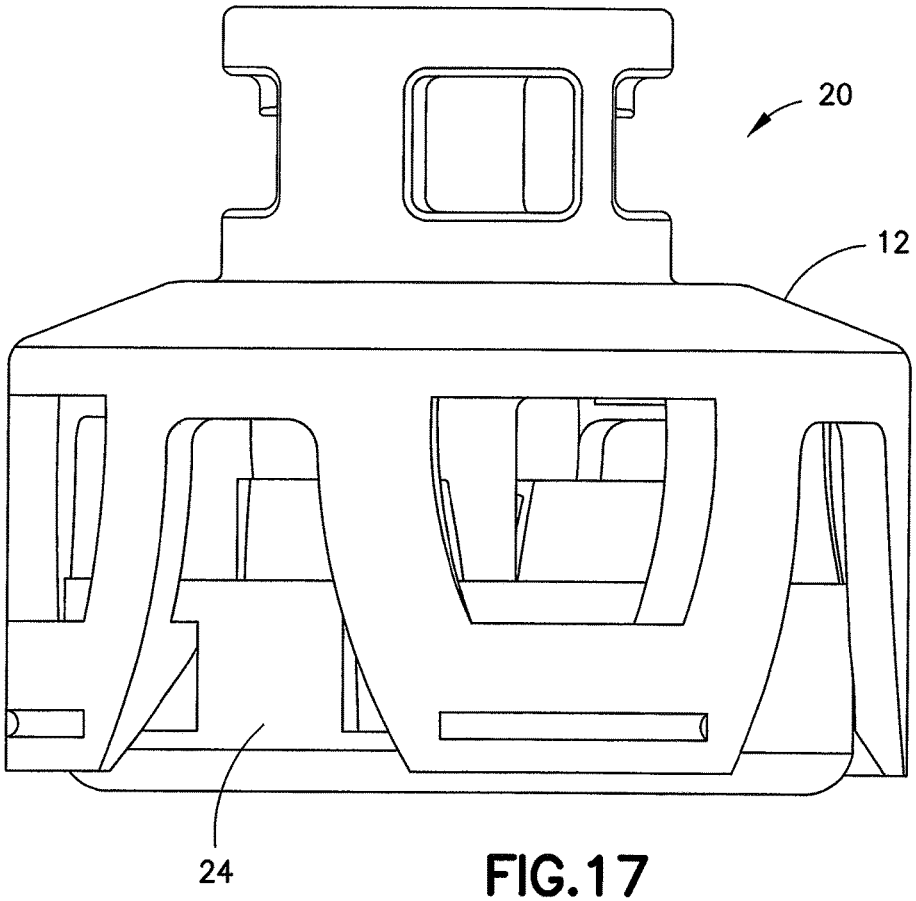
FIG. 17 is a perspective view of an adapter attached to a vial access device in a shield position in accordance with another aspect of the present invention.

Referring to FIGS. 17-18B, as described above, second adapter 24 is attachable to vial access device 12 such that second adapter 24 shields a spike member 38 of vial access device 12 in a shield position. Second adapter 24 is attachable to vial access device 12 by engagement of access device connection elements 108 of second adapter 24 with second adapter connection elements 50 of vial access device 12. For example, locking protrusions 51 of second adapter connection elements 50 can be positioned into engagement with respective locking apertures 110 of second adapter 24 as shown in FIGS. 17 and 18B. For example, a force can be exerted on vial access device 12 to push vial access device 12 into engagement with locking apertures 110 of second adapter 24. As force is exerted on vial access device 12 to axially move vial access device 12 into engagement with second adapter 24, locking protrusions 51 of vial access device 12 cooperate with outer shield wall 102 of second adapter 24 and deform outward so that second adapter connection elements 50 of vial access device 12 move axially downward until locking protrusions 51 of vial access device 12 snap into engagement with respective locking apertures 110 of second adapter 24 and lock second adapter 24 to vial access device 12 in the shield position as shown in FIGS. 17-18B. In this manner, second adapter 24 is secured to vial access device 12 such that second adapter 24 is prevented from significant relative movement relative to vial access device 12. In one aspect, vial access device 12 does not need to contain slots 48 when used with second adapter 24 and second system 20.

In the shield position, second adapter 24 is particularly advantageous in that it allows a user, such as a patient and/or healthcare worker, to safely handle vial access device 12 without receiving spike stick injuries from piercing tip 40 of spike member 38. With second adapter 24 in the shield position as described above, second adapter 24 provides a physical barrier preventing the fingers of a user from contacting piercing tip 40 of spike member 38. In this manner, the user is prevented from spike stick injuries and the user can conveniently and safely handle vial access device 12 and remove vial access device 12 from packaging. An adapter of the present disclosure is also advantageous in that it protects the package integrity.

After vial access device 12 is safely removed from packaging and safely handled with second adapter 24 shielding spike member 38 as described above, second adapter 24 may be removed from vial access device 12. Next, if it is desired to use a system that provides substantially leak-proof sealing during engagement of a cannula with a first vial 80 defining a first vial size 81, vial access device 12 can be used and attached to first vial 80 as shown in FIGS. 21-22B and as described above.

In another application of second system 20 of the present disclosure, after vial access device 12 is safely removed from packaging and safely handled with second adapter 24 shielding spike member 38 as described above, second adapter 24 may be removed from vial access device 12. Next, if it is desired to use a system that provides substantially leak-proof sealing during engagement of a cannula with a second vial 90 defining a second vial size 91, the second vial size 91 being less than first vial size 81, second adapter 24 can be used and attached to second vial 90 as shown in FIGS. 25-26B. After second adapter 24 is removed from vial access device 12, second adapter 24 can be rotated from the shield position as shown in FIGS. 17-18B to the vial position as shown in FIGS. 19-20B and 25-26B. In the vial position, second adapter 24 can be used and attached to second vial 90 as shown in FIGS. 25-26B. Vial grip members 117 of second adapter 24 are attachable to second vial 90 to secure vial access device 12 to second vial 90 via second adapter 24 as shown in FIGS. 25-26B. The second adapter 24 may be secured to the second vial 90 first with the vial access device 12 subsequently placed onto the second adapter 24. The second adapter 24 is secured to the vial access device 12 by the vial grip members 54 of the vial access device 12 engaging the bottom of the outer portion 101 of the second adapter 24. The vial grip members 54 may be secured to the second adapter 24 in the same manner that the vial grip members 54 are secured to the flange 87 on the first vial 80 as described above. Each vial grip member 117 of second adapter 24 includes a hook protrusion 118 arranged to engage a corresponding flange 97 on a container such as second vial 90 as shown in FIG. 26B.

Figure 20A:
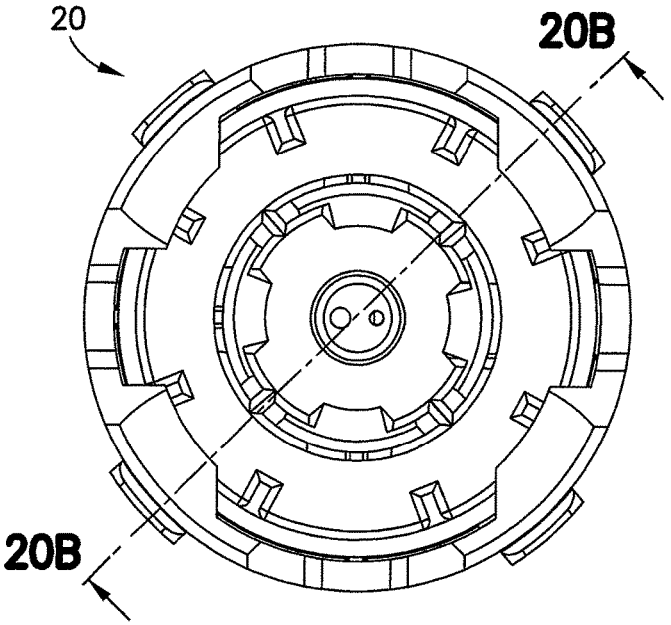
FIG. 20A is a bottom view of an adapter attached to a vial access device in a vial position in accordance with another aspect of the present invention.
Figure 20B:
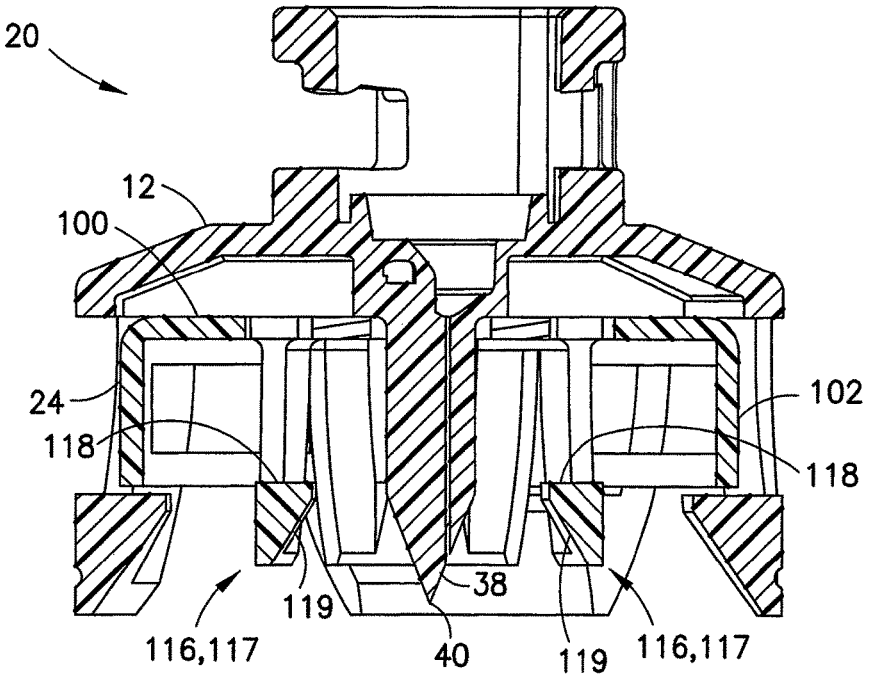
FIG. 20B is a cross-sectional view of an adapter attached to a vial access device in a vial position taken along line 20B-20B of FIG. 20A in accordance with another aspect of the present invention.

Referring to FIGS. 25-26B, with vial access device 12 attached to second vial 90 via second adapter 24, second system 20 provides substantially leak-proof sealing during engagement of a cannula with second vial 90, during transfer of a substance from vial chamber 96 to a barrel chamber via the cannula, and during disengagement of the cannula from second vial 90. With second adapter 24 and vial access device 12 secured to second vial 90, spike member 38 of vial access device 12 is able to extend through spike cavity 107 of second adapter 24 as shown in FIG. 20B.

FIGS. 27-56B illustrate a third exemplary aspect of the present disclosure. Referring to FIGS. 27-56B, a third system for the closed transfer of fluids 300 includes a vial access device or vial access device housing component 202 attachable to a first vial 80 having a first vial size 81 (FIGS. 53-54B) and a third adapter 204 transitionable between a shield position (FIGS. 42-46B) in which third adapter 204 is attachable to vial access device 202 such that third adapter 204 shields a spike member 228 of vial access device 202 and a vial position (FIGS. 47-52 and 55-56B) in which third adapter 204 is attachable to a second vial 90 defming a second vial size 91, the second vial size 91 different than the first vial size 81. In this manner, third adapter 204 provides reversibility between a shield configuration in which third adapter 204 shields spike member 228 of vial access device 202 to prevent spike stick injuries and an adapter configuration in which third adapter 204 allows third system 200 to accommodate a plurality of vials having different sizes.

Figure 53:
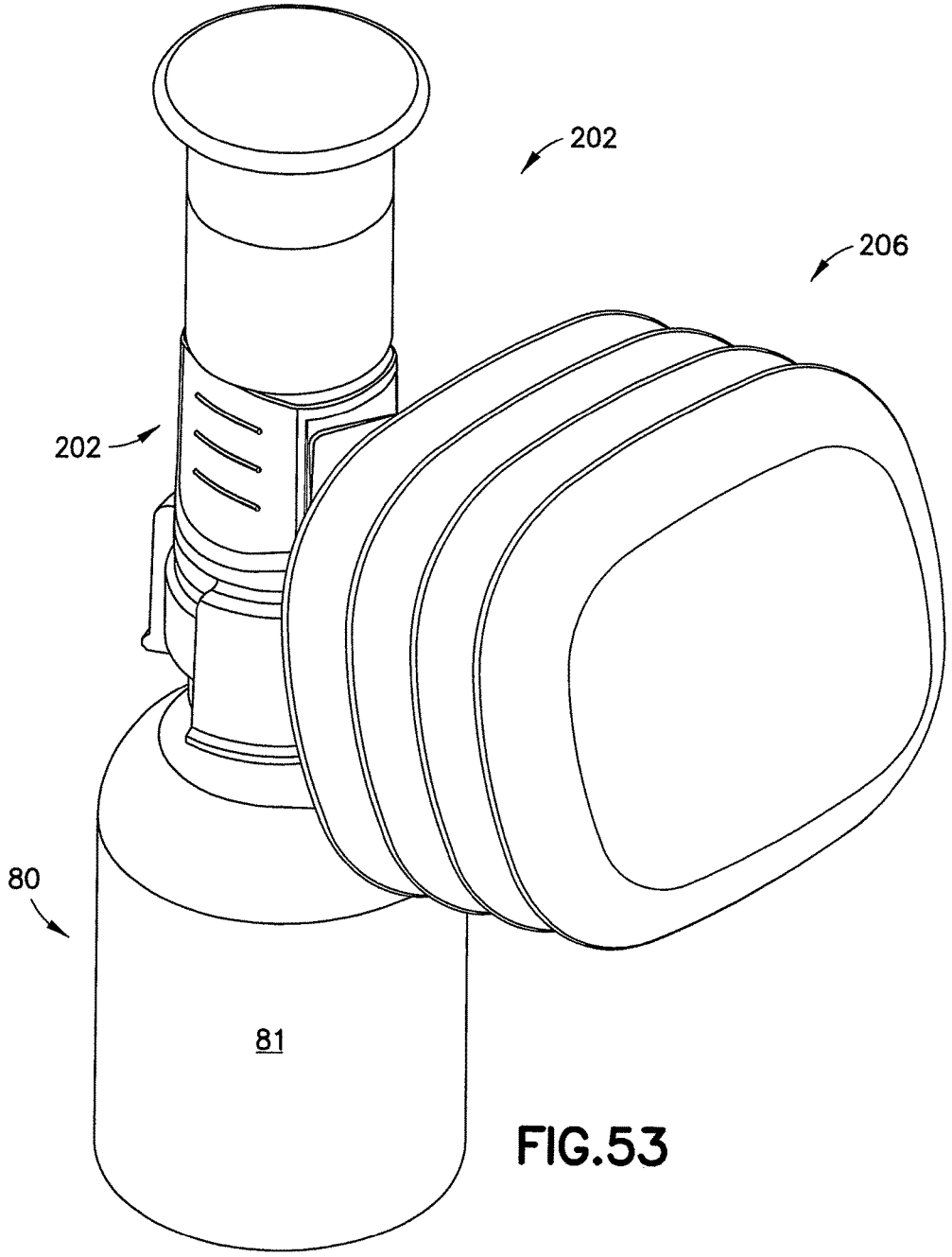
FIG. 53 is a perspective view of a vial access device connected to a first vial in accordance with another aspect of the present invention.
Figure 54A:
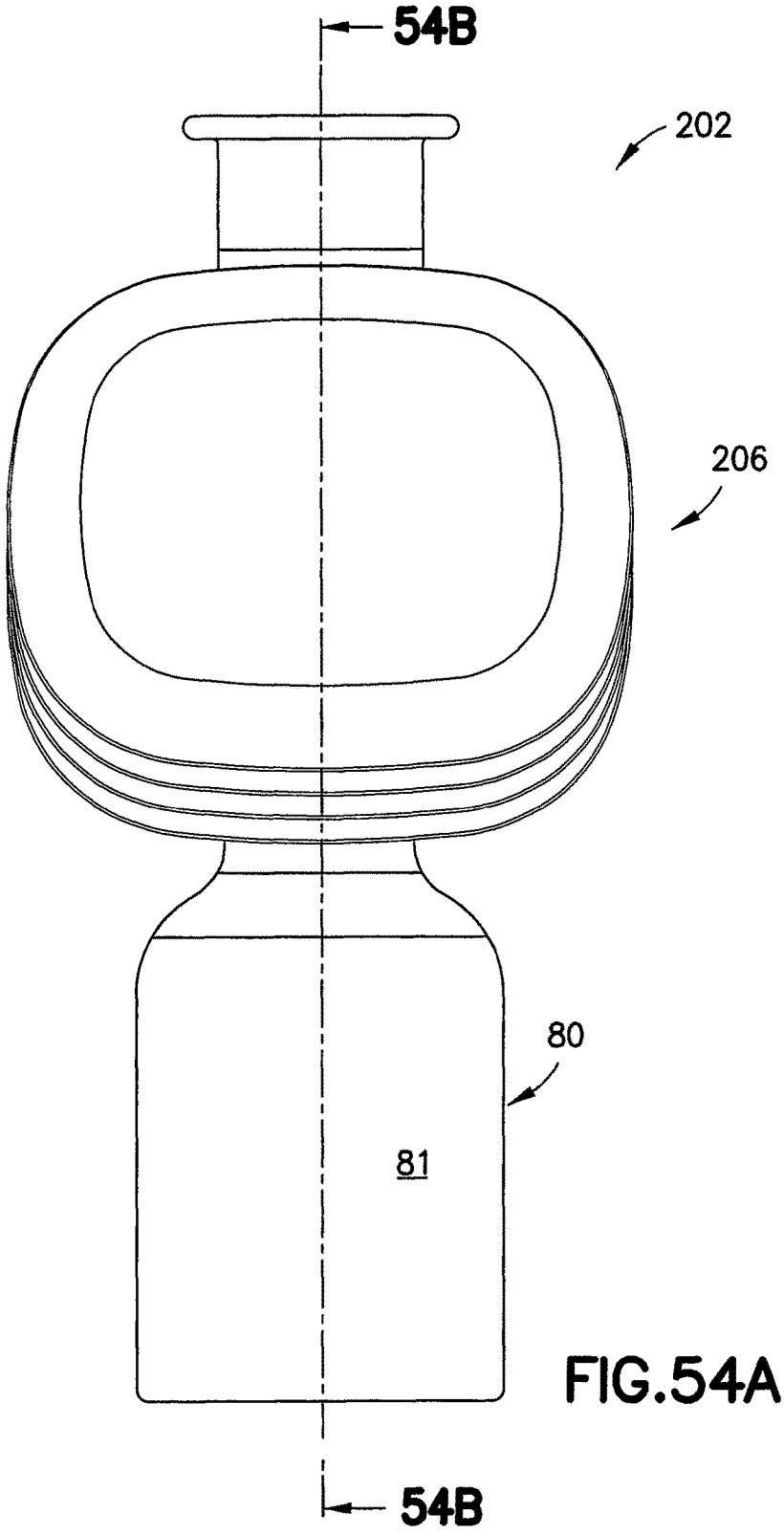
FIG. 54A is a side elevation view of a vial access device connected to a first vial in accordance with another aspect of the present invention.
Figure 54B:
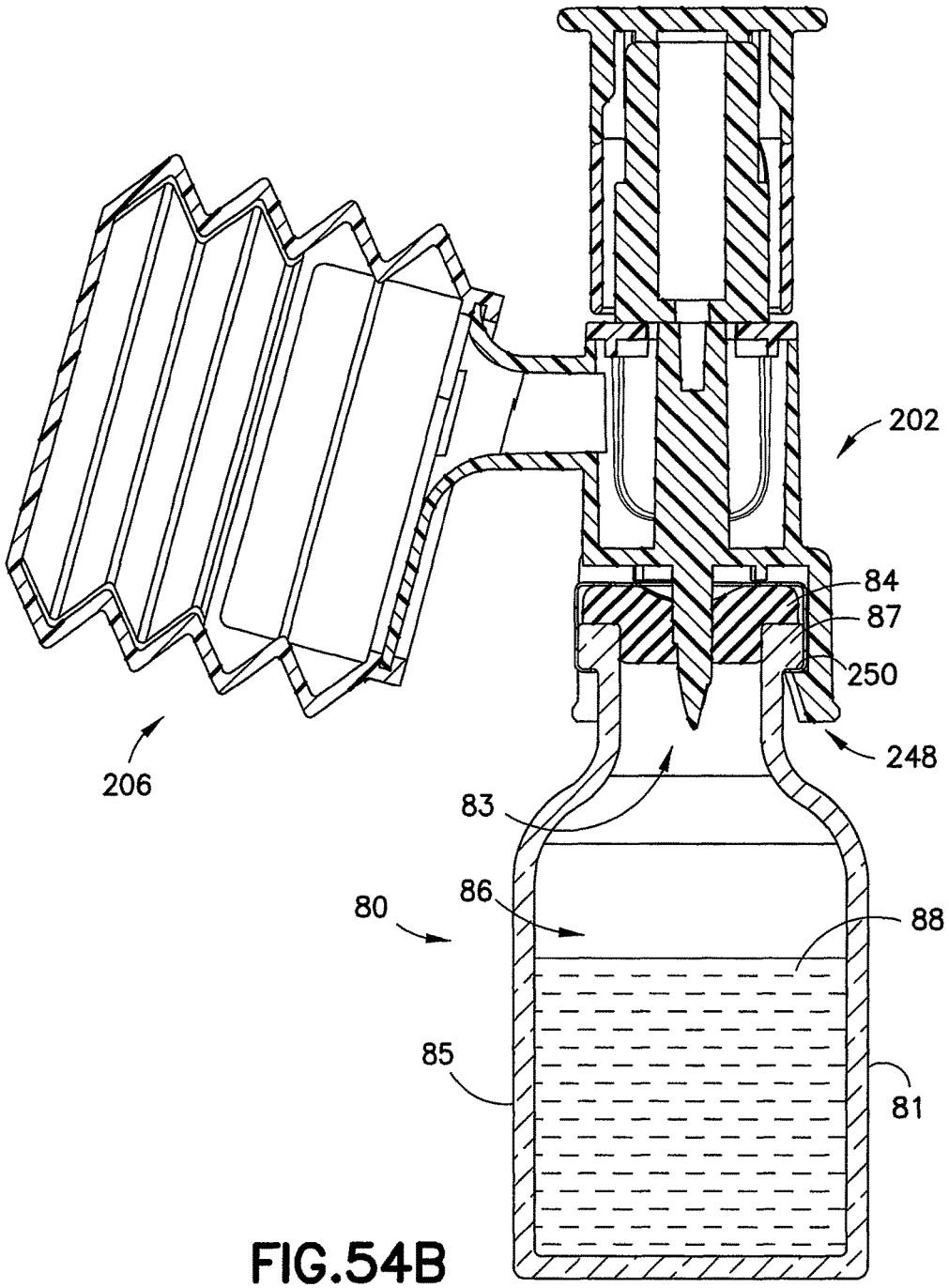
FIG. 54B is a cross-sectional view of the vial access device connected to the first vial taken along line 54B-54B of FIG. 54A in accordance with another aspect of the present invention.
Figure 55:
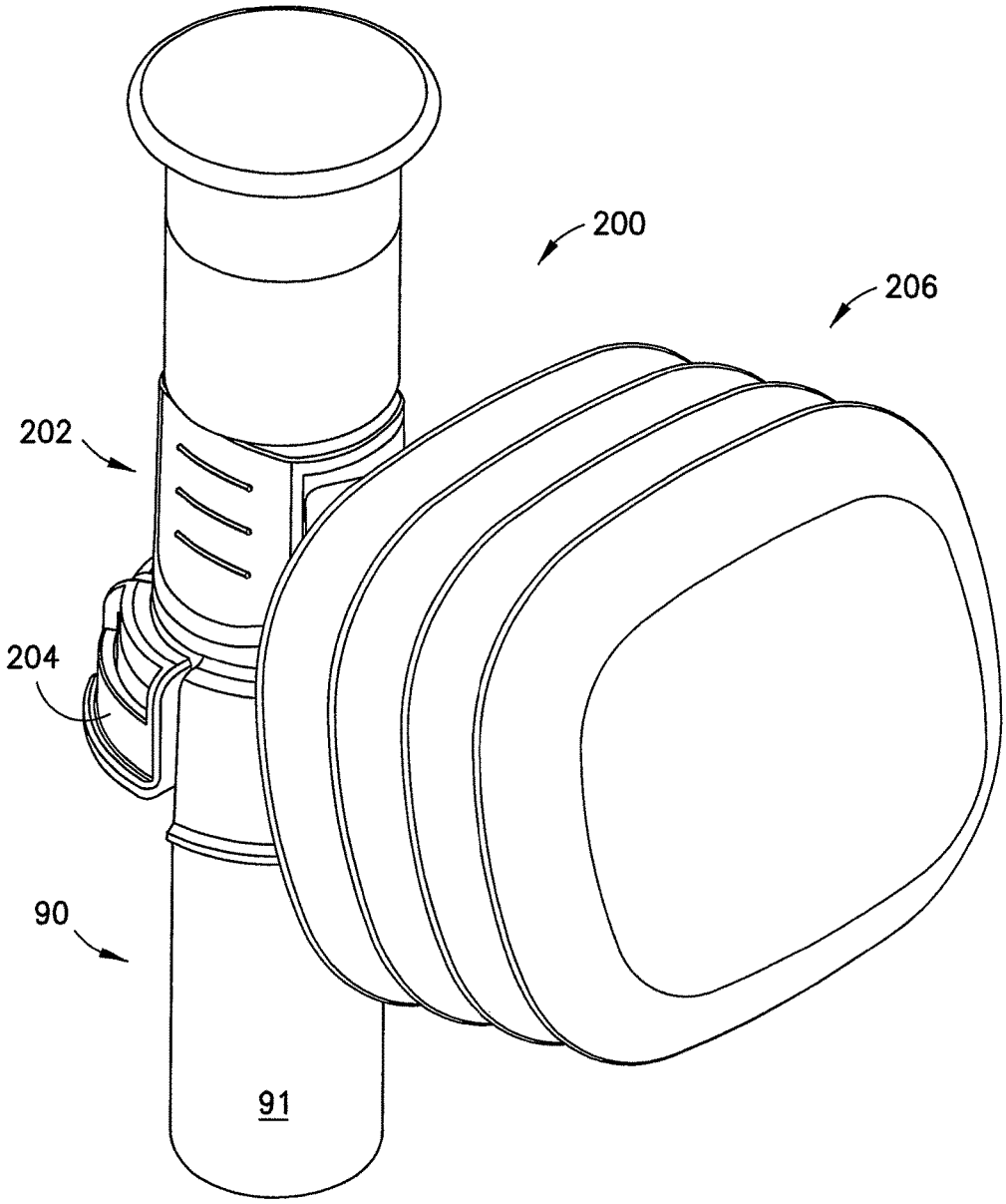
FIG. 55 is a perspective view of a vial access device and an adapter connected to a second vial in accordance with another aspect of the present invention.
Figure 56A:
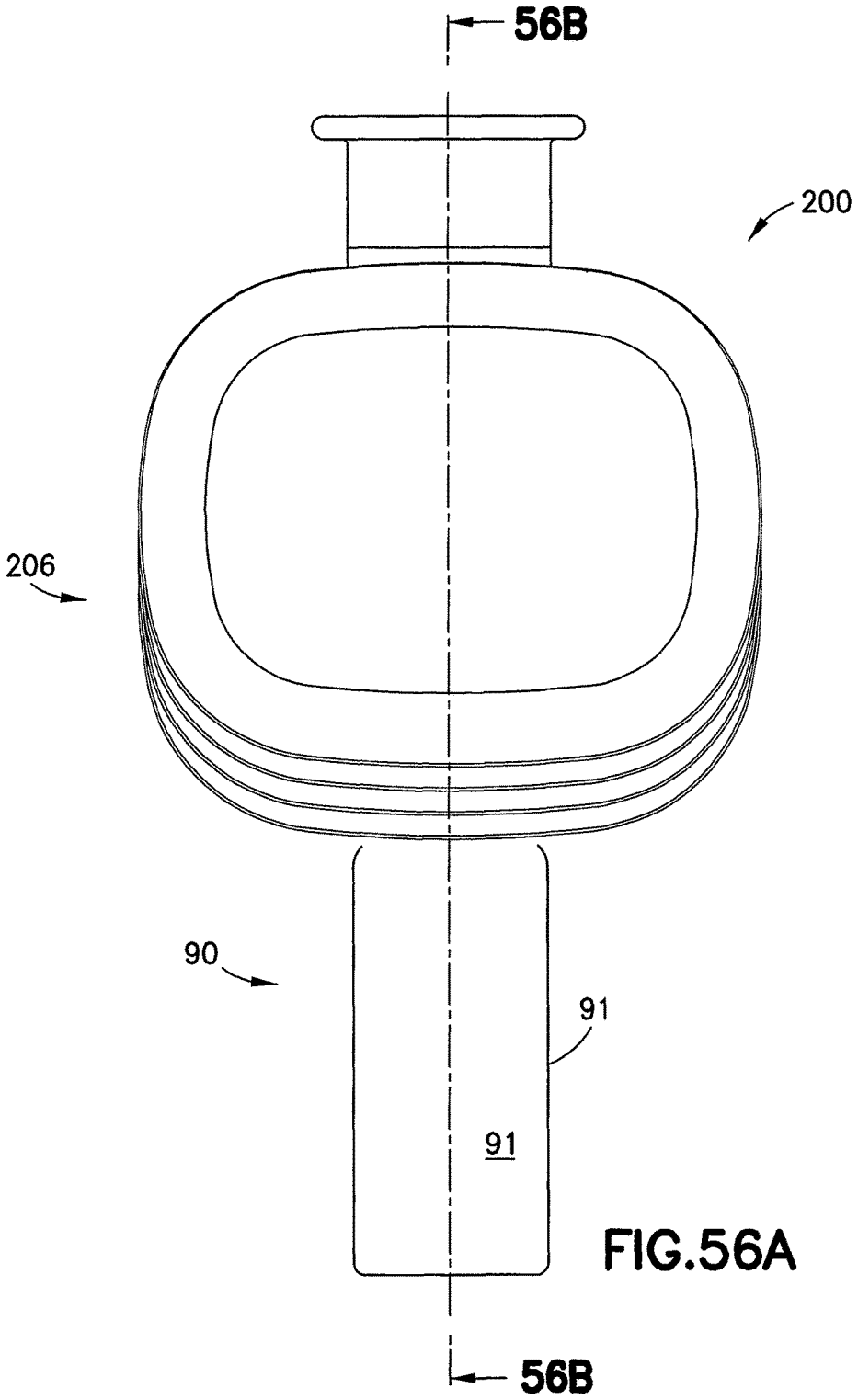
FIG. 56A is a side elevation view of a vial access device and an adapter connected to a second vial in accordance with another aspect of the present invention.
Figure 56B:
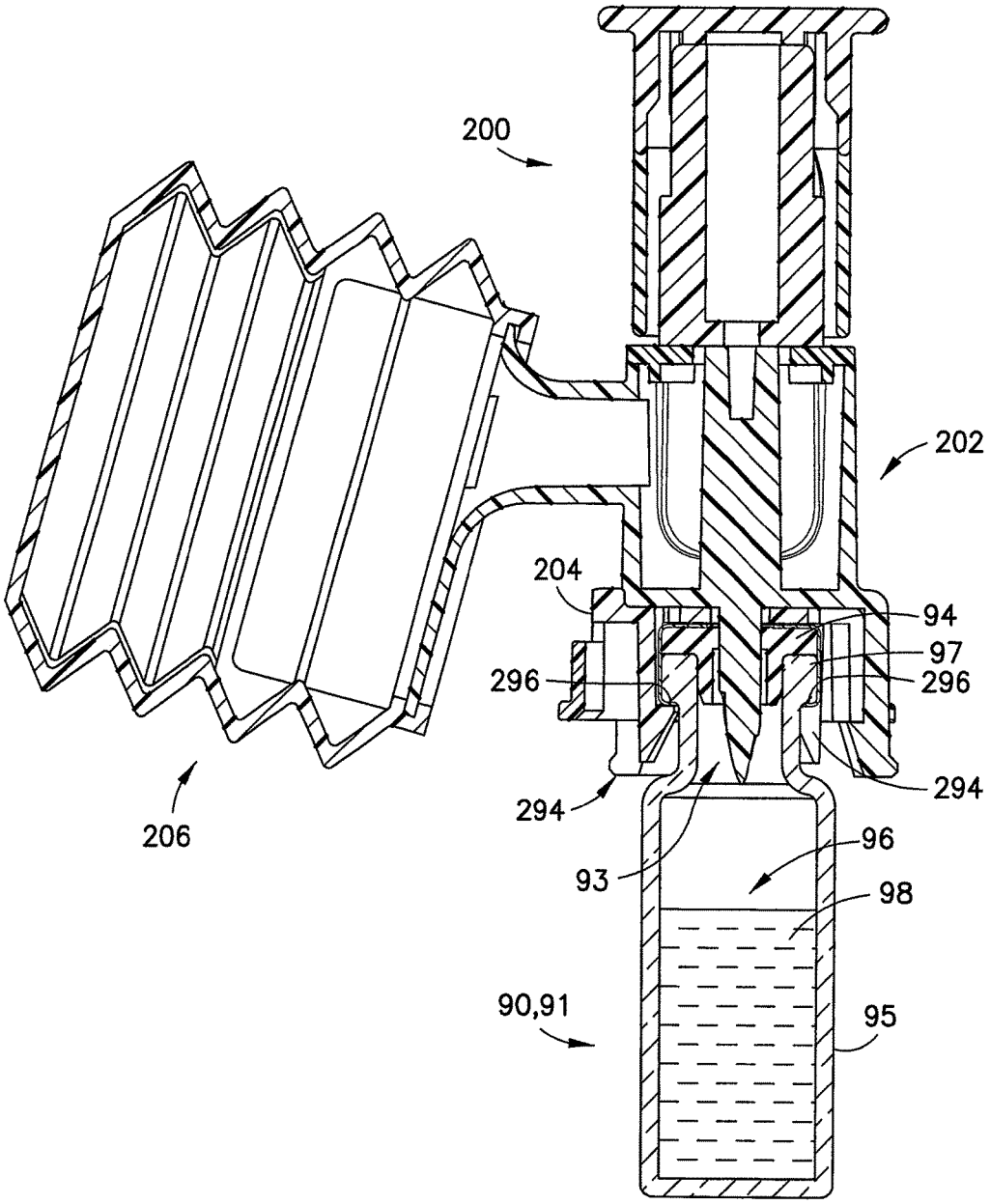
FIG. 56B is a cross-sectional view of the vial access device and the adapter connected to the second vial taken along line 56B-56B of FIG. 56A in accordance with another aspect of the present invention.

Referring to FIGS. 53-54B, with vial access device 202 attached to first vial 80, vial access device 202 provides substantially leak-proof sealing during engagement of a cannula with a vial, during transfer of a substance from a vial chamber to a barrel chamber via the cannula, and during disengagement of the cannula from the vial. Referring to FIGS. 55-56B, with vial access device 202 attached to second vial 90 via third adapter 204, third system 200 provides substantially leak-proof sealing during engagement of a cannula with a vial, during transfer of a substance from a vial chamber to a barrel chamber via the cannula, and during disengagement of the cannula from the vial. The leak-proof sealing of the third system 200 substantially prevents leakage of both air and liquid during use of the third system 200. Third system 200 is compatible with a needle and syringe assembly for accessing a medication contained within a vial for administering the medication to a patient. Third system 200 is also compatible to be used with a drug reconstitution system.

As described above, third system 200 is capable of accommodating a plurality of vials having different sizes. For example, referring to FIGS. 53-54B, first vial 80 defining a first vial size 81 may be a standard drug vial of any type having an open head portion 83 covered by a pierceable septum 84 of an elastomeric material. Walls 85 of first vial 80 define vial chamber 86 for containing a first substance 88. First vial 80 includes flange 87 located adjacent open head portion 83. Vial septum 84 is engaged with head portion 83 of first vial 80 to seal the first substance 88 within vial chamber 86. Referring to FIGS. 55-56B, second vial 90 defining a second vial size 91 may be a standard drug vial of any type having an open head portion 93 covered by a pierceable septum 94 of an elastomeric material. Walls 95 of second vial 90 define vial chamber 96 for containing a second substance 98. Second vial 90 includes flange 97 located adjacent open head portion 93. Vial septum 84 is engaged with head portion 93 of second vial 90 to seal the second substance 98 within vial chamber 96. In one aspect, second vial size 91 is less than first vial size 81.

Vial access device 202 and third adapter 204 provide a third system 200 that is capable of accommodating a plurality of vials having different sizes, e.g., first vial 80 having first vial size 81 and second vial 90 having second vial size 91. In one aspect, it is envisioned that vial access device 202 and third adapter 204 are compatible with a first vial 80 comprising a 20 mm vial and a second vial 90 comprising a 13 mm vial. In another aspect, it is envisioned that vial access device 202 and third adapter 204 are compatible with a first vial 80 comprising a 28 mm vial and a second vial 90 comprising a 20 mm vial. In another aspect, it is envisioned that vial access device 202 and third adapter 204 are compatible with a first vial 80 comprising a 32 mm vial and a second vial 90 comprising a 28 mm vial. In other aspects, it is envisioned that vial access device 202 and third adapter 204 are compatible with a first vial 80 comprising other vial sizes and a second vial 90 comprising other vial sizes, wherein the second vial size is less than the first vial size.

Figure 27:
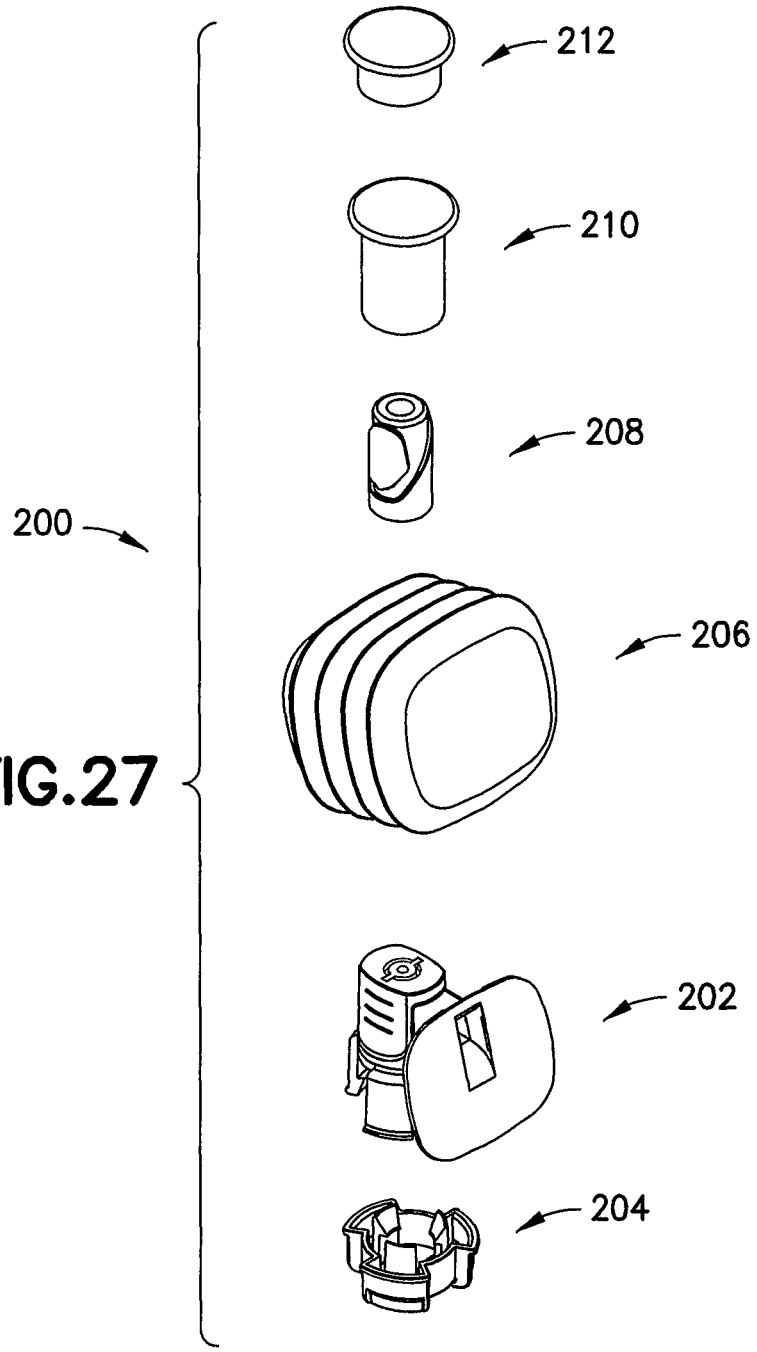
FIG. 27 is an exploded, perspective view of a system in accordance with another aspect of the present invention.
Figure 28:
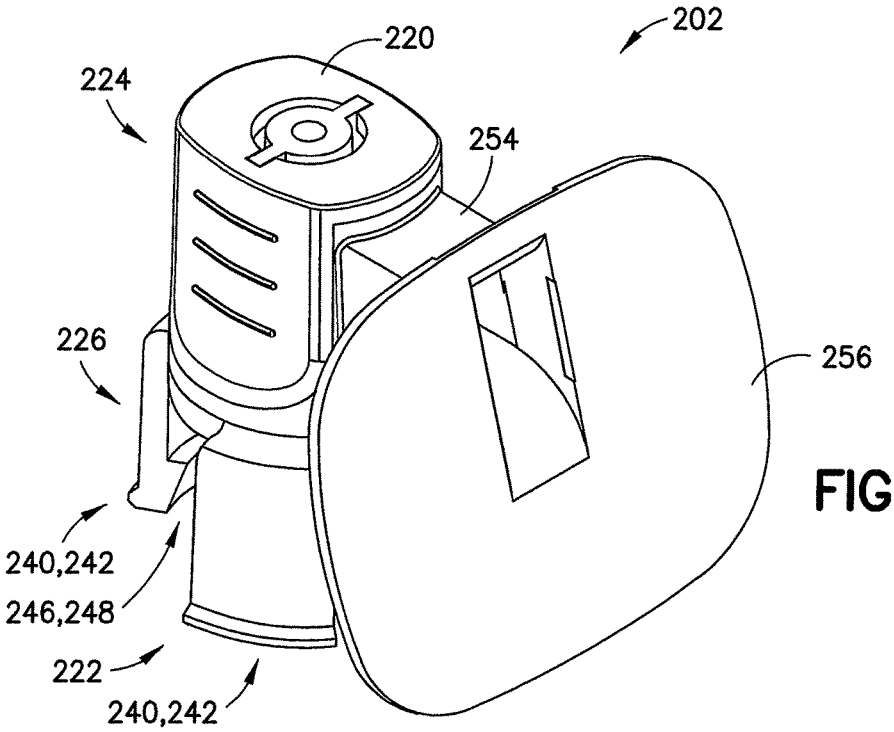
FIG. 28 is a perspective view of a vial access device in accordance with another aspect of the present invention.
Figure 29:
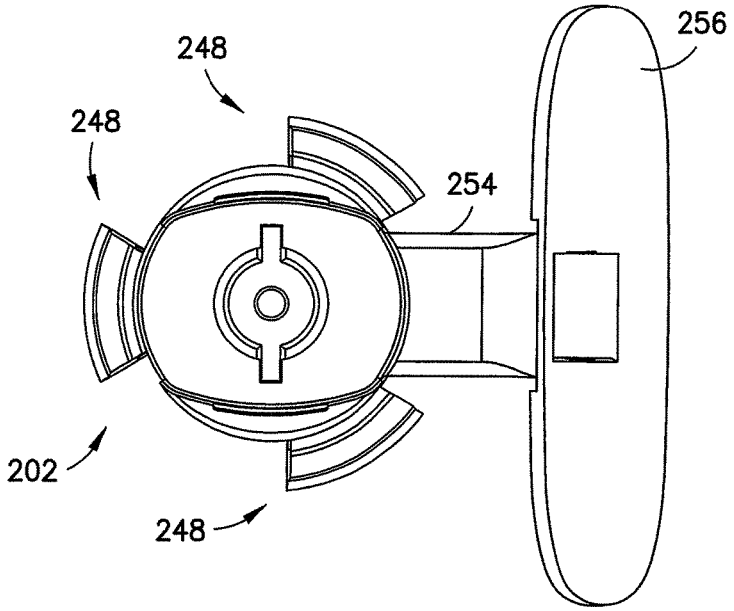
FIG. 29 is a top view of a vial access device in accordance with another aspect of the present invention.
Figure 30:
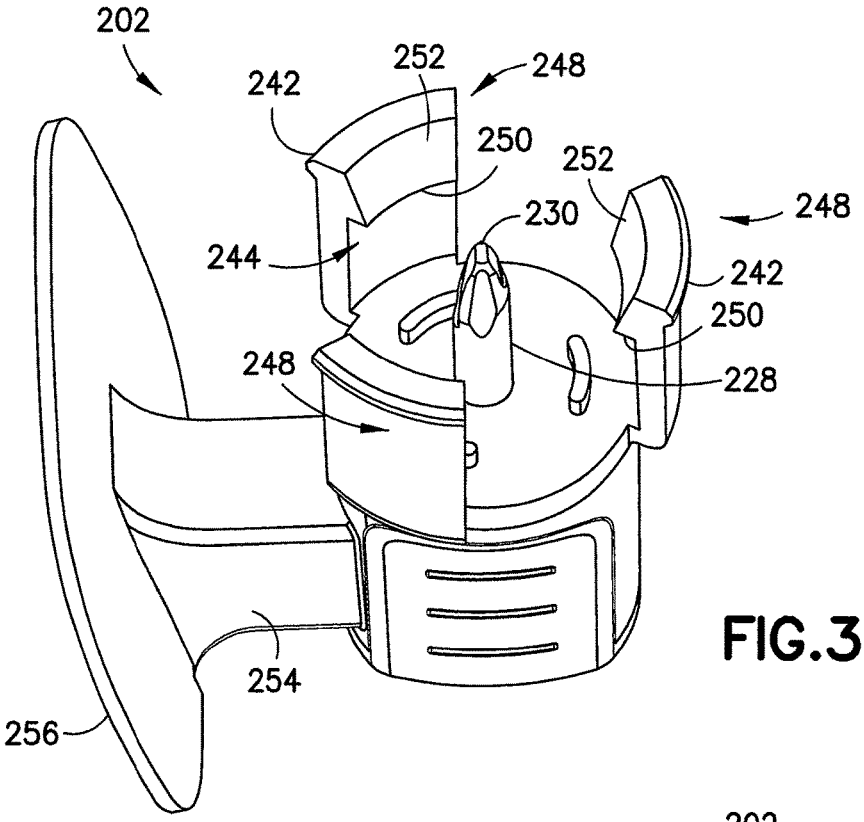
FIG. 30 is a bottom, perspective view of a vial access device in accordance with another aspect of the present invention.
Figure 31:
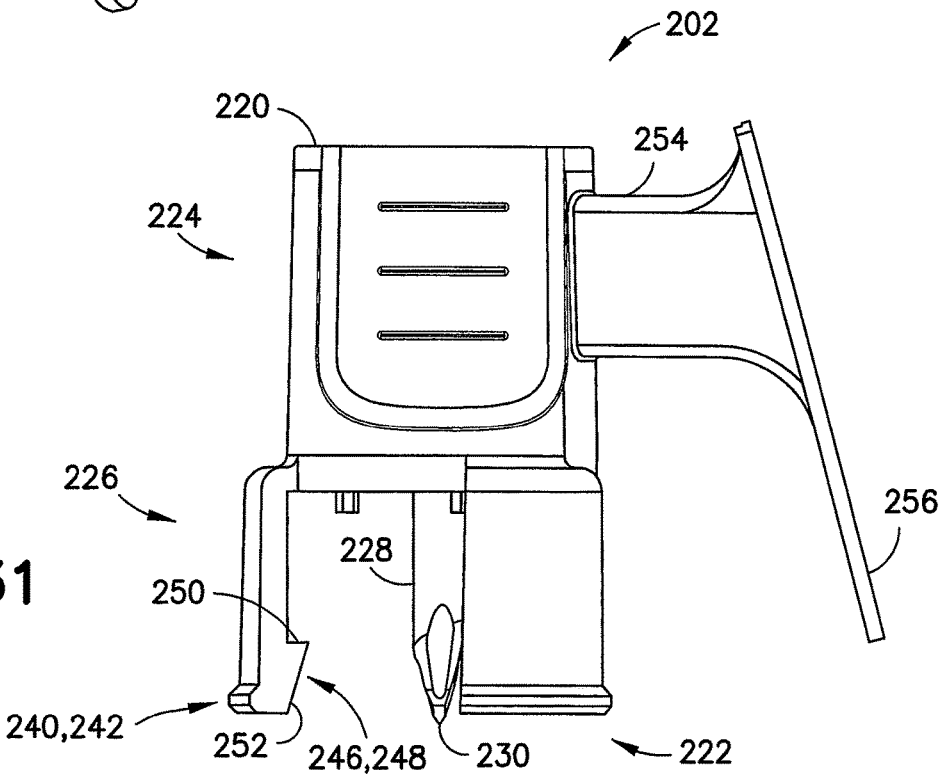
FIG. 31 is a side elevation view of a vial access device in accordance with another aspect of the present invention.
Figure 32:
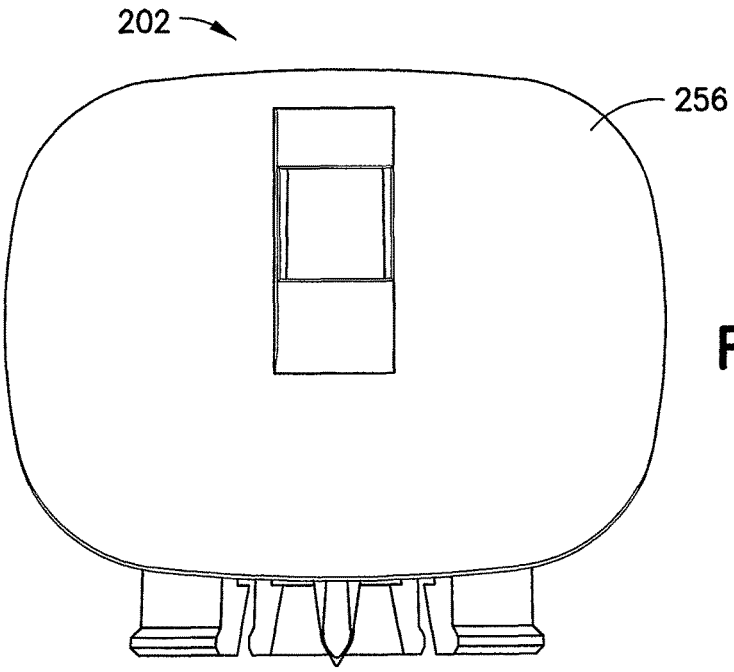
FIG. 32 is another side elevation view of a vial access device in accordance with another aspect of the present invention.

Referring to FIG. 27, in one aspect, third system 200 includes vial access device 202, third adapter 204, pressure equalization system 206, connector 208, top housing component 210, and cap component 212. FIG. 27 illustrates pressure equalization system 206 an expanded state, although the pressure equalization system also has a non-expanded state (not shown). Third system 200 includes a pressure equalization system 206 that is designed as an accordion bellows which is compressible and expandable and thus the volume of pressure equalization system 206 can thereby be increased and decreased. FIGS. 41A-56B illustrate pressure equalization system 206 an expanded state, although the pressure equalization system also has a non-expanded state (not shown). Pressure equalization system 206 is either a non-expanded state or an expanded state, e.g., pressure equalization system 206 is transitionable between a non-expanded state and an expanded state.

In one aspect, third system 200 includes either top housing component 210 or cap component 212 but not both. In one aspect, vial access device 202, pressure equalization system 206, connector 208, top housing component 210, and cap component 212 form a single integral component. In another aspect, vial access device 202, pressure equalization system 206, connector 208, top housing component 210, and cap component 212 are separate components that are attachable theretogether to form a vial access device housing component. The connector 208 is a bayonet-style connection, although the connection 208 may be embodied as any other suitable connection arrangement.

Third system 200 provides substantially leak-proof sealing and pressure balancing during engagement of a cannula with a vial, during transfer of a substance from a vial chamber to a barrel chamber via the cannula, and during disengagement of the cannula from the vial. The leak-proof sealing of the third system 200 substantially prevents leakage of both air and liquid during use of the third system 200. Third system 200 is compatible with a needle and syringe assembly for accessing a medication contained within a vial for administering the medication to a patient. Third system 200 is also compatible to be used with a drug reconstitution system as will be described in more detail below.

Referring to FIGS. 28-33B, vial access device 202 generally includes first end 220; opposing second end 222; neck portion 224 disposed adjacent first end 220; body portion 226 disposed adjacent second end 222; spike member 228 including piercing tip 230; fluid transfer channel 232; pressure normalization channel 234; pressure chamber 238; first adapter connection elements 240 comprising locking ribs 242; second adapter connection elements 244; vial connection element 246 comprising vial grip members 248, hook protrusions 250, and angled walls 252; arm portion 254; and pressure equalization connection wall 256.

First end 220 of vial access device 202 is substantially formed by neck portion 224. In one aspect, neck portion 224 may include a guiding groove arranged therein to guide corresponding guiding protrusions on a syringe adapter, for example, to establish a secure attachment between the syringe adapter and vial access device 202 after which fluid communication can be established.

Referring to FIGS. 28-33B, in one aspect, first end 220 of vial access device 202 may contain a pierceable barrier member. The pierceable barrier member provides for a liquid and gas tight seal between a piercing member and the pierceable barrier member during fluid transfer to minimize leakage and thereby prevent exposure of hazardous medicaments to a user. The pierceable barrier member provides a self-sealing seal that, with vial access device 202 attached to a vial, provides a leak-proof seal preventing any substance contained within the vial chamber from being exposed to a health care provider reconstituting, transporting, or administering a drug using third system 200. In one aspect, the pierceable barrier member comprises a resilient material. For example, the pierceable barrier member is preferably a unitary device molded of any flexible, elastomeric material conventionally used for fabricating gas-proof closures. The pierceable barrier member may be formed of a natural rubber material, polyurethane elastomers, butyl rubbers, or similar materials. It is contemplated that the pierceable barrier member is formed of a material having a Shore A hardness of approximately 10 to 50. It is also envisioned that the pierceable barrier member can have other material hardness values that would provide an appropriate self-sealing material to provide a leak-proof seal with a vial septum of a vial and a syringe adapter, thereby preventing any liquid or medication residue from being exposed to a health care provider reconstituting, transporting, or administering a drug using third system 200.

Second end 222 of vial access device 202 is substantially formed by body portion 226. Referring to FIGS. 28-33B, protruding out from body portion 226 at second end 222 of vial access device 202 is a piercing member or spike member 228 which includes piercing tip 230. The spike member 228 extends in a direction substantially parallel with the plurality of vial grip members 248 and serves the purpose of piercing a fluid container such as first vial 80 during assembly of vial access device 202 to a first vial 80 as is shown in greater detail in FIG. 54B.

Figure 33A:
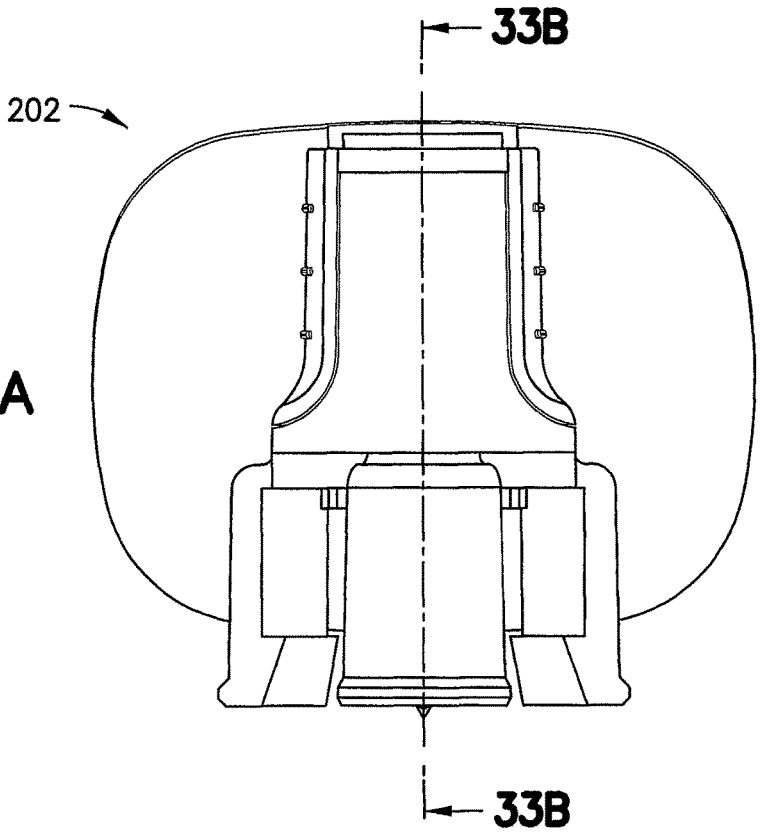
FIG. 33A is another side elevation view of a vial access device in accordance with another aspect of the present invention.
Figure 33B:
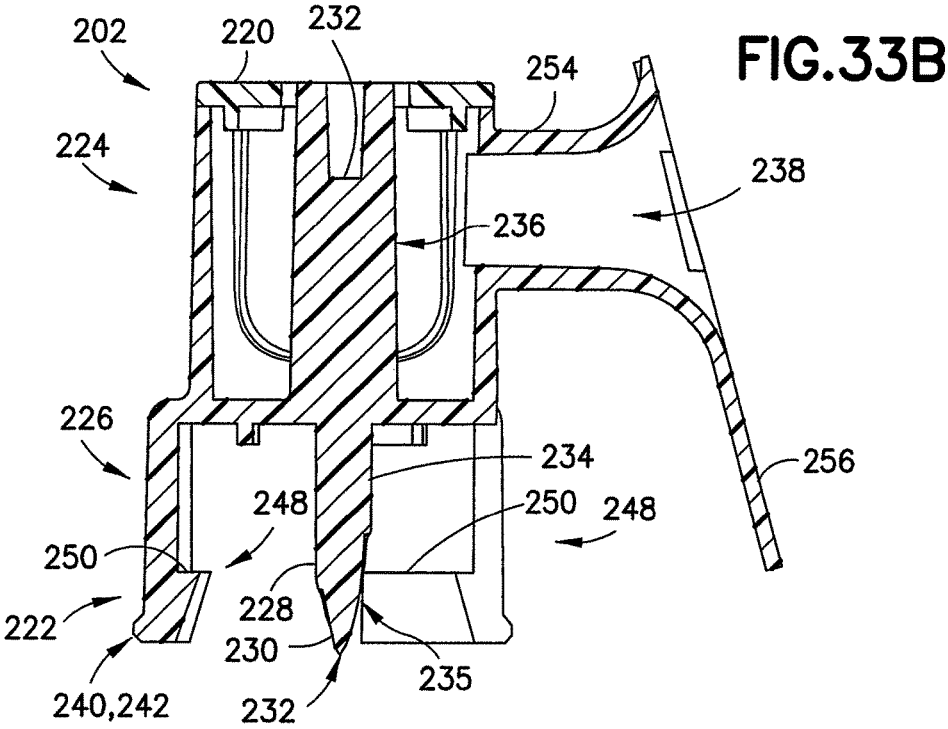
FIG. 33B is a cross-sectional view of a vial access device taken along line 33B-33B of FIG. 33A in accordance with another aspect of the present invention.

Referring to FIG. 33B, a fluid transfer channel 232 extends through spike member 228 such that piercing tip 230 is in fluid communication with first end 220 of vial access device 202. The purpose of fluid transfer channel 232 is to permit a needle cannula to extend through vial access device 202 and to thereby permit fluid to be transferred through vial access device 202. In one aspect, fluid transfer channel 232 extends inside of spike member 228 as shown in FIG. 33B.

Referring to FIG. 33B, in one aspect, a pressure normalization channel 234 extends from enter aperture 235 to exit aperture 236 and then to pressure chamber 238. Pressure normalization channel 234 is arranged to provide gas communication between a pressure equalization system, such as pressure equalization system 206, and the interior of a vial when the vial access device 202 is connected to a vial. With vial access device 202 connected to a vial, a syringe or cannula assembly may be used to inject fluid into the vial or to withdraw fluid therefrom. The use of a pressure equalization system, such as pressure equalization system 206, with a system of the present disclosure provides a system for the closed transfer of fluids that provides substantially leak-proof sealing and pressure equalization during engagement of a cannula with a vial, during transfer of a substance from a vial chamber to a barrel chamber via the cannula, and during disengagement of the cannula from the vial.

Referring to FIGS. 28-33B, a vial connection element 246 is disposed at second end 222 of vial access device 202. In one aspect, vial connection element 246 includes a plurality of vial grip members 248 having hook protrusions 250 and angled walls 252. In one aspect, vial grip members 248 are elastically deformable. Vial grip members 248 are attachable to a first vial 80 to secure vial access device 202 to the first vial 80. Each vial grip member 248 includes a hook protrusion 250 arranged to engage a corresponding flange 87 on a container such as first vial 80 as shown in FIGS. 53-54B. Vial connection element 246 of vial access device 202 may be dimensioned to be attached to containers of any size and volume. In other aspects, vial connection element 246 of vial access device 202 may include other connection mechanisms for securing vial access device 202 to first vial 80 such as a threaded portion, a snap fit mechanism, locking tabs, or other similar mechanism. Each vial grip member 248 includes an angled wall 252 arranged to provide a lead-in surface to center and align vial access device 202 on a vial.

Figure 41A:
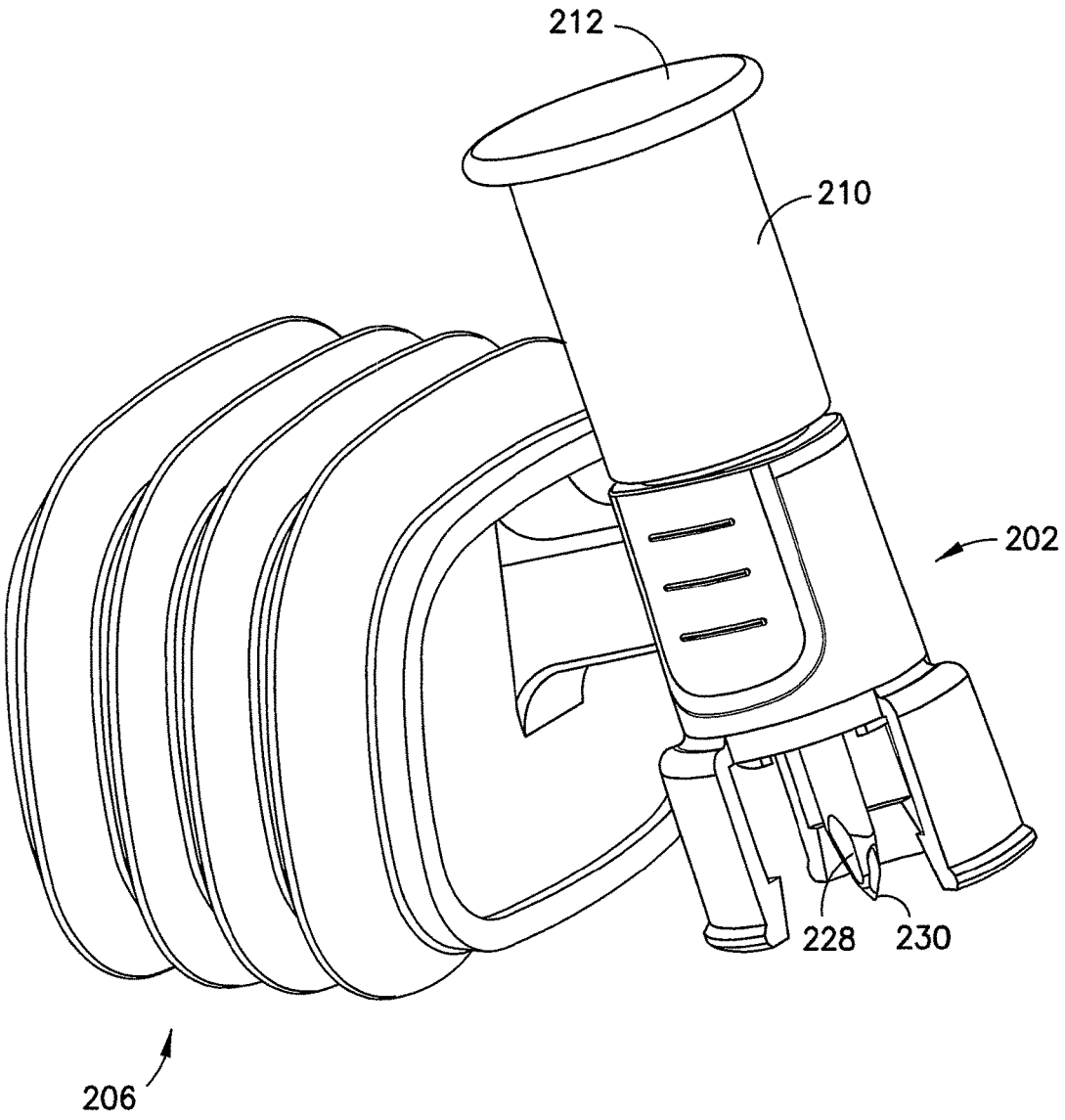
FIG. 41A is a perspective view of a vial access device housing component in accordance with another aspect of the present invention.
Figure 41B:
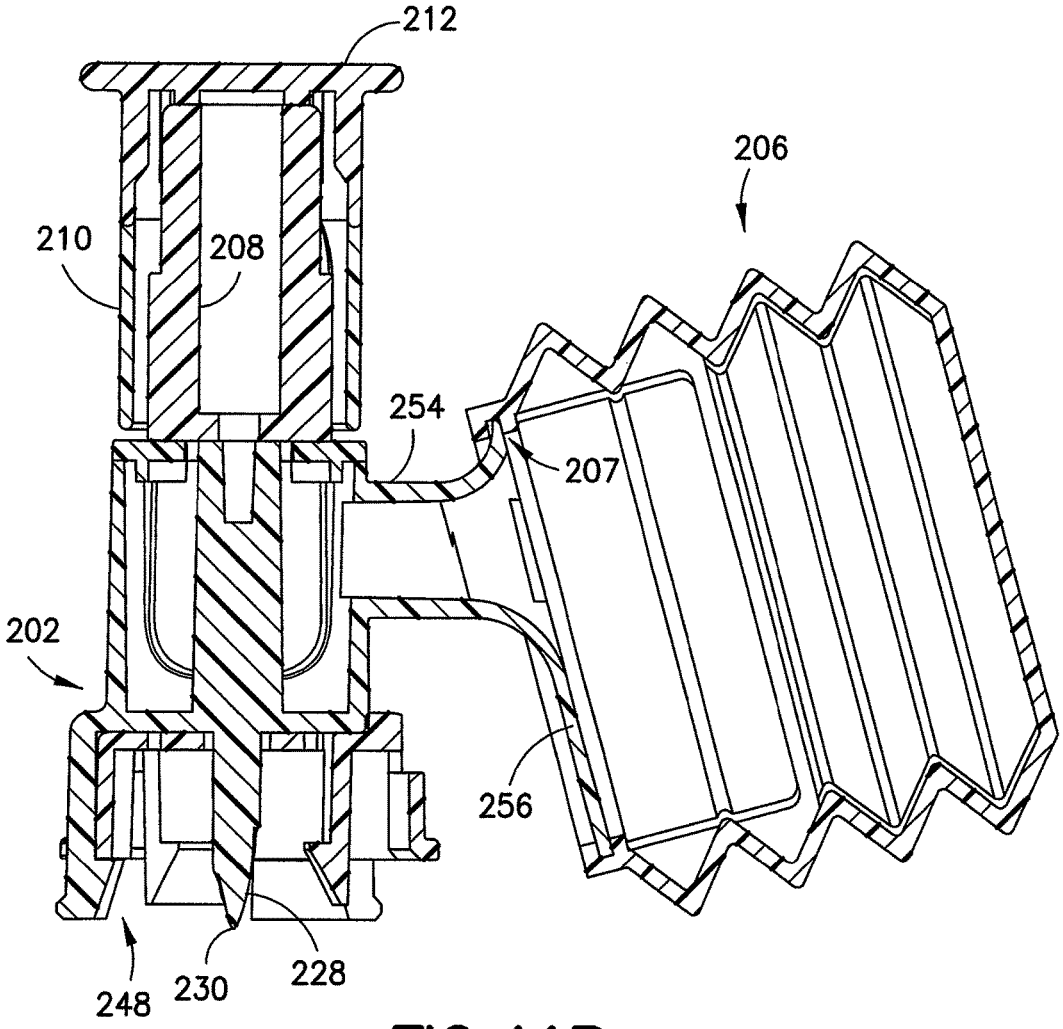
FIG. 41B is a cross-sectional view of the vial access device housing component of FIG. 41A in accordance with another aspect of the present invention.
Figure 42:
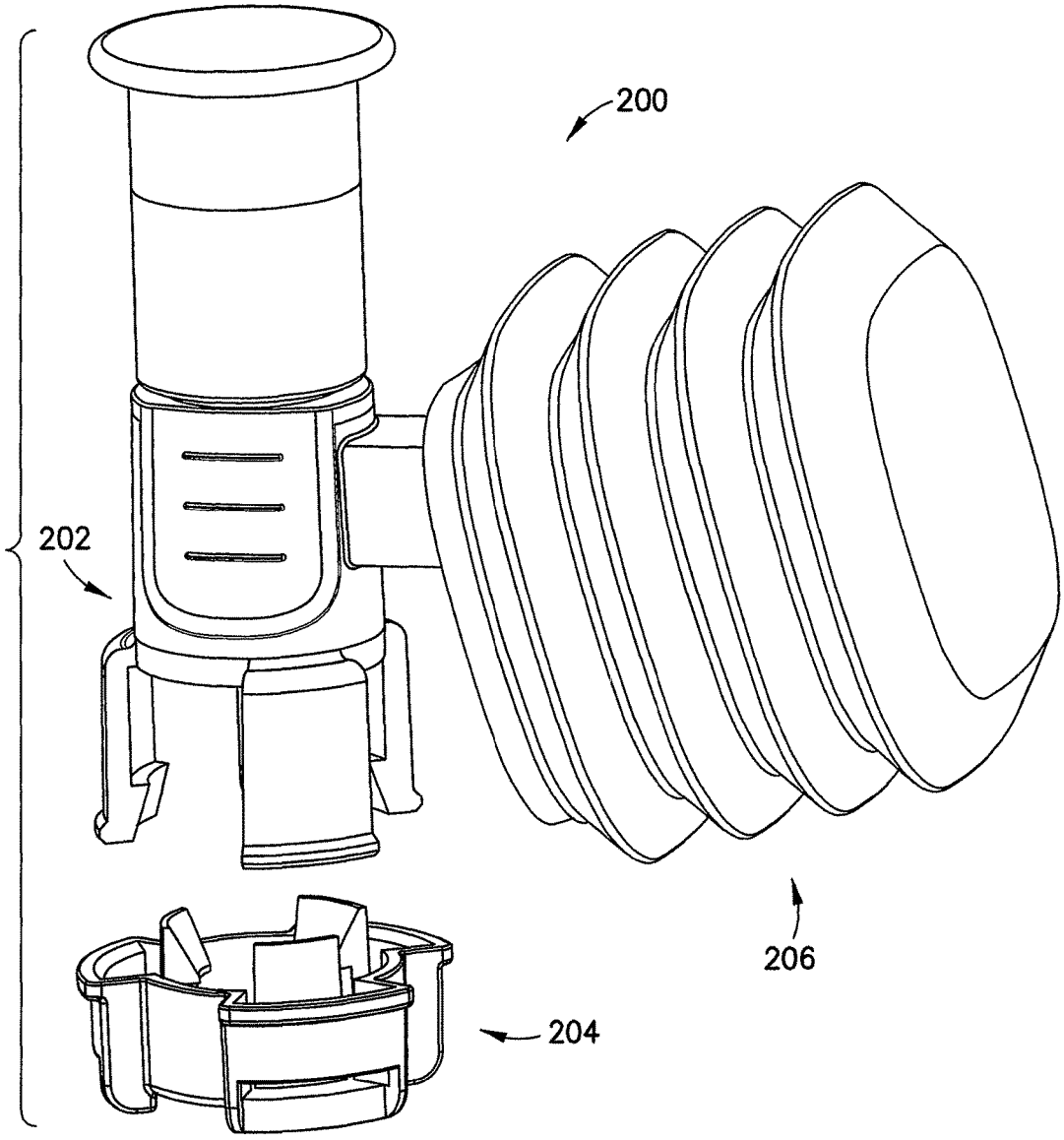
FIG. 42 is an exploded, perspective view of a system in accordance with another aspect of the present invention.
Figure 43:
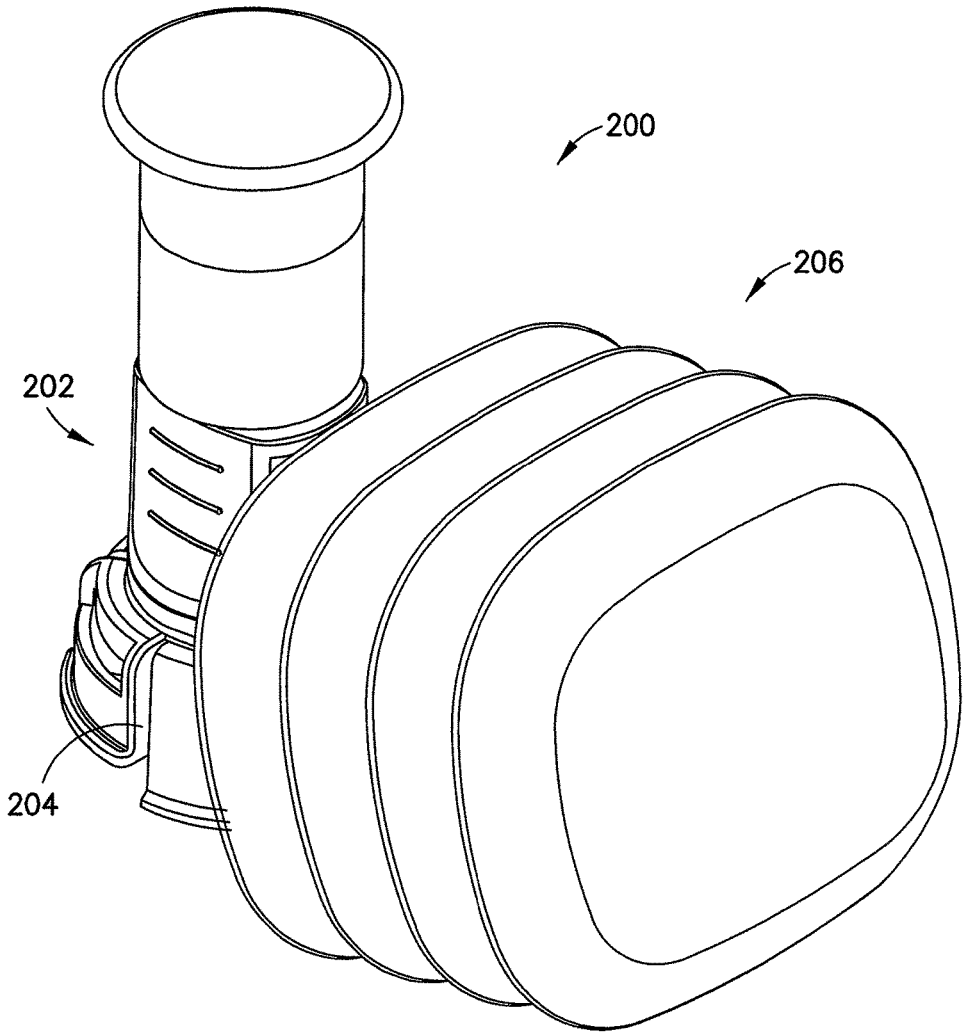
FIG. 43 is an assembled, perspective view of the system of FIG. 42 with an adapter in a shield position in accordance with another aspect of the present invention.
Figure 44:
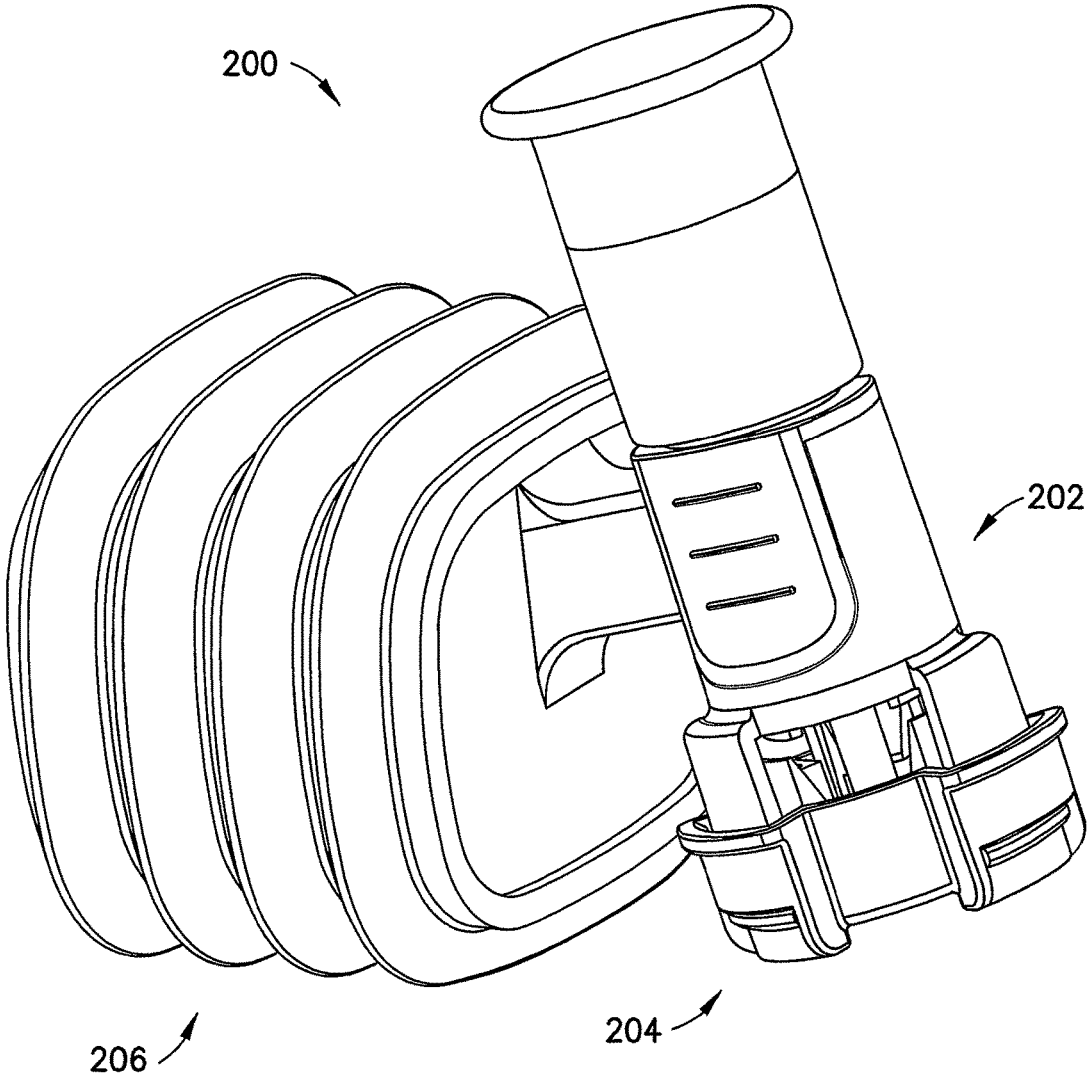
FIG. 44 is a perspective view of a system with an adapter in a shield position in accordance with another aspect of the present invention.
Figure 45:
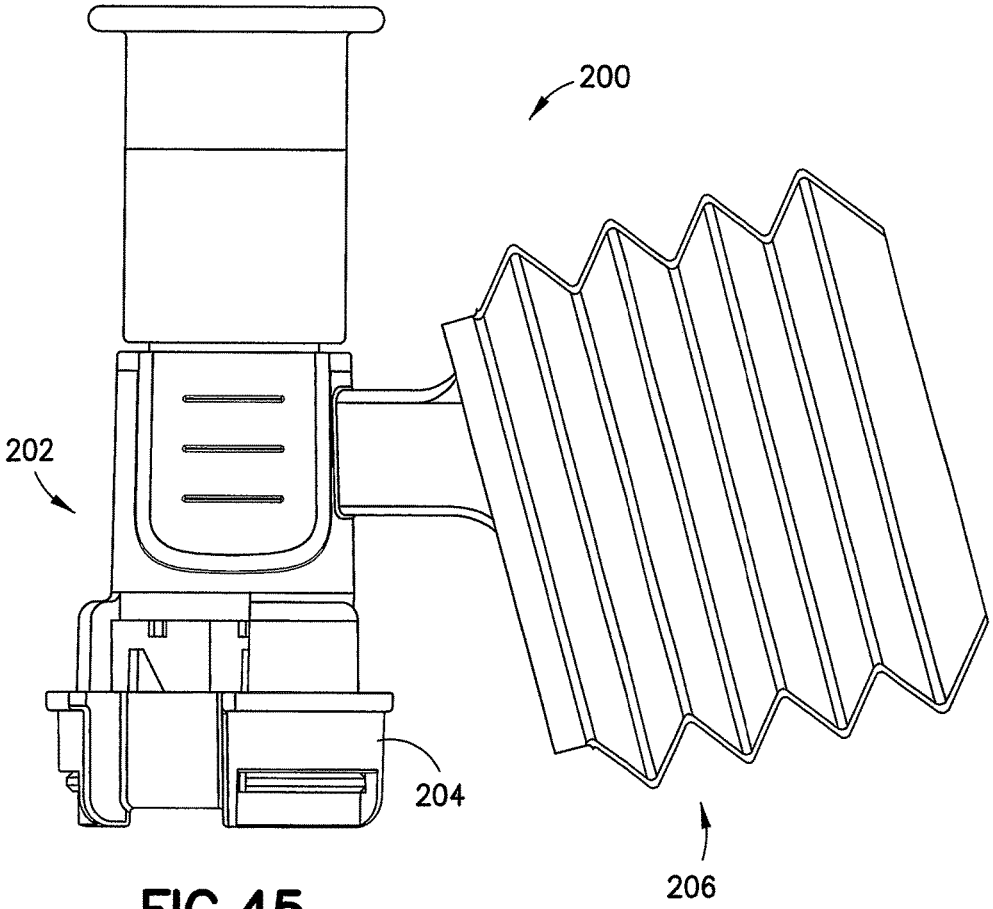
FIG. 45 is a side elevation view of a system with an adapter in a shield position in accordance with another aspect of the present invention.
Figure 46A:
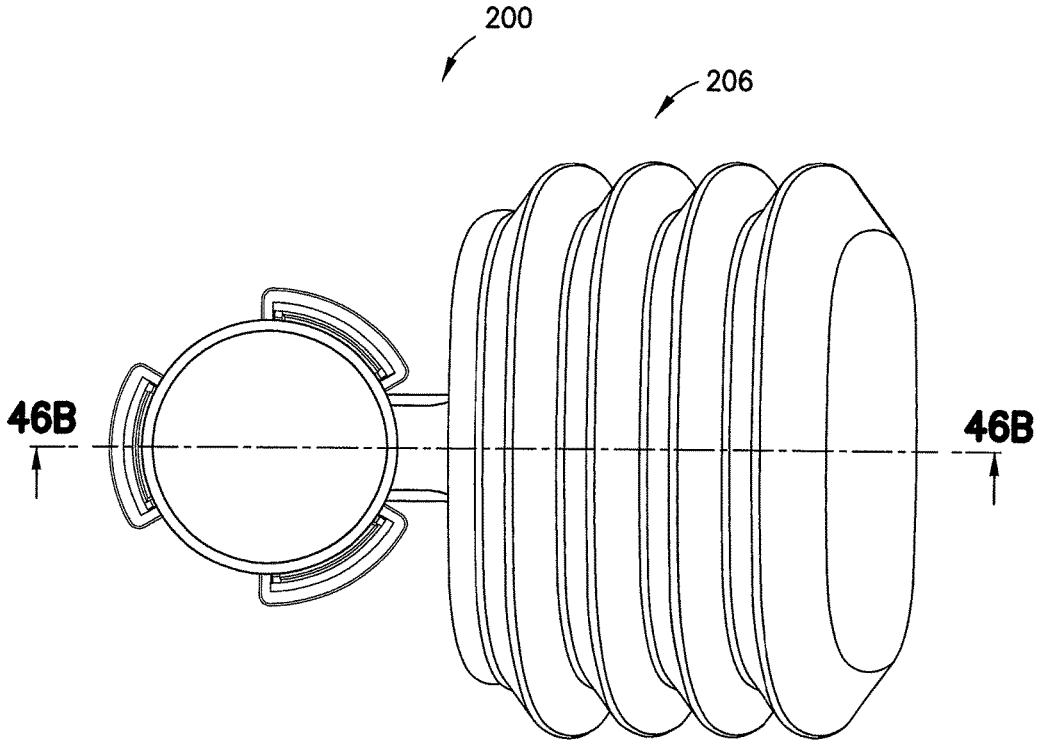
FIG. 46A is a top view of a system with an adapter in a shield position in accordance with another aspect of the present invention.
Figure 46B:
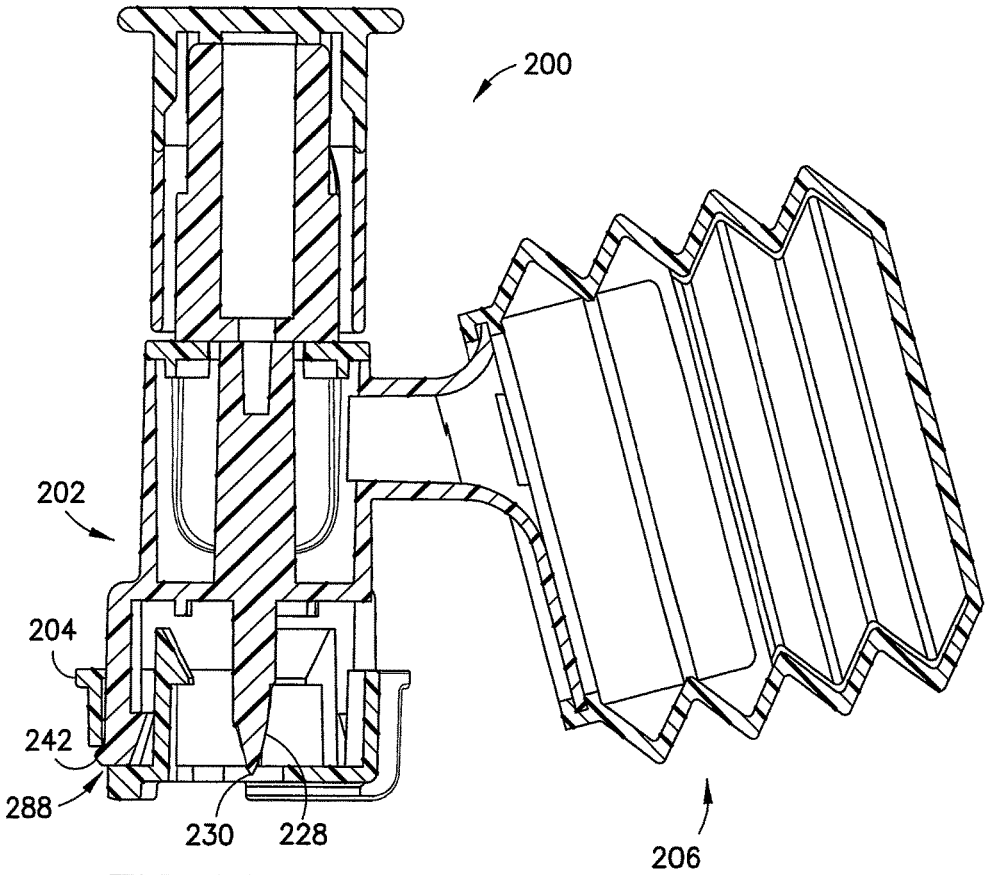
FIG. 46B is a cross-sectional view of a system with an adapter in a shield position taken along line 46B-46B of FIG. 46A in accordance with another aspect of the present invention.
Figure 47:
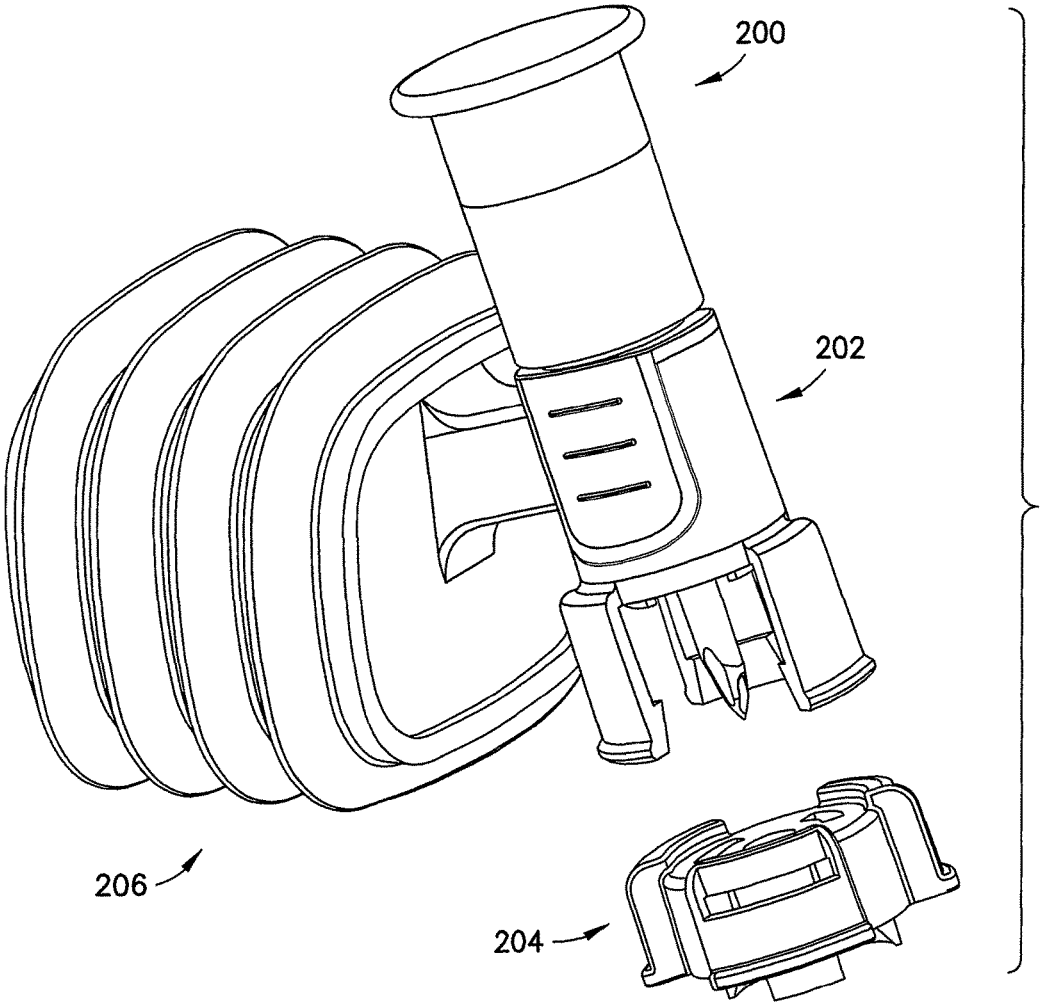
FIG. 47 is an exploded, perspective view of a system in accordance with another aspect of the present invention.
Figure 48:
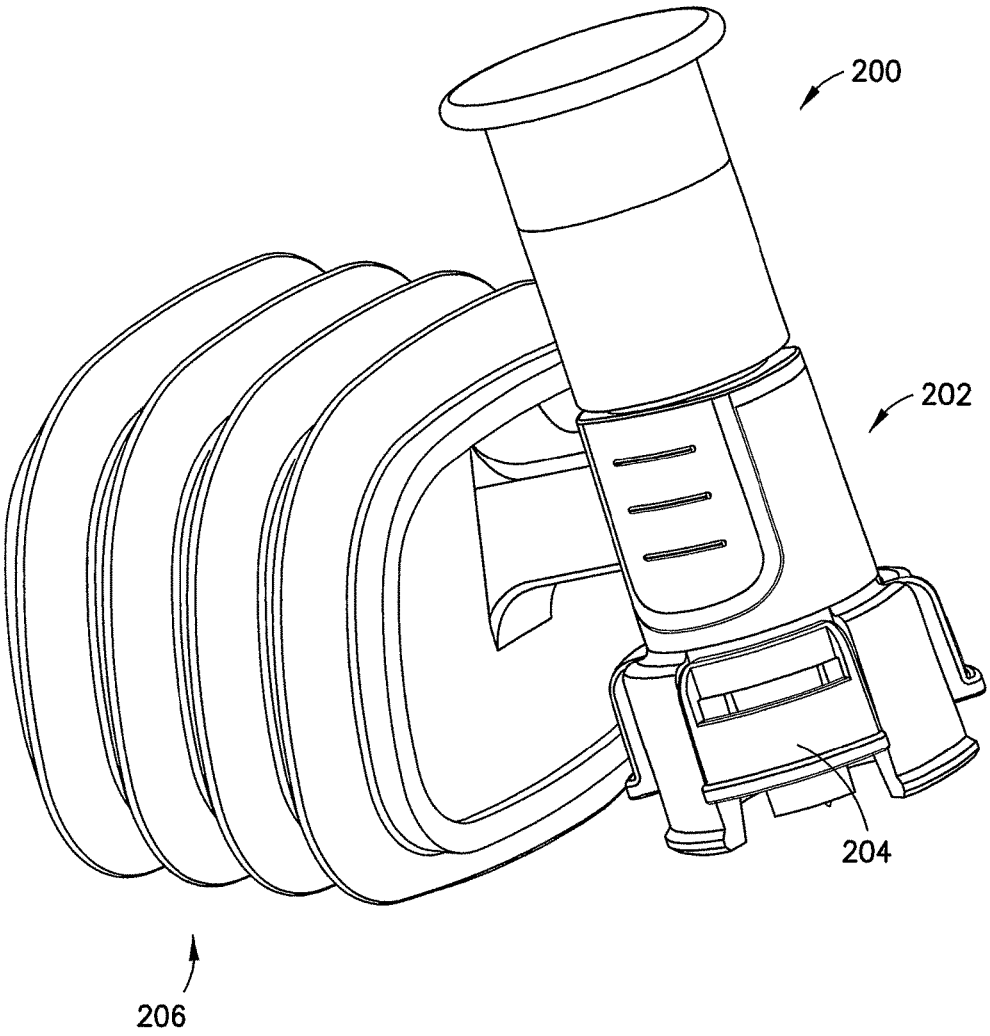
FIG. 48 is an assembled, perspective view of the system of FIG. 47 with an adapter in a vial position in accordance with another aspect of the present invention.
Figure 49:
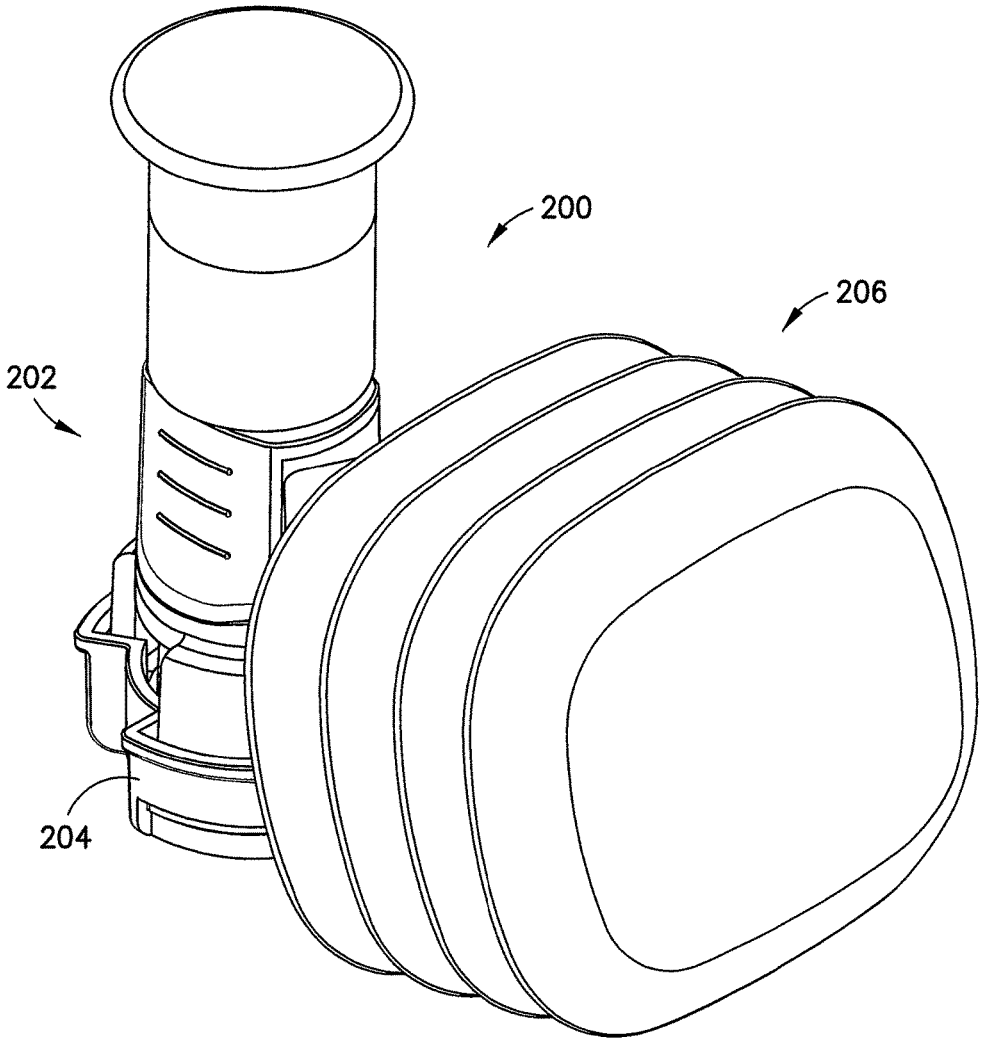
FIG. 49 is a perspective view of a system with an adapter in a vial position in accordance with another aspect of the present invention.
Figure 50:
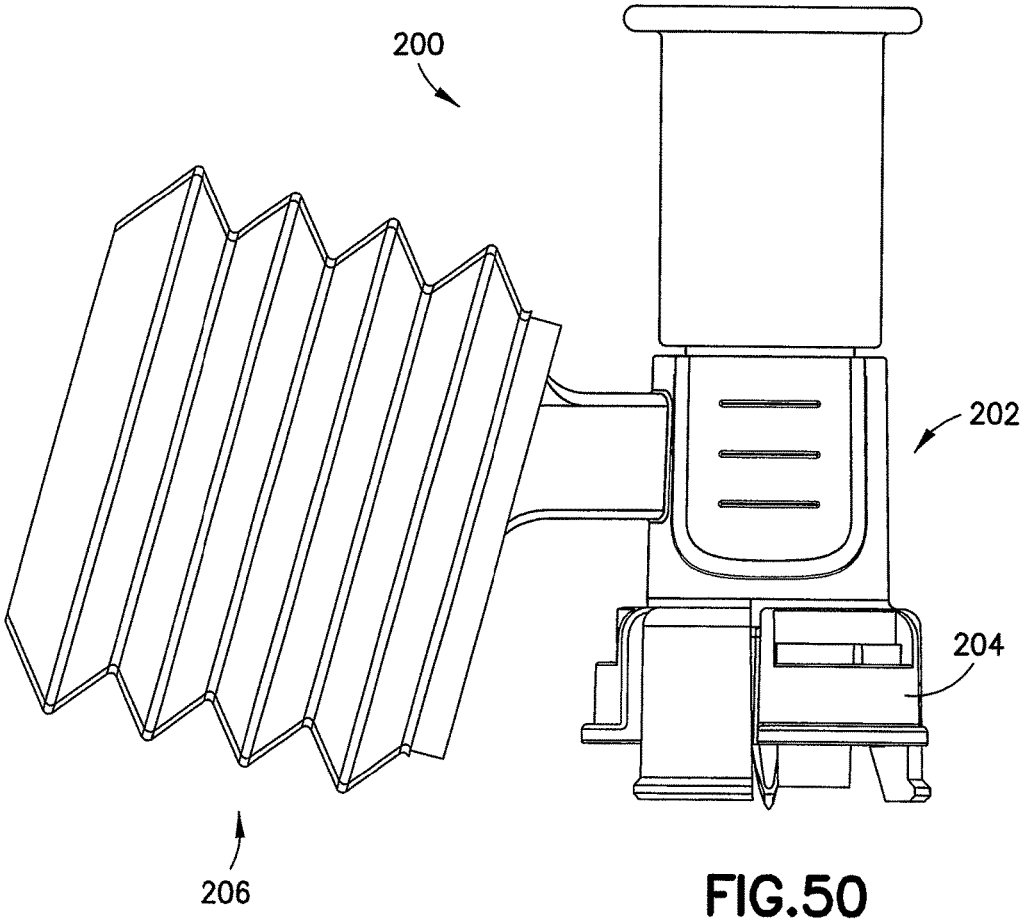
FIG. 50 is a side elevation view of a system with an adapter in a vial position in accordance with another aspect of the present invention.
Figure 51:
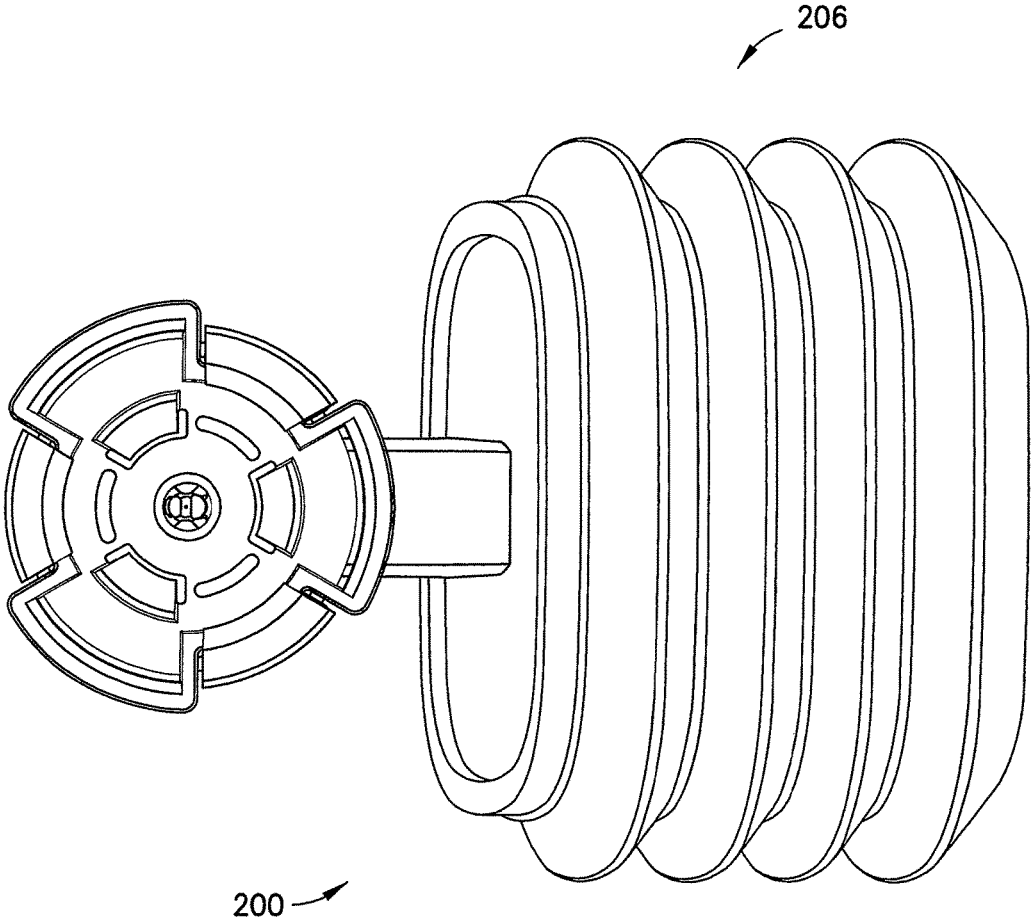
FIG. 51 is a bottom view of a system with an adapter in a vial position in accordance with another aspect of the present invention.
Figure 52:
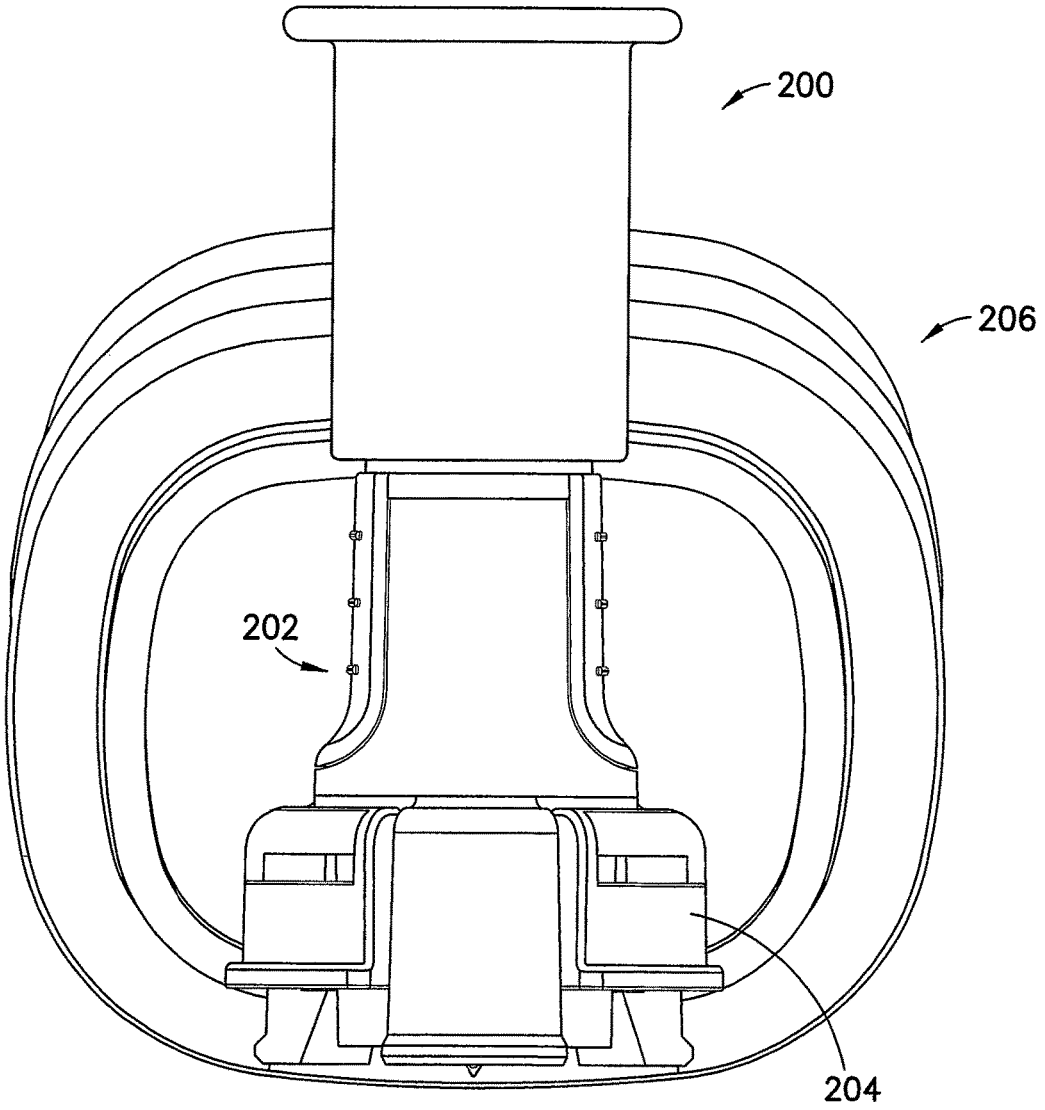
FIG. 52 is a side elevation view of a system with an adapter in a vial position in accordance with another aspect of the present invention.

Referring to FIGS. 28-33B, vial access device 202 includes a first adapter connection element 240 and a second adapter connection element 244. In this manner, vial access device 202 is connectable with third adapter 204 in a shield position and a vial position as discussed in more detail below. In one aspect, first adapter connection element 240 comprises a plurality of locking ribs 242. Locking ribs 242 are spaced a distance from one another as shown in FIGS. 28-33B. In one aspect, pressure equalization system 206 includes receiving slots 207 and pressure equalization system 206 is attachable to pressure equalization connection wall 256 of arm portion 254 of vial access device 202 by engagement of connection wall 256 within receiving slots 207 as shown in FIG. 41B.

Referring to FIGS. 34-40, third adapter 204 generally includes horizontal shield wall 270; outer portion 272 extending from the periphery of horizontal shield wall 270, outer portion 272 comprising outer shield wall 274 which defines outer vial access device compartments 276; inner portion 278 extending from horizontal shield wall 270 and disposed within outer portion 272, inner portion 278 comprising a plurality of inner shield walls 280 defining spike shield area 282; spike cavity 284 defined within a central region of horizontal shield wall 270; access device connection element 286 comprising a plurality of locking apertures 288 and a plurality of locking walls 290; and vial connection element 292 comprising vial grip members 294, hook protrusions 296, and angled walls 298.

Third adapter 204 is transitionable between a shield position (FIGS. 42-46B) in which third adapter 204 is attachable to vial access device 202 such that third adapter 204 shields a spike member 228 of vial access device 202 and a vial position (FIGS. 47-52 and 55-56B) in which third adapter 204 is attachable to a second vial 90 defining a second vial size 91, the second vial size 91 different than the first vial size 81. In this manner, third adapter 204 provides reversibility between a shield configuration in which third adapter 204 shields spike member 228 of vial access device 202 to prevent spike stick injuries and an adapter or vial configuration in which third adapter 204 allows third system 200 to accommodate a plurality of vials having different sizes.

Figure 34:
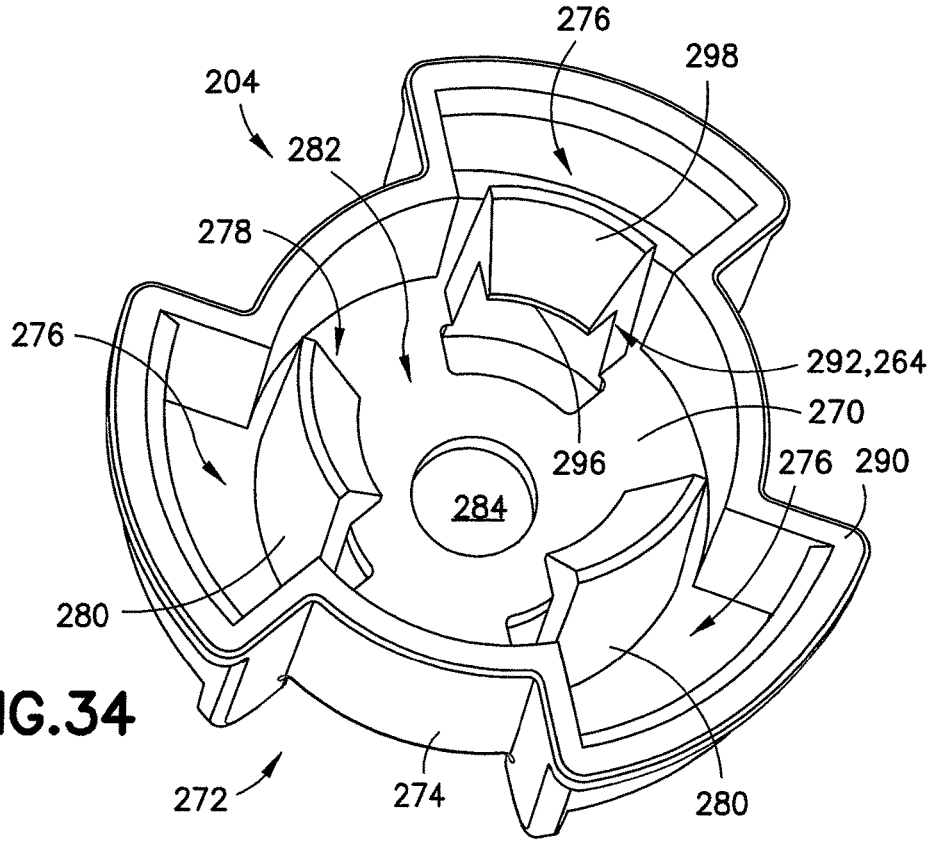
FIG. 34 is a perspective view of an adapter in accordance with another aspect of the present invention.

Referring to FIG. 34, horizontal shield wall 270 and inner shield walls 280 together define a spike shield area 282 which is sized and configured to receive and shield spike member 228 of vial access device 202 with third adapter 204 in a shield position. In this manner, third adapter 204 provides a physical barrier that shields spike member 228 of vial access device 202 and prevents the fingers of a user from contacting piercing tip 230 of spike member 228.

Figure 35:
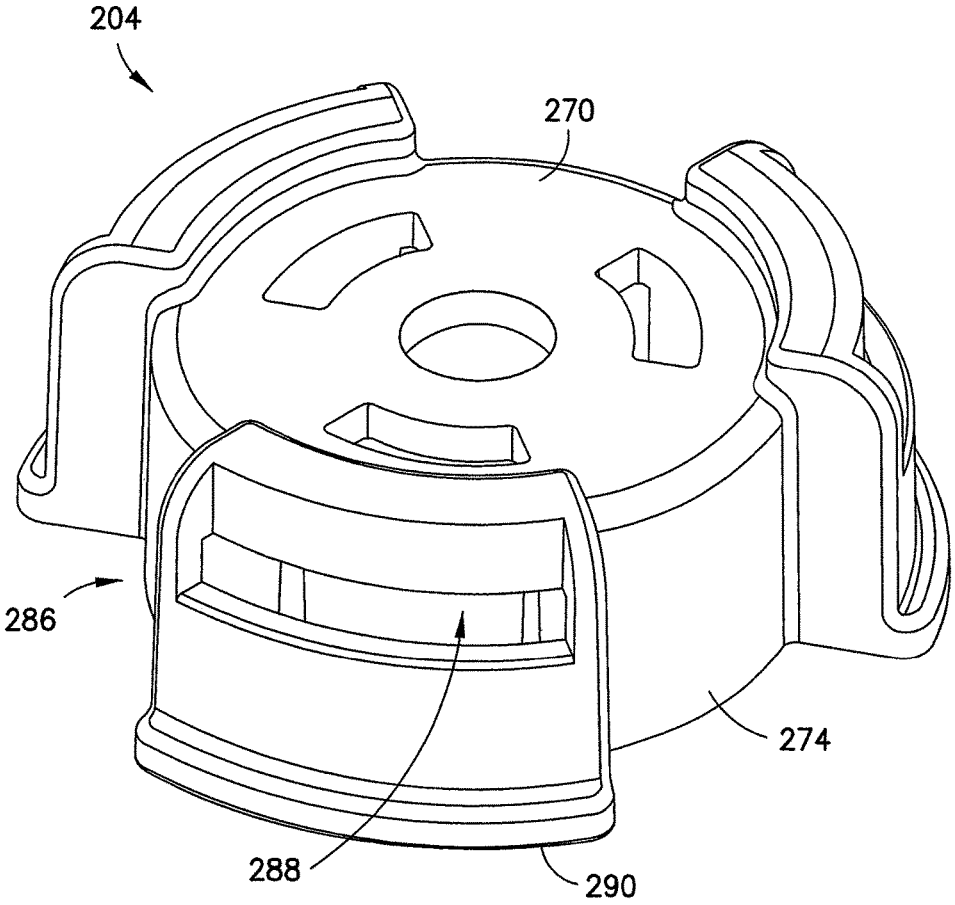
FIG. 35 is another perspective view of an adapter in accordance with another aspect of the present invention.
Figure 36A:
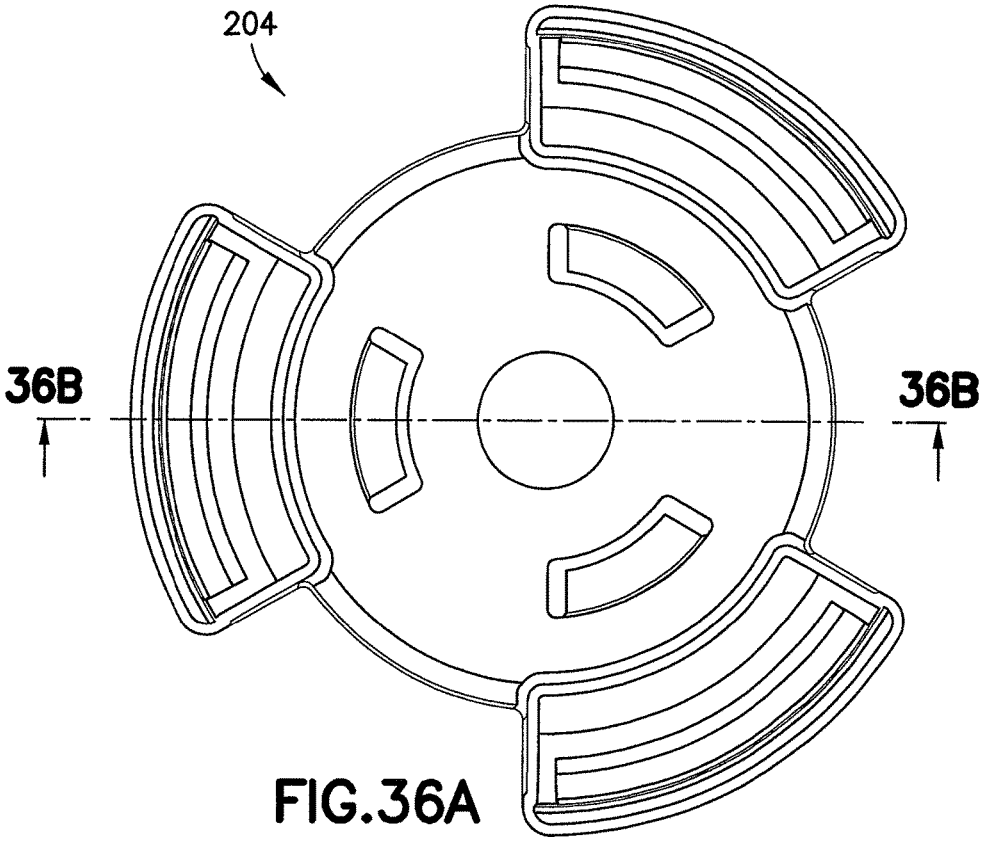
FIG. 36A is a top view of an adapter in accordance with another aspect of the present invention.
Figure 36B:
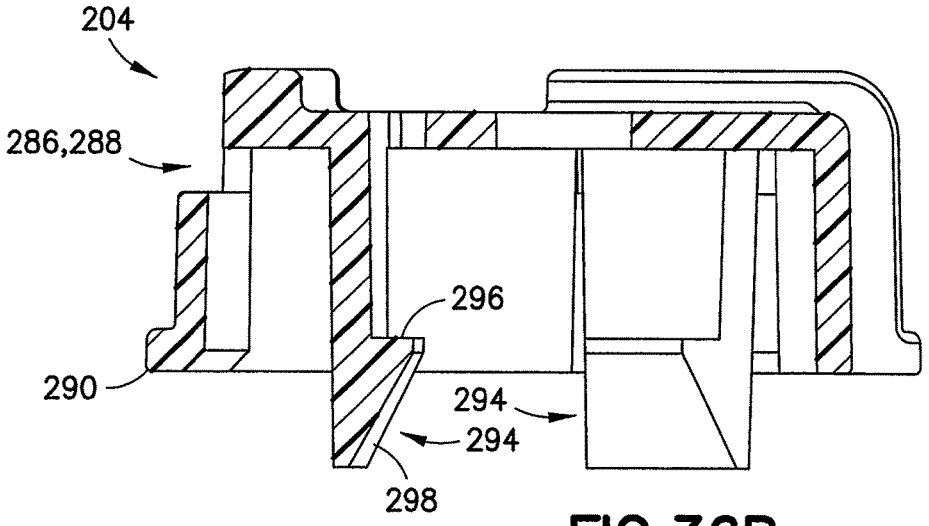
FIG. 36B is a cross-sectional view of an adapter taken along line 36B-36B of FIG. 36A in accordance with another aspect of the present invention.
Figure 37:
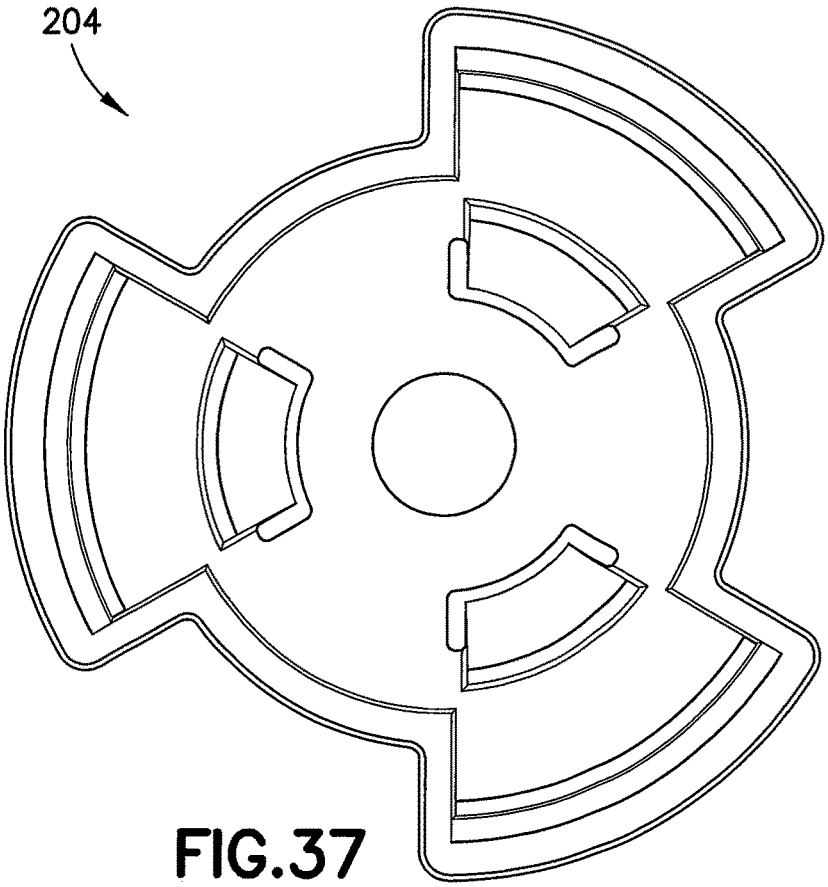
FIG. 37 is a bottom view of an adapter in accordance with another aspect of the present invention.
Figure 38:
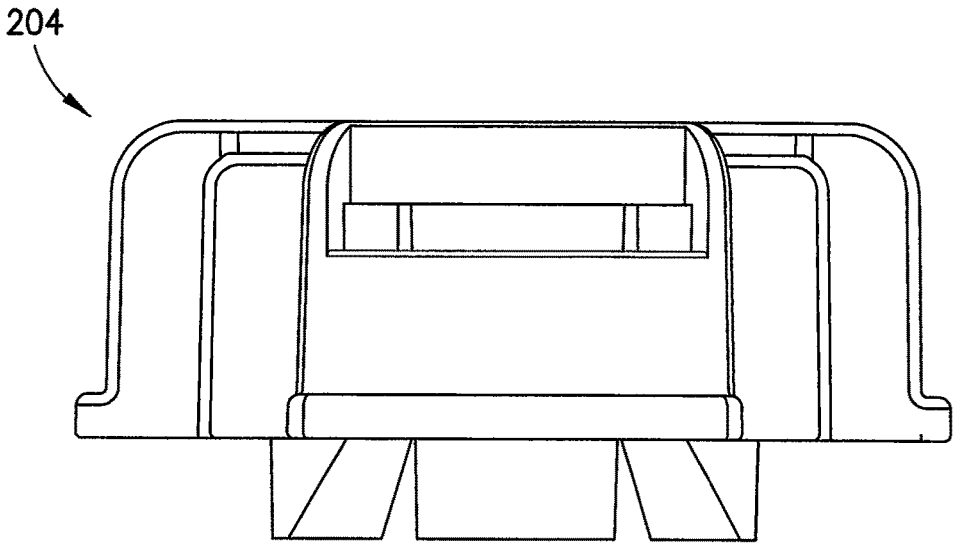
FIG. 38 is a side elevation view of an adapter in accordance with another aspect of the present invention.
Figure 39:
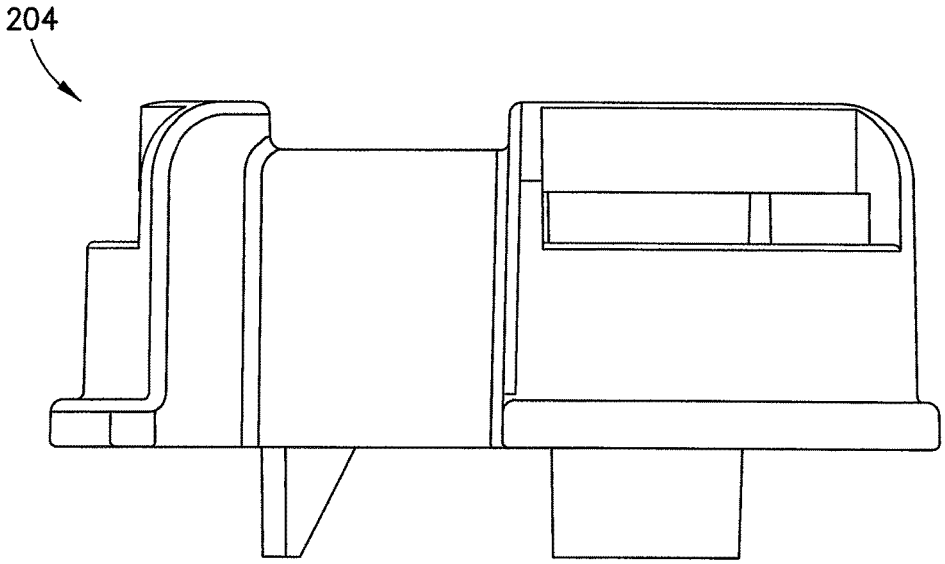
FIG. 39 is another side elevation view of an adapter in accordance with another aspect of the present invention.
Figure 40:
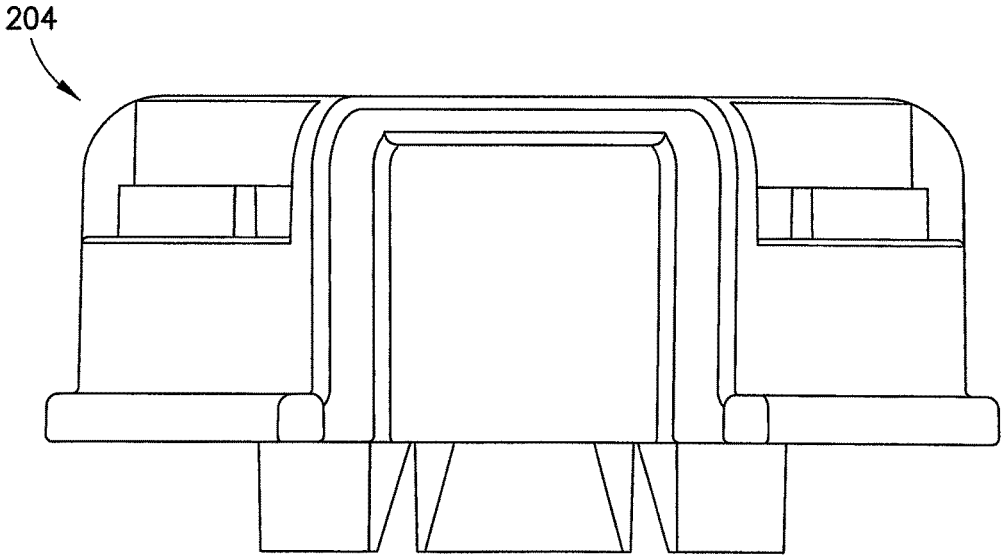
FIG. 40 is another side elevation view of an adapter in accordance with another aspect of the present invention.

In one aspect, access device connection element 286 of third adapter 204 includes a plurality of locking apertures 288 spaced around a periphery of outer shield wall 274 as shown in FIG. 35. Locking apertures 288 are engageable with locking ribs 242 of vial access device 202 to attach third adapter 204 to vial access device 202 with the third adapter 204 in the shield position to shield spike member 228 of vial access device 202 as shown in FIGS. 42-46B and as described in more detail below.

Referring to FIGS. 34-40, inner shield walls 280 of third adapter 204 include a vial connection element 292. In one aspect, vial connection element 292 includes a plurality of vial grip members 294 having hook protrusions 296 and angled walls 298. In one aspect, vial grip members 294 are elastically deformable. Vial grip members 294 are attachable to a second vial 90 to secure third system 200 to the second vial 90. Each vial grip member 294 includes a hook protrusion 296 arranged to engage a corresponding flange 97 on a container such as second vial 90 as shown in FIGS. 55-56B. Vial connection element 292 of third adapter 204 may be dimensioned to be attached to containers of any size and volume. In other aspects, vial connection element 292 of third adapter 204 may include other connection mechanisms for securing third adapter 204 to second vial 90 such as a threaded portion, a snap fit mechanism, locking tabs, or other similar mechanism. Each vial grip member 294 includes an angled wall 298 arranged to provide a lead-in surface to center and align third system 200 on a vial.

Referring to FIGS. 42-46B, as described above, third adapter 204 is attachable to vial access device 202 such that third adapter 204 shields a spike member 228 of vial access device 202 in a shield position. Third adapter 204 is attachable to vial access device 202 by engagement of locking apertures 288 of third adapter 204 with locking ribs 242 of vial access device 202 to attach third adapter 204 to vial access device 202 with the third adapter 204 in the shield position to shield spike member 228 of vial access device 202 as shown in FIGS. 42-46B In this manner, third adapter 204 is secured to vial access device 202 such that third adapter 204 is prevented from significant relative movement relative to vial access device 202.

In the shield position, third adapter 204 is particularly advantageous in that it allows a user, such as a patient and/or healthcare worker, to safely handle vial access device 202 without receiving spike stick injuries from piercing tip 230 of spike member 228. With third adapter 204 in the shield position as described above, third adapter 204 provides a physical barrier preventing the fingers of a user from contacting piercing tip 230 of spike member 228. In this manner, the user is prevented from spike stick injuries and the user can conveniently and safely handle vial access device 202 and remove vial access device 202 from packaging.

After vial access device 202 is safely removed from packaging and safely handled with third adapter 204 shielding spike member 228 as described above, third adapter 204 may be removed from vial access device 202. Next, if it is desired to use a system that provides substantially leak-proof sealing during engagement of a cannula with a first vial 80 defining a first vial size 81, vial access device 202 can be used and attached to first vial 80 as shown in FIGS. 53-54B. Vial grip members 248 of vial access device 202 are attachable to first vial 80 to secure vial access device 202 to first vial 80. Each vial grip member 248 includes a hook protrusion 250 arranged to engage a corresponding flange 87 on a container such as first vial 80 as shown in FIG. 54B. Referring to FIGS. 53-54B, with vial access device 202 attached to first vial 80, vial access device 202 provides substantially leak-proof sealing during engagement of a cannula with first vial 80, during transfer of a substance from vial chamber 86 to a barrel chamber via the cannula, and during disengagement of the cannula from first vial 80.

In another application of third system 200 of the present disclosure, after vial access device 202 is safely removed from packaging and safely handled with third adapter 204 shielding spike member 228 as described above, third adapter 204 may be removed from vial access device 202. Next, if it is desired to use a system that provides substantially leak-proof sealing during engagement of a cannula with a second vial 90 defining a second vial size 91, the second vial size 91 being less than first vial size 81, third adapter 204 can be used and attached to second vial 90 as shown in FIGS. 55-56B. After third adapter 204 is removed from vial access device 202, third adapter 204 can be rotated from the shield position as shown in FIGS. 42-46B to the vial position as shown in FIGS. 47-52 and 55-56B. In the vial position, third adapter 204 can be used and attached to second vial 90 as shown in FIGS. 55-56B. The third adapter 204 is secured to the vial access device 202 by the vial grip members 248 of the vial access device 202 engaging the bottom of the outer portion 272 of the third adapter 204. The vial grip members 248 may be secured to the third adapter 204 in the same manner that the vial grip members 248 are secured to the flange 87 on the first vial 80 as described above. In this manner, third adapter 204 is secured to vial access device 202 such that third adapter 204 is prevented from significant relative movement relative to vial access device 202.

Vial grip members 294 of third adapter 204 are attachable to second vial 90 to secure vial access device 202 to second vial 90 via third adapter 204 as shown in FIGS. 55-56B. Each vial grip member 294 of third adapter 204 includes a hook protrusion 296 arranged to engage a corresponding flange 97 on a container such as second vial 90 as shown in FIG. 56B. The third adapter 204 may be secured to the second vial 90 first with the vial access device 202 subsequently secured to the third adapter 204. Referring to FIGS. 55-56B, with vial access device 202 attached to second vial 90 via third adapter 204, third system 200 provides substantially leak-proof sealing during engagement of a cannula with second vial 90, during transfer of a substance from vial chamber 96 to a barrel chamber via the cannula, and during disengagement of the cannula from second vial 90. With third adapter 204 and vial access device 202 secured to second vial 90, spike member 228 of vial access device 202 is able to extend through spike cavity 284 of third adapter 204 as shown in FIG. 56B.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A system selectively attachable to a first vial defining a first vial size and a second vial defining a second vial size, the second vial size different than the first vial size, the system comprising:

a vial access device including a spike, the vial access device directly attachable to the first vial, the vial access device having a first connection element attachable to the first vial to secure the vial access device to the first vial; and an adapter movable relative to the vial access device between a shield position in which the adapter is attachable to the vial access device such that the adapter shields the spike of the vial access device and a vial position in which the adapter is attachable to the second vial.

2. The system of claim 1, wherein the vial access device further comprises an adapter connection element, the first connection element comprising elastically deformable vial grip members, and the adapter further comprises an access device connection element and a vial connection element, the adapter movable between the shield position in which the access device connection element is attachable to the adapter connection element of the vial access device to secure the adapter to the vial access device such that the adapter shields the spike of the vial access device and the vial position in which the vial connection element is attachable to the second vial to secure the adapter to the second vial.

3. The system of claim 2, wherein the access device connection element of the adapter comprises an external latch.

4. The system of claim 2, wherein the access device connection element of the adapter comprises an internal latch.

5. The system of claim 2, wherein the vial connection element of the adapter comprises a plurality of adapter vial grip members.

6. The system of claim 5, wherein the plurality of adapter vial grip members are elastically deformable.

7. The system of claim 2, wherein the first connection element of the vial access device is configured to secure the adapter to the vial access device when the adapter is in the vial position.

8. The system of claim 2, wherein the adapter comprises a horizontal shield wall, an outer portion extending from the periphery of the horizontal shield wall, and an inner portion extending from the horizontal shield wall.

9. The system of claim 8, wherein the horizontal shield wall of the adapter defines a spike cavity that is configured to receive the spike when the adapter is in the vial position.

10. The system of claim 8, wherein the access device connection element comprises a plurality of external latches spaced around a periphery of the outer portion of the adapter, the vial access device defining a plurality of slots configured to receive the plurality of external latches when the adapter is in the shield position.

11. The system of claim 8, wherein the access device connection element comprises a plurality of locking apertures spaced around a periphery of the outer portion of the adapter, the vial access device comprising a locking protrusion configured to be received by the plurality of locking apertures when the adapter is in the shield position.

12. The system of claim 1, wherein the second vial size is less than the first vial size.

13. The system of claim 1, further comprising a first vial defining a first vial size, and a second vial defining a second vial size, the second vial size different than the first vial size, wherein the vial access device further comprises a first connection element attachable to the first vial to secure the vial access device to the first vial, and wherein the adapter is attachable to the second vial.

14. The system of claim 1, wherein the adapter comprises an alignment guide configured to position the vial access device during installation of the vial access device onto the second vial when the adapter is in the vial position.

15. A system comprising:

a first vial defining a first vial size;

a second vial defining a second vial size, the second vial size different than the first vial size;

a vial access device including a spike, the vial access device directly attachable to the first vial, the vial access device having a first connection element attachable to the first vial to secure the vial access device to the first vial; and an adapter movable relative to the vial access device between a shield position in which the adapter is attachable to the vial access device such that the adapter shields the spike of the vial access device and a vial position in which the adapter is attachable to the second vial.

* * * * *